US010551100B2

(12) United States Patent
Park et al.

(10) Patent No.: US 10,551,100 B2
(45) Date of Patent: Feb. 4, 2020

(54) REFRIGERATOR AND METHOD FOR CONTROLLING THE SAME

(71) Applicant: SAMSUNG ELECTRONICS CO., LTD., Suwon-si, Gyeonggi-do (KR)

(72) Inventors: Jung Won Park, Suwon-si (KR); Sung Ho Cho, Suwon-si (KR); Kyung Tae Ko, Suwon-si (KR); Seung Wan Kang, Yongin-si (KR); Woo Sung Kim, Suwon-si (KR); Chang Hern Lee, Suwon-si (KR); Gang Hyun Kim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 59 days.

(21) Appl. No.: 15/551,409

(22) PCT Filed: Feb. 2, 2016

(86) PCT No.: PCT/KR2016/001096

§ 371 (c)(1),
(2) Date: Aug. 16, 2017

(87) PCT Pub. No.: WO2016/133300

PCT Pub. Date: Aug. 25, 2016

(65) Prior Publication Data

US 2018/0045442 A1 Feb. 15, 2018

Related U.S. Application Data

(60) Provisional application No. 62/212,138, filed on Aug. 31, 2015.

(30) Foreign Application Priority Data

Feb. 17, 2015 (KR) ..... 10-2015-0024064
Jan. 12, 2016 (KR) ..... 10-2016-0003653

(51) Int. Cl.
*F25B 41/04* (2006.01)
*F25D 23/12* (2006.01)
(Continued)

(52) U.S. Cl.
CPC ..... *F25B 41/04* (2013.01); *F25B 1/005* (2013.01); *F25C 5/22* (2018.01); *F25D 11/02* (2013.01);
(Continued)

(58) Field of Classification Search
CPC ..... F25C 2600/04; F25C 2600/02; B01F 3/04794; B01F 3/04106; F25D 23/126;
(Continued)

(56) References Cited

U.S. PATENT DOCUMENTS

2006/0196214 A1* 9/2006 Lee ..... F25D 17/065 62/344
2011/0162392 A1* 7/2011 Lim ..... F25D 29/00 62/66
2013/0309361 A1* 11/2013 Kyong ..... F25D 23/126 426/67

FOREIGN PATENT DOCUMENTS

CN 104019611 A 9/2014
CN 104019612 A 9/2014
(Continued)

OTHER PUBLICATIONS

Written Opinion, PCT/ISA/237, dated May 20, 2016, in corresponding International Patent Application No. PCT/KR2016/001096.
(Continued)

*Primary Examiner* — Cassey D Bauer
(74) *Attorney, Agent, or Firm* — Staas & Halsey LLP

(57) ABSTRACT

A refrigerator including a water intake container, in which carbonated water is produced by mixture of carbon dioxide and clean water, a first dispenser assembly, which the water intake container is attached to or detached from, and which supplies carbon dioxide and clean water to the water intake container when the water intake container is attached to the first dispenser, a dispenser lever and a second dispenser assembly which discharges clean water or ice according to manipulation of the dispenser lever, but stops the discharging of clean water or ice if the water intake container is
(Continued)

attached to the first dispenser assembly. The refrigerator may include a dispenser lever and a processor to control an ice maker to stop operation if a command is entered through a user interface and to control the ice maker to start operation if the dispenser lever is manipulated while the ice maker stops operation.

10 Claims, 42 Drawing Sheets

(51) Int. Cl.

| | |
|---|---|
| ***F25C 5/20*** | (2018.01) |
| ***F25B 1/00*** | (2006.01) |
| ***F25D 11/02*** | (2006.01) |
| ***F25D 25/00*** | (2006.01) |
| ***F25D 29/00*** | (2006.01) |

(52) U.S. Cl.
CPC ..... *F25D 23/126* (2013.01); *F25D 25/005* (2013.01); *F25D 29/005* (2013.01); *F25C 2400/10* (2013.01); *F25C 2400/14* (2013.01); *F25D 2400/361* (2013.01)

(58) Field of Classification Search
CPC ..... F25D 2323/122; F25D 25/005; F25D 2400/10
See application file for complete search history.

(56) References Cited

FOREIGN PATENT DOCUMENTS

| | | | |
|---|---|---|---|
| CN | 104019622 | A | 9/2014 |
| EP | 1 378 716 | A1 | 1/2004 |
| KR | 1999-0062189 | | 7/1999 |
| KR | 10-2008-0057221 | | 6/2008 |
| KR | 10-2010-0030722 | | 3/2010 |
| KR | 10-2010-0137378 | | 12/2010 |
| KR | 10-2014-0108065 | | 9/2014 |
| WO | WO 2012/162762 | A1 | 12/2012 |

OTHER PUBLICATIONS

International Search Report, PCT/ISA/210, dated May 20, 2016, in corresponding International Patent Application No. PCT/KR2016/001096.

Extended European Search Report dated Dec. 15, 2017, in corresponding European Patent Application No. 16752630.0.

European Office Action dated Apr. 17, 2019 in corresponding European Patent Application No. 16752630.0.

Chinese Office Action dated Jun. 25, 2019 in corresponding Chinese Patent Application No. 201680010339.7.

* cited by examiner

420:421~426

420:421~426

420:421~426

420:421~426

REFRIGERATOR AND METHOD FOR CONTROLLING THE SAME

CROSS-REFERENCE TO RELATED APPLICATION

This application is a U.S. National Stage Application under 35 U.S.C. § 371 of International Patent Application No. PCT/KR2016/001096, filed Feb. 2, 2016, which claims the benefit of U.S. Provisional Patent Application No. 62/212,138, filed Aug. 31, 2015, and claims foreign priority benefit under 35 U.S.C. § 119 of Korean Patent Application No. 10-2015-0024064, filed Feb. 17, 2015, and Korean Patent Application No. 10-2016-0003653, filed Jan. 12, 2016, the contents of which are incorporated herein by reference.

TECHNICAL FIELD

The present disclosure relates to a refrigerator and method for controlling the same.

BACKGROUND ART

Refrigerators are devices for keeping things like food or medicines below a certain temperature. To store the things under the certain temperature, the refrigerator has a storage room for storing things and a cooler for maintaining the storage room under the certain temperature by supplying cool air to the storage room.

The refrigerator may maintain the temperature in the storage room below a level desired by the user by repeatedly evaporating and compressing refrigerants. For this cyclic repetitive evaporation and compression of the refrigerant, an evaporator, a compressor, a condenser, an expansion valve, and the like are installed in the refrigerator.

The refrigerator may further have parts installed therein to perform many additional functions to meet various demands from the user. Form example, the refrigerator may be equipped with an ice maker for forming ice, and further a dispenser for supplying clean water or ice to the user without opening the door of the refrigerator.

DISCLOSURE

Technical Problem

An object of the present disclosure is to provide a refrigerator and method for controlling the same, by which the refrigerator capable of producing carbonated water by attaching a water intake container to a carbonated water maker module may prevent mishandling of a dispenser lever for supplying clean water or ice during the attachment of the water intake container.

Another object of the present disclosure is to provide a refrigerator and method for controlling the same, which may change the function of an ice maker into an operating state based on manipulation of the dispenser lever even while the function of the ice maker is set to stop.

Technical Solution

To achieve the aforementioned objects, a refrigerator and method for controlling the same is provided.

A refrigerator may comprise a water intake container, in which carbonated water is produced by mixture of carbon dioxide and clean water, a first dispenser assembly, to or from which the water intake container is attached or detached, and which supplies carbon dioxide and clean water to the water intake container, a dispenser lever and a second dispenser assembly to discharge clean water or ice according to manipulation of the dispenser lever and to stop the dispenser-lever-manipulation-based discharging of clean water or ice if the water intake container is attached to the first dispenser assembly.

The second dispenser assembly may be able to discharge clean water or ice according to manipulation of the dispenser lever, if the water intake container is detached from the first dispenser assembly.

The first dispenser assembly may include an attachment body, to or from which the water intake container is attached or detached.

The dispenser lever may be installed adjacent to the attachment body.

The dispenser lever may be manipulated by being moved in a direction in which the attachment body is installed or the opposite direction, according to an applied pressure.

The first dispenser assembly may further comprise an attachment sensor to detect whether the water intake container is attached to the attachment body.

The refrigerator may further comprise a processor configured to determine whether the water intake container is attached to the attachment body based on an electric signal output from the attachment sensor, and if the water intake container is attached to the attachment body, generate no control signal corresponding to an electric signal output from the dispenser lever.

The first dispenser assembly may comprise a clean water inflow valve configured to regulate clean water supply to the water intake container, and the second dispenser assembly includes a dispenser supply valve configured to regulate supply of clean water or ice discharged.

The refrigerator may further comprise a processor configured to control the clean water inflow valve to be opened and the dispenser supply valve to be closed if the water intake container is attached to the first dispenser assembly.

The refrigerator may further comprise a processor configured to control the clean water inflow valve to be closed and the dispenser supply valve to be opened if the water intake container is detached from the first dispenser assembly.

The refrigerator may comprise an ice maker configured to perform an ice making operation and a user interface configured to receive a command for at least one of start and stop of the ice making operation of the ice maker.

The ice maker may be configured to stop the ice making operation if receiving a command to stop the ice making operation through the user interface.

The ice maker may be configured to start the ice making operation if the dispenser lever is manipulated while operation of the ice maker is stopped.

The user interface may be configured to output information about the start of operation of the ice maker if the ice maker starts operation.

The ice maker may be configured to stop the ice making operation if manipulation of the dispenser lever is completed.

The user interface may be configured to output information about the stop of operation of the ice maker if the ice maker stops operation.

The refrigerator may further comprise a processor configured to count time from when manipulation of the dispenser is completed if the manipulation of the dispenser lever is completed, and control the ice maker to stop operation if the count result exceeds a predetermined value.

The refrigerator may further comprise a processor configured to measure a period for which the dispenser lever is manipulated if the dispenser lever is manipulated while the ice maker stops its operation, and control the ice maker to start operation if the measurement result exceeds a predetermined value.

The user interface may be configured to include at least one of a mechanical button, a knob, a trackball, a touch pad, a touch button, a track pad, a lever, a photo detection sensor, and a touch detection sensor, or include a terminal device remote from the refrigerator.

A refrigerator may comprise an ice maker configured to perform an ice making operation, a user interface configured to receive a command for at least one of start and stop of the ice making operation of the ice maker, a dispenser lever and a processor configured to control the ice maker to stop its operation if a command to stop ice making is entered through the user interface, and control the ice maker to start its operation if the dispenser lever is manipulated while the ice maker stops its operation.

A method for controlling a refrigerator, the method may comprise determining whether a water intake container is attached to a first dispenser assembly, wherein the water intake container is a container in which carbonated water is produced by mixture of carbon dioxide and clean water, supplying carbon dioxide and clean water, by the first dispenser assembly, to the water intake container, if the water intake container is attached to the first dispenser assembly and blocking operation of a second dispenser assembly configured to discharge clean water or ice according to manipulation of a dispenser lever.

The method for controlling a refrigerator may further comprise discharging, by the second dispenser assembly, clean water or ice according to manipulation of the dispenser lever, if the water intake container is detached from the first dispenser assembly and the dispenser lever is manipulated.

The first dispenser assembly may include an attachment body, to or from which the water intake container is attached or detached.

The dispenser lever may be installed adjacent to the attachment body.

The dispenser lever may be manipulated by being moved in a direction in which the attachment body is installed or the opposite direction, according to an applied pressure.

The first dispenser assembly may further comprise an attachment sensor to detect whether the water intake container is attached to the attachment body.

The blocking operation of a second dispenser assembly configured to discharge clean water or ice according to manipulation of a dispenser lever may comprises blocking generation of an electric signal output from the dispenser lever if the water intake container is attached to the attachment body.

The first dispenser assembly comprises a clean water inflow valve configured to regulate clean water supply to the water intake container, and the second dispenser assembly may include a dispenser supply valve configured to regulate supply of clean water or ice discharged.

The blocking operation of a second dispenser assembly configured to discharge clean water or ice according to manipulation of a dispenser lever may comprises controlling the clean water inflow valve to be opened and the dispenser supply valve to be closed if the water intake container is attached to the first dispenser assembly.

The blocking operation of a second dispenser assembly configured to discharge clean water or ice according to manipulation of a dispenser lever may comprises controlling the clean water inflow valve to be closed and the dispenser supply valve to be opened if the water intake container is detached from the first dispenser assembly.

The method for controlling a refrigerator may further comprise receiving a command to stop ice making operation of an ice maker and stopping, by the ice maker, its operation according to the command to stop ice making operation of the ice maker.

The method for controlling a refrigerator may further comprise starting, by the ice maker, ice making operation, if the dispenser lever is manipulated while the ice maker stops its operation and the water intake container is not attached to the first dispenser assembly.

The method for controlling a refrigerator may further comprise outputting information about start of operation of the ice maker if the ice maker starts operation.

The method for controlling a refrigerator may further comprise stopping, by the ice maker, the ice making operation if manipulation of the dispenser lever is completed.

The method for controlling a refrigerator may further comprise outputting information about stop of operation of the ice maker if the ice maker stops operation.

The stopping, by the ice maker, the ice making operation if manipulation of the dispenser lever is completed may comprises measuring time from when manipulation of the dispenser lever is completed if the manipulation of the dispenser lever is completed, and stopping, by the ice maker, operation if the measurement result exceeds a predetermined value.

The starting, by the ice maker, ice making operation, if the dispenser lever is manipulated may comprises measuring a period in which the dispenser lever is manipulated if the dispenser lever is manipulated, and starting, by the ice maker, operation if the measurement result exceeds a predetermined value.

A method for controlling a refrigerator, the method may comprise receiving a command to stop ice making operation of an ice maker, stopping, by the ice maker, its operation according to the command to stop ice making operation and starting, by the ice maker, ice making operation, if a dispenser lever is manipulated after the ice maker stops its operation.

The method for controlling a refrigerator may further comprise stopping, by the ice maker, the ice making operation if manipulation of the dispenser lever is completed.

Advantageous Effects

The aforementioned refrigerator and method for controlling the same may prevent unintended manipulation of a dispenser lever while a user is attaching a water intake container to a carbonated water maker module to produce carbonated water from triggering operation of a dispenser to discharge clean water or ice, and accordingly, prevent an accident that might happen due to discharging of clean water or ice Also, according to the aforementioned refrigerator and method for controlling the same, even if a user mistakenly manipulates the dispenser lever while making carbonated water by attaching the water intake container to the carbonated water maker module, supply of the water or ice is blocked, thereby improving convenience of use for the user.

Also, according to the aforementioned refrigerator and method for controlling the same, the user may make and take carbonated water stably and safely in using the refrigerator that may produce and supply carbonated water, and thus use the refrigerator more conveniently.

Furthermore, according to the aforementioned refrigerator and method for controlling the same, the user may easily obtain ice by controlling the ice maker to operate just with manipulation of the dispenser lever even in a state in which the operation of the ice maker is stopped, and thus convenience of use of the refrigerator may be improved.

Moreover, according to the aforementioned refrigerator and method for controlling the same, if operation of the ice maker is stopped, the ice maker may be activated only after the lapse of a certain period of time from when the operation of the ice maker is stopped even if the user manipulates the dispenser lever, thereby preventing unnecessary operation of the ice maker even if the dispenser lever is mistakenly manipulated.

In addition, according to the aforementioned refrigerator and method for controlling the same, if the dispenser lever is not operating for a certain period of time, operation of the ice maker may be automatically stopped, thereby preventing unnecessary operation of the ice maker and accordingly, obtaining a power saving effect.

MODES OF THE INVENTION

Various embodiments of a refrigerator will now be described with reference to FIGS. 1 to 36.

Figure 1:
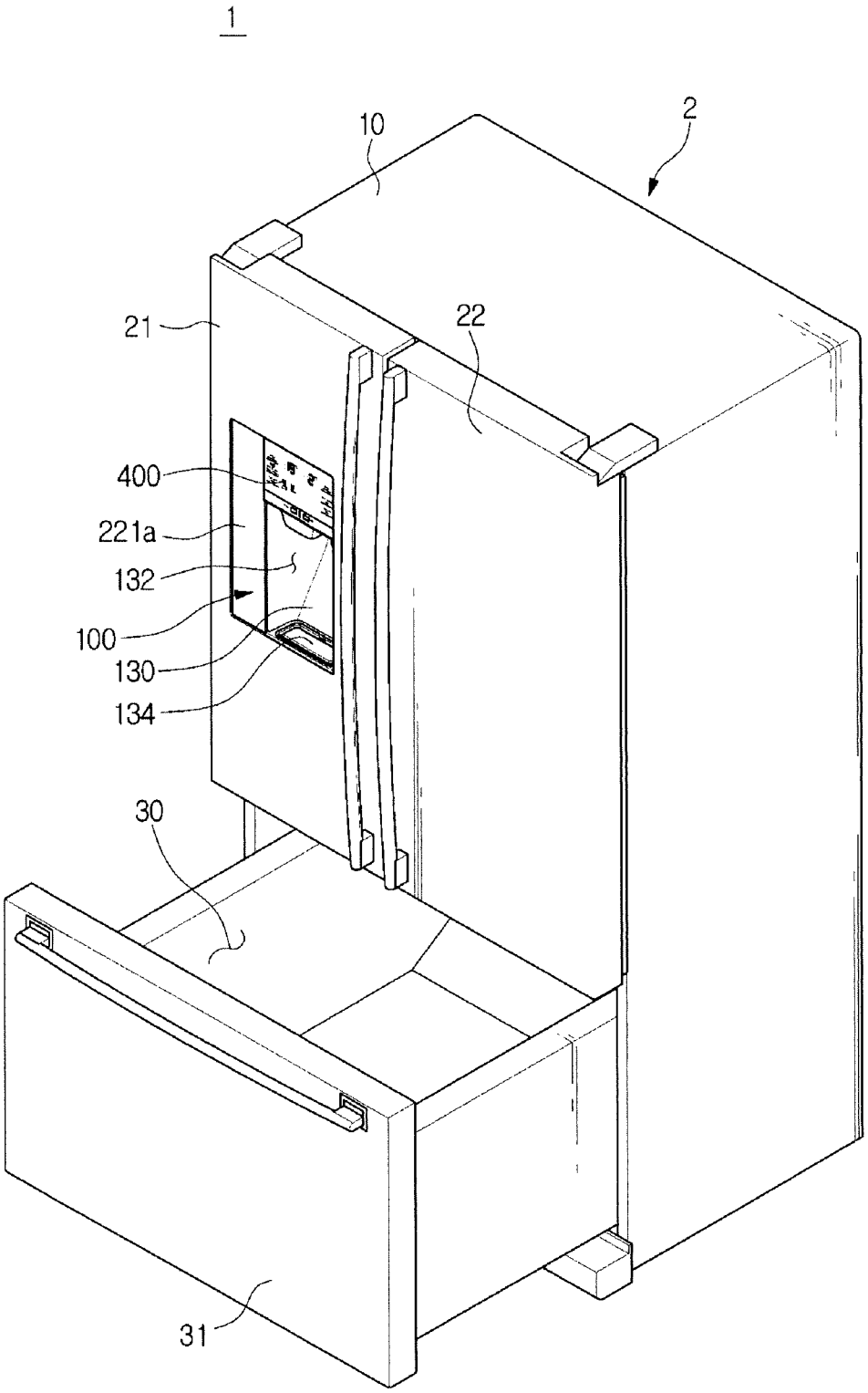
FIG. 1 is a perspective view illustrating an embodiment of the exterior of a refrigerator with doors closed.
Figure 2:
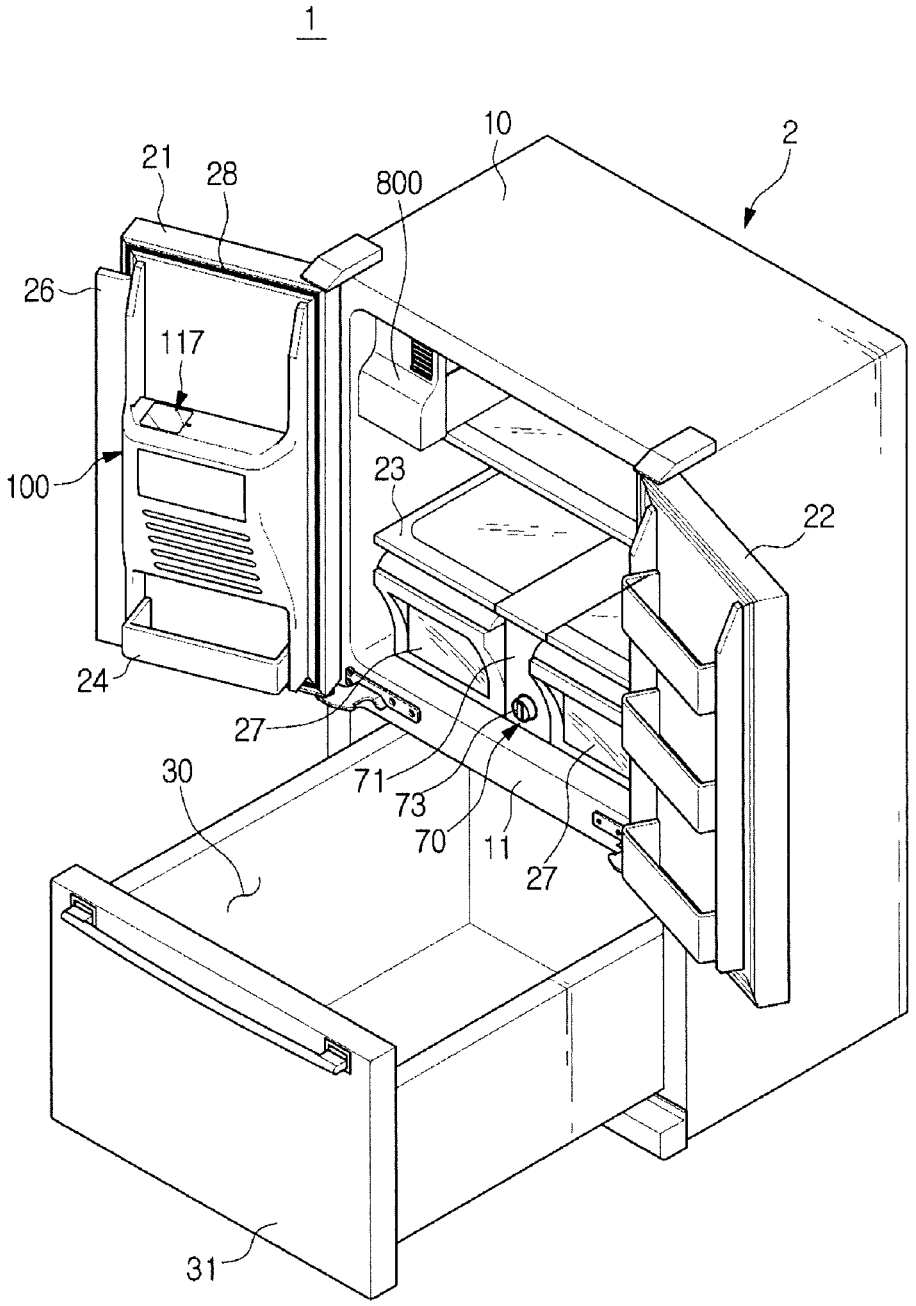
FIG. 2 is a perspective view illustrating an embodiment of the exterior of a refrigerator with doors open.

FIG. 1 is a perspective view illustrating an embodiment of the exterior of a refrigerator with doors closed, and FIG. 2 is a perspective view illustrating an embodiment of the exterior of a refrigerator with doors open.

Referring to FIGS. 1 and 2, a refrigerator 1 may include a main body 10 that forms the exterior of the refrigerator 1, and one, two or more storage rooms 20, 30 formed in the internal space of the main body 10. On a side of the main body 10, there may be a door 21, 22, 31 arranged to open or close the storage room 20, 30.

The main body 10 may include an inner casing that forms the storage rooms 20, 30, an outer casing combined with the outside of the inner casing to form the exterior of the refrigerator, and an insulation placed between the inner casing and the outer casing to insulate the storage rooms 20, 30.

The storage rooms 20, 30 may be divided into a plurality of storage rooms 20, 30 by a middle partition wall 11, in which case the middle partition wall 11 may divide the storage rooms 20, 30 into upper and lower rooms or left and right rooms. In an embodiment, the refrigerator 1 may include a plurality of middle partition walls 11, by which the storage rooms 20, 30 may be arranged in the refrigerator 1 by being partitioned into three or more.

The plurality of storage rooms 20, 30 may include a refrigerating room for keeping things cold and a freezing room for keeping things frozen. The storage rooms 20, 30 may be kept at certain temperature, e.g., at 3 degrees above zero to keep things cold, and the freezing room may be kept at a certain temperature, e.g., about 18.5 degrees below zero to keep things frozen. Apart from this, the temperatures of the storage rooms 20, 30 may be differently set according to the user's selection. In this case, the user may set the temperatures inside the storage rooms 20, 30 using a user interface 400.

The 'things' may refer to various items that may be kept refrigerated in a low temperature condition, e.g., food or medicines.

In at least one storage room 20, a rack 23 on which to put things may be provided and at least one storage box 27 may also be placed to seal and store things. The at least one storage box 27 may be installed in the storage room 20 to be drawn out from the inside of the storage room 20 by the user.

An ice maker 800 may be installed inside the storage room 20, 30. The ice maker 800 is a device for forming ice by freezing clean water supplied. In some embodiments, the ice maker 800 may be installed inside the refrigerating room or inside the freezing room. The ice formed in the ice maker 800 may be discharged out of the ice maker 800 and released through an ice connection path 117 arranged inside of the door 21 and connected to a dispenser assembly 100 and an outlet 116 to a water intake space 132. Details of the ice maker 800 will be described later.

In addition, various devices for convenience for the user may be installed in the storage room 20.

The storage rooms 20, 30 may have the front open to take out food, and the open front may be opened or closed by a pair of doors 21, 22 hinged with the main body 10. In some embodiments, the open front may be opened or closed by a sliding door 31 that may slide in and out of the main body 10.

The storage room doors 21, 22 may include a front side exposed to the outside if the storage rooms 20, 30 are closed, and a rear side directed toward the storage rooms 20, 30.

On the front side of at least one of the storage room doors 21, 22, part of the dispenser assembly 100 may be exposed and the user interface 400 for receiving control commands related to operation of the refrigerator 1 from the user or for displaying operation information of the refrigerator 1 may further be arranged.

Figure 3:
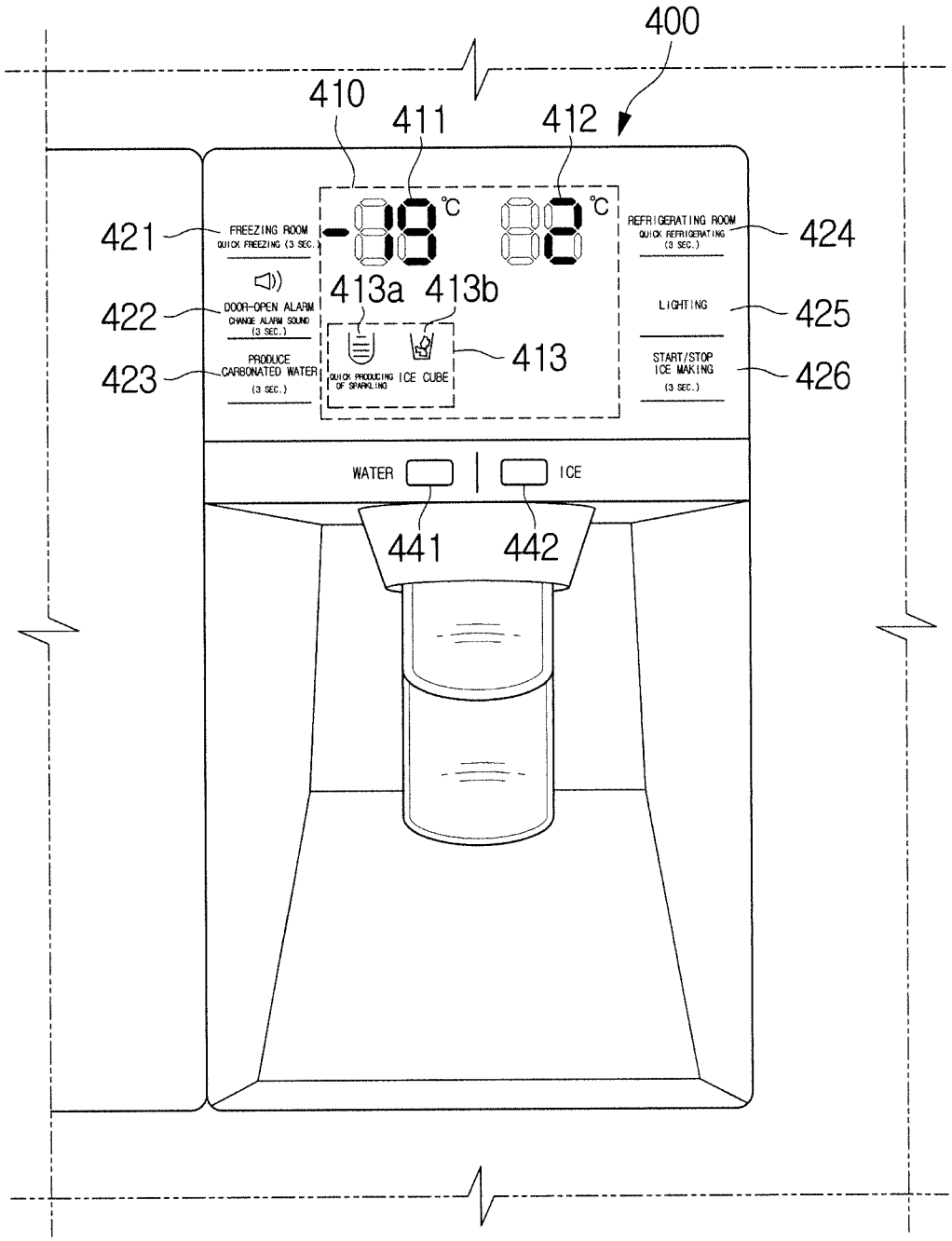
FIG. 3 shows an embodiment of a user interface.

FIG. 3 shows an embodiment of a user interface.

Referring to FIG. 3, the user interface 400 may include a display 410 for providing a variety of information for the user and an input unit 420 for receiving various commands from the user.

The display 410 is configured to display and provide the user with current operation state of the refrigerator 1, operation-related settings of the refrigerator 1, and at least one of various information required for user convenience for the user.

The display 410 may display information regarding current operation state of the refrigerator. For example, the display 410 may display current internal temperatures 411, 412 of the storage rooms 20, 30, respectively. In this case, one 411 of the internal temperatures 411, 412 corresponds to a temperature of the freezing room while the other 412 corresponds to a temperature of the refrigerating room. The display 410 may also display information for the user regarding a current state related to operation of the refrigerator 1, such as an amount of remaining carbon dioxide in a carbon dioxide cylinder 222. Besides, it may display concentrations of the produced carbonated water, and a variety of information required for user convenience.

The display 410 may also display information 413 about what operation the refrigerator is currently performing. For example, the display 410 may display information 413*a* about whether carbonated water making operation is being performed or information 413*b* about whether the ice maker 800 is performing ice making operation in at least one of characters, symbols, numbers, and various figures.

Furthermore, the display 410 may display current settings of various functions of the refrigerator 1, e.g., temperature setting values of the storage rooms 20, 30, setting values about an amount of carbon dioxide given in producing carbonated water, etc., and even display information about whether the dispenser assembly 100 is currently set to provide clean water or ice.

The display 410 may be implemented using e.g., at least one lighting device. The lighting device may be implemented using various kinds of lightings, such as incandescent light bulbs, halogen lamps, fluorescent lamps, natrium lamps, mercury lamps, mercury fluorescent lamps, xenon lamps, arc lightings, neon tube lamps, electroluminescent (EL) lamps, light emitting diode (LED) lamps, cold cathode fluorescent (CCFL) lamps, external electrode fluorescent (EEFL) lamps or the like, and may display operation or state of the refrigerator for the user by using blinking patterns or colors of light.

Moreover, in another example, the display 410 may be implemented using a lighting device and a substrate on which a light emitting port is formed. The light emitting port is implemented in a certain shape and formed for the light irradiated by the lighting device to be emitted. The display 410 may provide various information for the user based on the shape of the light emitting port.

In yet another example, the display 410 may be implemented using various kinds of display panels. Here, the display panel may be implemented using a liquid crystal display (LCD) panel, an LED display panel, etc. The display 410 may be implemented with a touch screen, in which case the display 410 may also have the function of the input unit 420.

The input unit 420 may receive various user commands related to operation of the refrigerator 1. The input unit 420 may output a certain electric signal based on manipulation of the user, and send the output signal through a circuit or wire to a control device, e.g., a processor (300 of FIG. 26 or 31) for controlling the refrigerator. The input unit 420 may receive various commands required to control the refrigerator 1 from the user, such as a target temperature of the storage room 20, a target temperature of the freezing room 30, a command to produce carbonated water, a target concentration of the carbonated water, etc.

For example, as shown in FIG. 3, the input unit 420 may include at least one of a unit 421 to input a control command for freezing room temperature, a unit 422 to input a control command about whether to notify door-open, a unit 423 to input a command to produce carbonated water, a unit 424 to input a control command for refrigerating room temperature, a unit 425 to input a command to drive lighting, a unit 426 to input a command to start/stop the ice maker, a unit 441 to input a command to discharge clean water, and a unit 442 to input a command to discharge ice. The user may control the temperature of the freezing room or the refrigerating room 20, 30 by manipulating the unit 421 to input a control command for freezing room temperature and the unit 424 to input a control command for refrigerating room temperature, and input a command to produce carbonated water by manipulating the unit 423 to input a command to produce carbonated water.

The user may also manipulate the unit 426 to input a command to start/stop the ice maker for the ice maker 800 to start or stop ice making operation. In this case, the unit 426 to input a command to start/stop the ice maker may be implemented by a single manipulation means, e.g., a mechanical button, or by a plurality of manipulation means. With the unit 426 to input a command to start/stop the ice maker implemented with a single manipulation means, the user may input the command to start or stop operation of the ice maker 800 by sequentially manipulating the manipulation means. With the unit 426 to input a command to start/stop the ice maker implemented with a plurality of manipulation means, the user may input the command to start or stop operation of the ice maker 800 by manipulating the respective manipulation means.

The user may also input a command to the refrigerator 1 about which one of the clean water and the ice is to be discharged based on manipulation of the dispenser lever 136 by manipulating at least one of the unit 441 to input a command to discharge clean water and the unit 442 to input a command to discharge ice. In this case, if the dispenser lever 136 is manipulated after the unit 441 to input a command to discharge clean water is manipulated, the refrigerator 1 may discharge clean water through the outlet 116, and if the dispenser lever 136 is manipulated after the unit 442 to input a command to discharge ice is manipulated, the refrigerator 1 may discharge ice through the outlet 116.

The aforementioned input units 420 to 428 may be implemented using various input means capable of outputting electric signals based on external manipulation, such as various mechanical buttons, keyboard device knobs, levers, track balls, track pads, operation detection sensors, touch detection sensors, touch buttons, touch pads, photo detection sensors, and touch screen, etc. In some embodiments, the unit 421 to input a control command for freezing room temperature, the unit 422 to input a control command about whether to notify door-open, the unit 423 to input a command to produce carbonated water, the unit 424 to input a control command for refrigerating room temperature, the unit 425 to input a command to drive lighting, the unit 426 to input a command to start/stop the ice maker, the unit 441 to input a command to discharge clean water, and the unit 442 to input a command to discharge ice may be implemented using the same input means or different input means. For example, the unit 421 to input a control command for freezing room temperature, the unit 422 to input a control command about whether to notify door-open, the unit 423 to input a command to produce carbonated water, the unit 424 to input a control command for refrigerating room temperature, the unit 425 to input a command to drive lighting, the unit 426 to input a command to start/stop the ice maker may be implemented using the touch buttons, while the unit 441 to input a command to discharge clean water, and the unit 442 to input a command to discharge ice may be implemented with the mechanical buttons.

Positions, shapes, or implementation types of the unit 421 to input a control command for freezing room temperature, the unit 422 to input a control command about whether to notify door-open, the unit 423 to input a command to produce carbonated water, the unit 424 to input a control command for refrigerating room temperature, the unit 425 to input a command to drive lighting, the unit 426 to input a command to start/stop the ice maker, the unit 441 to input a command to discharge clean water, and the unit 442 to input a command to discharge ice may be implemented in various ways according to the designer's arbitrary selection.

In addition, the user interface 400 may further include a sound output device, such as a speaker device to provide the user with various information related to the refrigerator 1 or required for user convenience.

Although an example of the user interface 400 installed in the refrigerator 1 was described, the user interface 400 may not be directly installed in the refrigerator 1. According to an embodiment, the user interface 400 may be implemented by a terminal remote from the refrigerator 1. The terminal herein used may be implemented using e.g., a smart phone, a cellular phone, a tablet personal computer (PC), a laptop computer, a desktop computer, a portable game device, or a navigation device, etc.

The dispenser assembly 100 may provide clean water, carbonated water or ice through an exposed part on the front, allowing the user to take out the clean water, carbonated water or ice without opening the storage room door 21.

Details of the dispenser assembly 100 will be described later.

Door guards 24 may be arranged on the rear side of the storage room doors 21, 22 for containing food. The storage room doors 21, 22 may be further equipped with gaskets 28 along the edges of the rear side of the storage room doors 21, 22 to prevent leakage of cold air from the storage room 20 by sealing the gap between the storage room doors 21, 22 and the main body 10 when the storage room doors 21, 22 shuts the storage rooms 20, 30.

At least one 21 of the storage room doors 21, 22 may be further equipped with a pivoting bar 26 to prevent leakage of cold air from the storage room 20 by sealing the gap between the storage room doors 21, 22 and the main body 22 when the storage room doors 21, 22 are closed.

In the door 21 of the refrigerator 1, a second dispenser assembly 200 may be installed for producing and providing carbonated water for the user. Detailed configuration and operation of the second dispenser assembly 200 will be described below.

Figure 4:
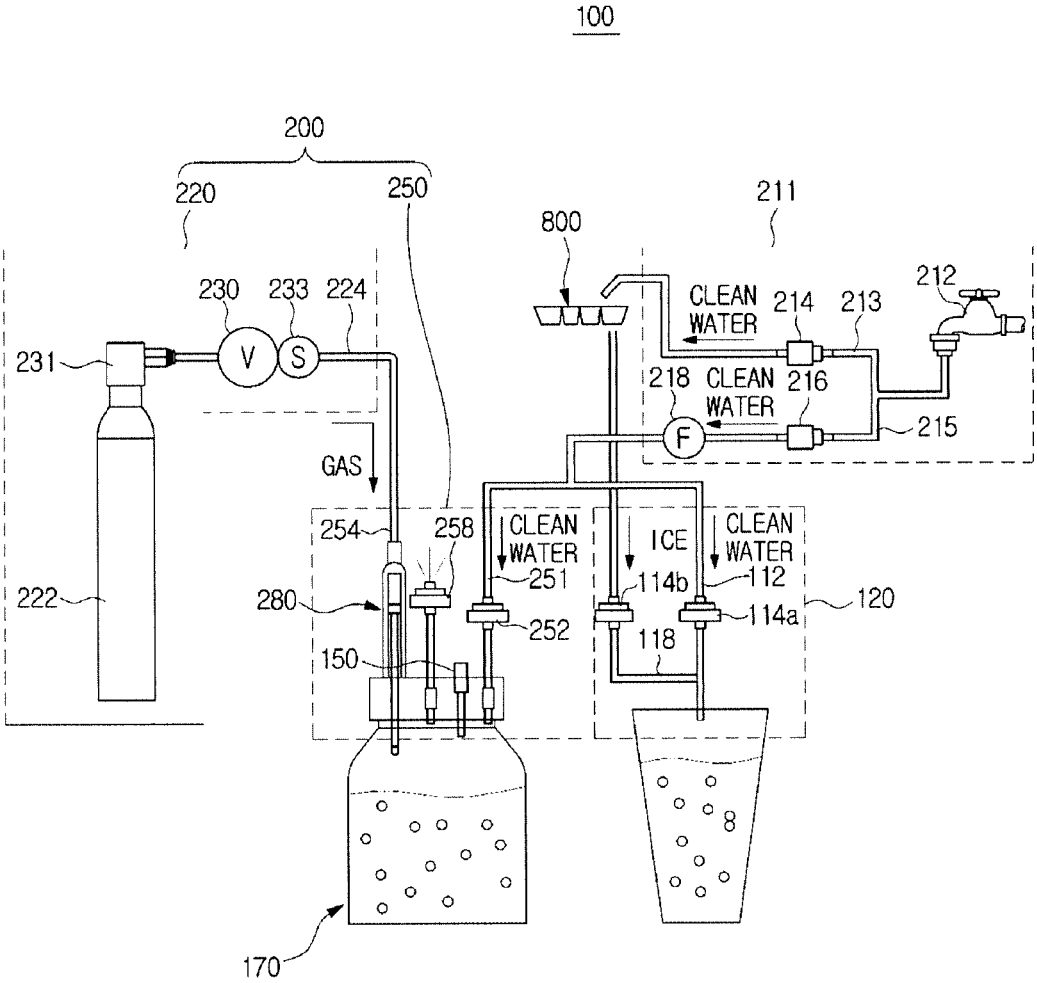
FIG. 4 is a diagram for explaining a carbonated water producing and supplying procedure, and an ice or clean water producing or supplying procedure.

FIG. 4 is a diagram for explaining a dispenser assembly that produces and supplies carbonated water, ice, or clean water in a refrigerator.

The dispenser assembly 100 may include a first dispenser assembly 110 and a second dispenser assembly 200, and further include a clean water supply 211 to supply clean water to the first and second dispenser assemblies 110 and 200.

The clean water supply 211 may include a water supply source 212, a clean water fluid path 215 through which the water to be supplied to the first dispenser assembly 110 or the carbonated water maker module 250 passes, and a clean water valve 216 to block or open the clean water fluid path 215. In some embodiments, the clean water supplier 211 may further include an ice fluid path 213 for connecting the water supply source 212 and the ice maker 800, and an ice maker valve 214 for blocking or opening the ice fluid path 213. Furthermore, the clean water supply 211 may further include a flow level sensor 218 at need, for detecting an amount of clean water supplied to the first dispenser assembly 110 or the carbonated water maker module 250.

The water supply source 212 is a device for supplying clean water to the clean water supply 211, which may be a water tank arranged separately or a water pipe connected to a household or a factory. The water supply source 212 may be connected to at least one of the ice fluid path 213 and the clean water fluid path 215, and the water supplied from the water supply source 212 may be delivered to the first dispenser assembly 110, the carbonated water maker module 250, or the ice maker 800 through the ice fluid path 213 or the clean water fluid path 215.

The clean water valve 216 is configured to open or close the clean water fluid path 215 through which clean water is supplied to the first dispenser assembly 110 or the carbonated water maker module 250.

The ice maker valve 214 is configured to open or close the ice fluid path 213, through which clean water is supplied to the ice maker 800 from the water supply source 212. According to operation of the ice maker valve 214, clean water may be supplied to the ice maker 800, which may in turn freeze the clean water into ice. The ice maker valve 214 may be opened or closed according to operation of a processor 300 provided separately, and the processor 300 may open or close the ice maker valve 214 in response to the user's manipulation on the unit 426 to input a command to start/stop the ice maker. In some embodiments, if the dispenser lever 136 is manipulated even while the operation of the ice maker 800 is stopped, the ice maker valve 214 may be opened to supply clean water to the ice maker 800 under the control of the processor 300.

The ice maker valve 214 and the clean water valve 216 may regulate an amount of clean water to be delivered to at least one of the ice maker 800, the first dispenser assembly 110, and the carbonated water maker module 250 by blocking high pressure of water coming from the water supply source 212. The ice maker valve 214 and the clean water valve 216 may employ a solenoid valve in an embodiment, but types or forms of the ice maker valve 214 and the clean water valve 216 are not limited thereto.

The water supply source 212 and at least one of the ice maker valve 214 and the clean water valve 216 may be directly connected through the fluid paths 213, 215, as shown in FIG. 4. In some embodiments, a fluid path conversion valve (not shown) may further be arranged between the water supply source 212 and at least one of the ice maker valve 214 and the clean water valve 216.

The fluid path conversion valve may be one designed to supply clean water supplied from the water supply source 212 to at least one of the first dispenser assembly 110, the carbonated water maker module 250, or the ice maker 800.

For example, if the user inputs a command to stop ice making operation by manipulating the unit 426 to input a command to start/stop the ice maker, the fluid path conversion valve may open the clean water fluid path 215 connected to the first dispenser assembly 110 or the carbonated water maker module 250 while shutting the ice fluid path 215 connected to the ice maker 800, to supply the clean water only to the first dispenser assembly 110 or the carbonated water maker module 250. Furthermore, if the user inputs a command to start ice making operation, the fluid path conversion valve may shut the fluid path 215 connected to the first dispenser assembly 110 or the carbonated water maker module 250 while opening the fluid path 213 connected to the ice maker 800, to supply clean water to the ice maker 800. Accordingly, the ice maker 800 may perform ice making operation.

In an embodiment, the fluid path conversion valve may be implemented using a three-way valve with an inlet connected to the water supply source 212, a first outlet connected to the ice maker 800, and a second outlet connected to the first dispenser assembly 110 or the carbonated water maker module 250.

The flow level sensor 218 may calculate an amount of the clean water supplied from the water supply source 212 to the first dispenser assembly 110 or the carbonated water maker module 250. Although an example is illustrated in FIG. 4, where the flow level sensor 218 is placed between the first dispenser assembly 110 or the carbonated water maker module 250 and the clean water valve 216, the flow level sensor 218 is not limited thereto. For example, the flow level sensor 218 may be located in the upstream of the clean water valve 216 and the ice maker valve 214 to calculate an amount of the clean water supplied to the clean water supply 211.

The flow level sensor 218 or the clean water supply 211 shown in FIG. 4 is merely an example of a clean water supply means that may be employed in the refrigerator 1, but is not limited thereto.

The first dispenser assembly 110 may provide clean water or ice to the user.

In an embodiment, the first dispenser assembly 110 may include a first dispenser supply fluid path 112 connected to the clean water supply 211, and a first dispenser supply valve 114*a* that opens or closes the first dispenser supply fluid path 112. The first dispenser assembly 110 may further include a second dispenser supply fluid path 118 connected to the ice maker 800. In some embodiment, the first dispenser assembly 110 may include a second dispenser supply valve 114*b* that opens or shuts the second dispenser supply fluid path 118.

The first dispenser supply fluid path 112 may direct the clean water to the water intake space 132.

The first dispenser supply valve 114*a* may be opened or closed to regulate an amount of clean water to be supplied to the water intake space 132. The first dispenser supply valve 114*a* may be opened or closed based on a control signal sent from outside, and specifically, may be opened or closed based on an electric signal output from the dispenser lever 136 or based on an electric control signal output from the dispenser lever 136 if the user manipulates the dispenser lever 136. Accordingly, if the user presses and manipulates the dispenser lever 136, clean water may be provided for the user. The first dispenser supply valve 114*a* may be implemented using e.g., a solenoid valve. If the second dispenser supply fluid path 118 is linked to the first dispenser supply fluid path 112 in the middle of the clean water valve 216 and the first dispenser supply valve 114*a*, the first dispenser supply valve 114*a* may regulate an amount of ice to be supplied to the water intake space 132 by being opened or closed. In this case, the second dispenser supply valve 114*b* could be omitted.

The second dispenser supply fluid path 118 may direct the ice formed by the ice maker 800 to the water intake space 132.

The second dispenser supply valve 114*b* may regulate an amount of ice to be supplied to the water intake space 132. The second dispenser supply valve 114*b* may also be opened or closed based on a control signal sent from outside. Specifically, if the user manipulates the dispenser lever 136, the second dispenser supply valve 114*b* may be opened or closed based on an electric signal output from the dispenser lever 136, or based on a control signal generated by the processor 300 based on the electric signal output from the dispenser lever 136. Accordingly, if the user presses and manipulates the dispenser lever 136, ice may be provided for the user. The second dispenser supply valve 114*b* may be implemented using e.g., a solenoid valve. The second dispenser supply valve 114*b* could be omitted in some embodiments.

The second dispenser assembly 200 may produce and provide carbonated water to the user. For this, in an embodiment, the second dispenser assembly 200 may include a carbon dioxide supply module 220 and the carbonated water maker module 250 as shown in FIG. 4.

The carbon dioxide supply module 220 includes a carbon dioxide cylinder 222 for storing carbon dioxide, and a carbon dioxide supply valve 230 for regulating an amount of carbon dioxide to be supplied to the carbonated water maker module 250 from the carbon dioxide cylinder 222.

The carbon dioxide cylinder 222 may store high pressure carbon dioxide, and the pressure of the carbon dioxide may be about 45 to 60 bar.

The carbon dioxide stored in the carbon dioxide cylinder 222 may be discharged into the water intake container 170 through a carbon dioxide supply path 224 that connects between the carbon dioxide cylinder 222 and the carbonated water maker module 250.

The carbon dioxide supply path 224 may direct the carbon dioxide stored in the carbon dioxide cylinder 222 to the carbonated water maker module 250.

The carbon dioxide supply valve 230 may be located in the carbon dioxide supply path 224 to open or close the carbon dioxide supply path 224. Once the carbon dioxide supply valve 230 is opened, the carbon dioxide stored in the carbon dioxide cylinder 222 is discharged into the water intake container 170 through the carbon dioxide supply path 224. In an embodiment, the carbon dioxide supply valve 230 may include a solenoid valve to open or close the carbon dioxide supply path. Details of the carbon dioxide supply valve 230 will be described later.

The carbon dioxide supply module 220 may include a carbon dioxide pressure sensor 233. The carbon dioxide pressure sensor 233 may detect a discharge pressure of the carbon dioxide being discharged from the carbon dioxide cylinder 222. The carbon dioxide pressure sensor 233 may be implemented using a pressure switch that may output a low-pressure detection signal if the pressure of the carbon dioxide being discharged falls below a threshold.

The carbon dioxide supplied from the carbon dioxide supply module 220 and the clean water supplied from the clean water supply module 211 may flow into the water intake container 170, which in turn produces carbonated water.

The carbonated water maker module 250 is made for the water intake container 170 to be detachable therefrom, and may discharge carbon dioxide into the water intake container 170 while the water intake container 170 is attached thereto, allowing carbonated water to be produced in the water intake container 170.

In an embodiment, the carbonated water maker module 250 may include a clean water inflow path 251 connected to the clean water supply 211, and a clean water inflow valve 252 to open or close the clean water inflow path 251. Through opening or closing of the clean water inflow valve 252, the amount of clean water to flow into the water intake container 170 may be regulated.

Furthermore, the carbonated water maker module 250 may include a carbon dioxide inflow path 254 connected to the carbon dioxide supply module 220 and a nozzle module 280 configured to be activated by the carbon dioxide flowing through the carbon dioxide inflow path 254, and the nozzle module 280 is configured to be activated by carbon dioxide supplied to the carbonated water maker module 250 to eject the supplied carbon dioxide to the water intake container 170.

Details of the nozzle module 280 will be described later.

The carbonated water maker module 250 may include a bent valve 258. The bent valve 258 is configured to prevent an excessive increase of an internal pressure of the water intake container 170 due to injection of carbon dioxide if the carbon dioxide is injected to the water intake container 170. Specifically, if a carbon dioxide pressure exceeds a certain level in the water intake container 170, the bent valve 258 is opened and the carbon dioxide is discharged from the water intake container 170.

The second dispenser assembly 200 may include a relief valve 150. The relief valve 150 is configured to discharge overflowing clean water or carbonated water if the clean water that exceeds a certain level is supplied or if the carbonated water that exceeds a certain level is produced, in the process of producing the carbonated water.

Figure 5A:
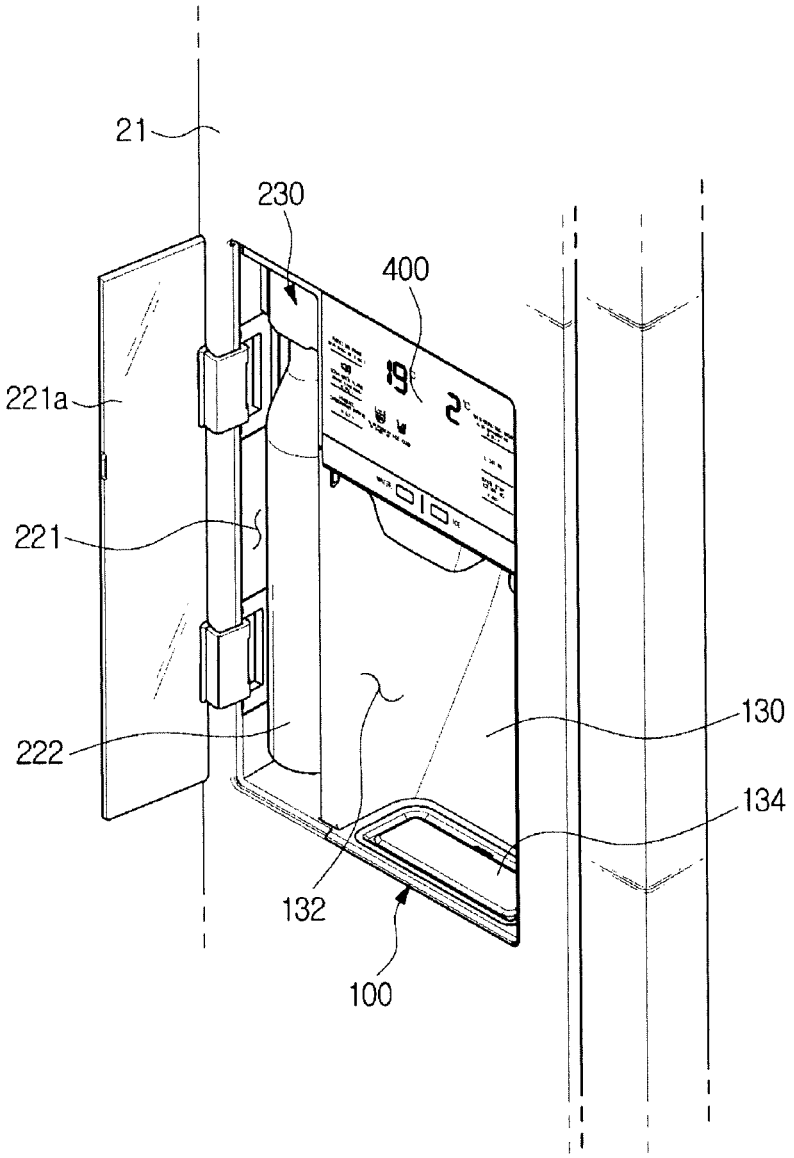
FIG. 5A shows an embodiment of a dispenser.

FIG. 5A shows an embodiment of a dispenser assembly.

The dispenser assembly 100 may be built in the door 21. The dispenser assembly 100 may include the water intake space 132 exposed on the front of the door 21, and a dispenser housing 130 formed to cave in from the front of the door toward the back to form the water intake space 132.

The water intake space 132 may receive the water intake container 170. The water intake container 170 may be configured to be detachable from the carbonated water maker module 250 in the water intake space 132. Further, in the carbonated water maker module 250, there may be an attachment body 272, to which the water intake container 170 is attached, configured to be exposed in the direction to the water intake space 132.

In the water intake space 132, there may be a dispenser lever 136 that may be manipulated by the user, to control discharge of the clean water or ice formed by the ice maker 800. According to manipulation of the dispenser lever 136, the second dispenser assembly 110 may discharge clean water or ice to the water intake space 132.

On the bottom of the dispenser housing 130, there may be a water collector case 134 to collect the discharged liquids, such as discarded clean water or carbonated water from the water intake space 132. The inner side of the dispenser housing 130 slants at a certain inclination in order for the liquids discharged to the water intake space 132 to be easily collected in the water collector case 134.

The dispenser housing 130 may include a cylinder receiving space 221 that the carbon dioxide cylinder 222 is inserted to or pulled out. The cylinder receiving space 221 may be located adjacent to the water intake space 132, e.g., may be formed on a side to the water intake space 132 as shown in FIG. 5A. The carbon dioxide cylinder 222 may be arranged in the cylinder receiving space 221, and attached to a cylinder connector 231 arranged on the inner side of the cylinder receiving space 221. If the carbon dioxide cylinder 222 is attached to the cylinder connector 231, the carbon dioxide in the carbon dioxide cylinder 222 may be supplied into the carbon dioxide supply path 224. The dispenser housing 130 may include a cylinder door 221*a* to open or close the cylinder receiving space 221, and for example, the cylinder door 221*a* may be hinged to open or close the cylinder receiving space 221.

In an embodiment, the aforementioned user interface 400 may be installed in a part of the dispenser housing 130. As described above, the user interface 400 may include a display 41 (see FIG. 21) or a lighting unit 44 (see FIG. 21) for indicating information about an operation of the refrigerator 1, and a manipulation unit 45 (see FIG. 21) for receiving various control commands regarding the refrigerator 1 from the user.

The second dispenser assembly 200 may be placed in the dispenser housing 130 to supply clean water and carbon dioxide to the water intake container 170 received in the water intake space 132.

Figure 5B:
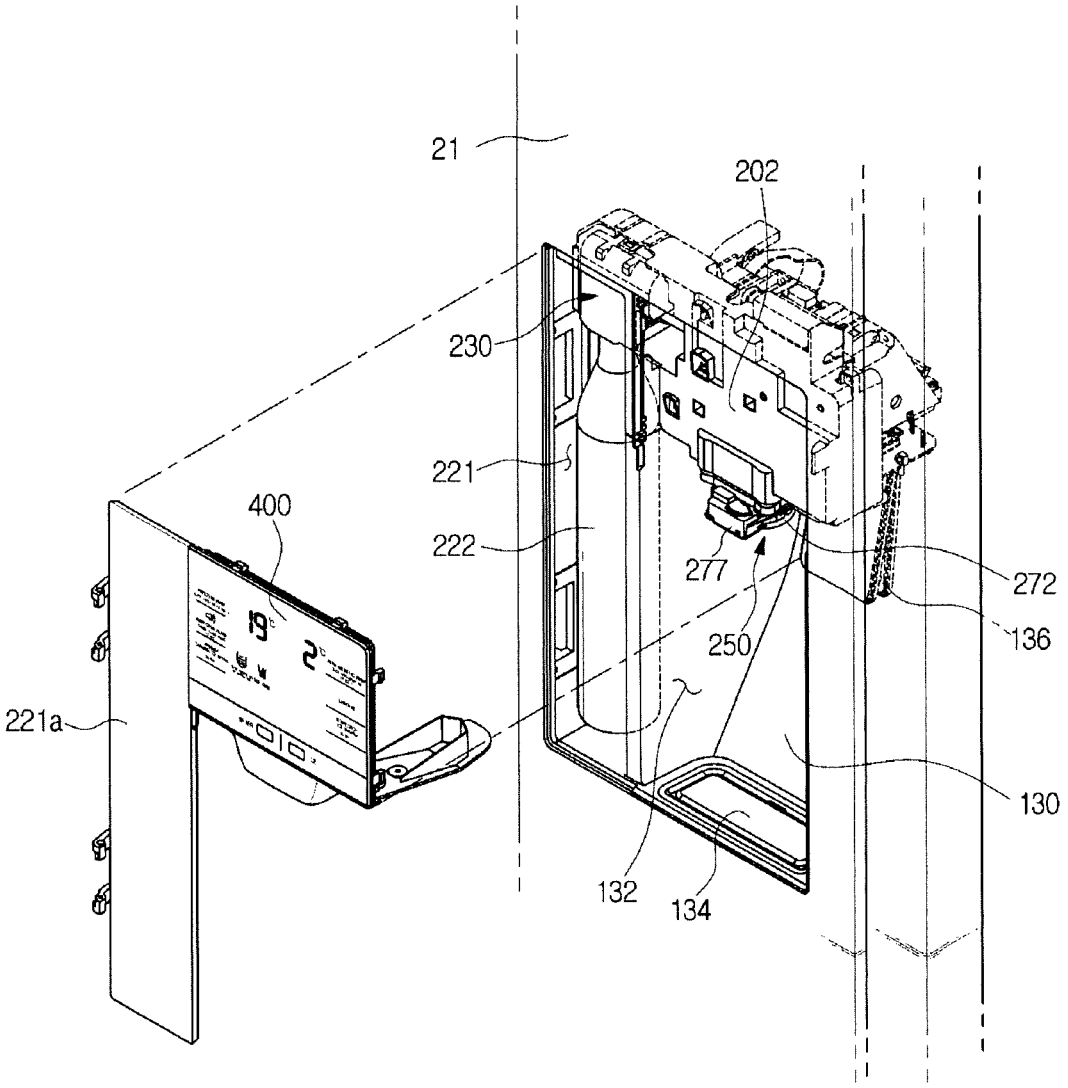
FIG. 5B shows a carbon dioxide supply module and a carbonated water maker module installed in a dispenser.
Figure 6:
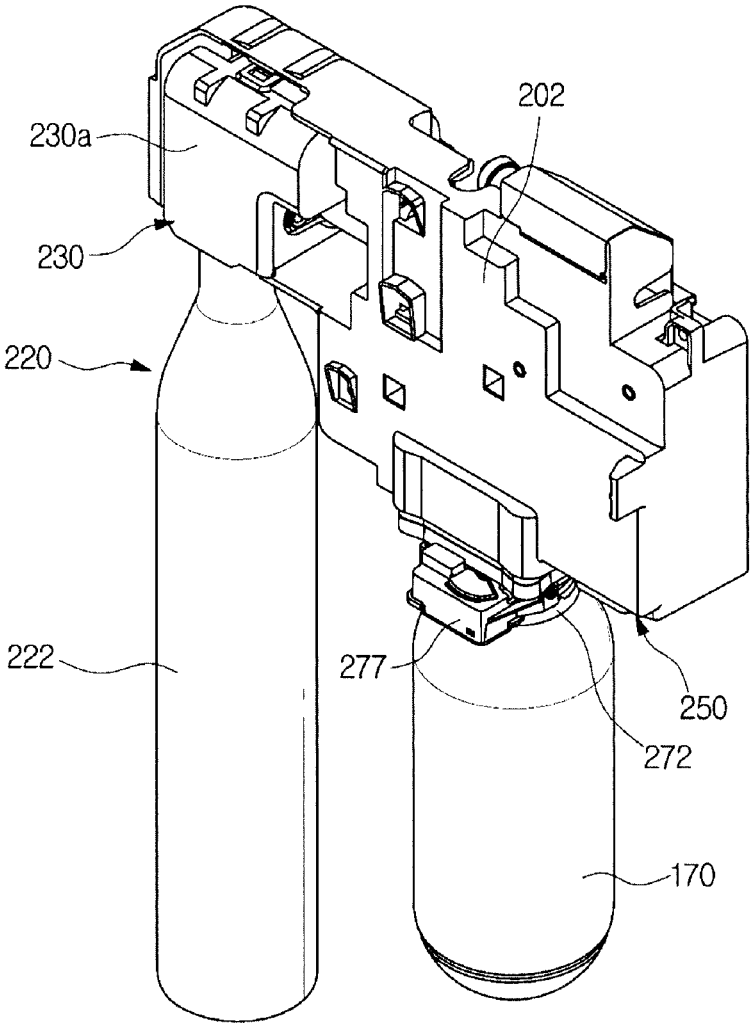
FIG. 6 shows a carbon dioxide supply module and a carbonated water maker module.
Figure 7:
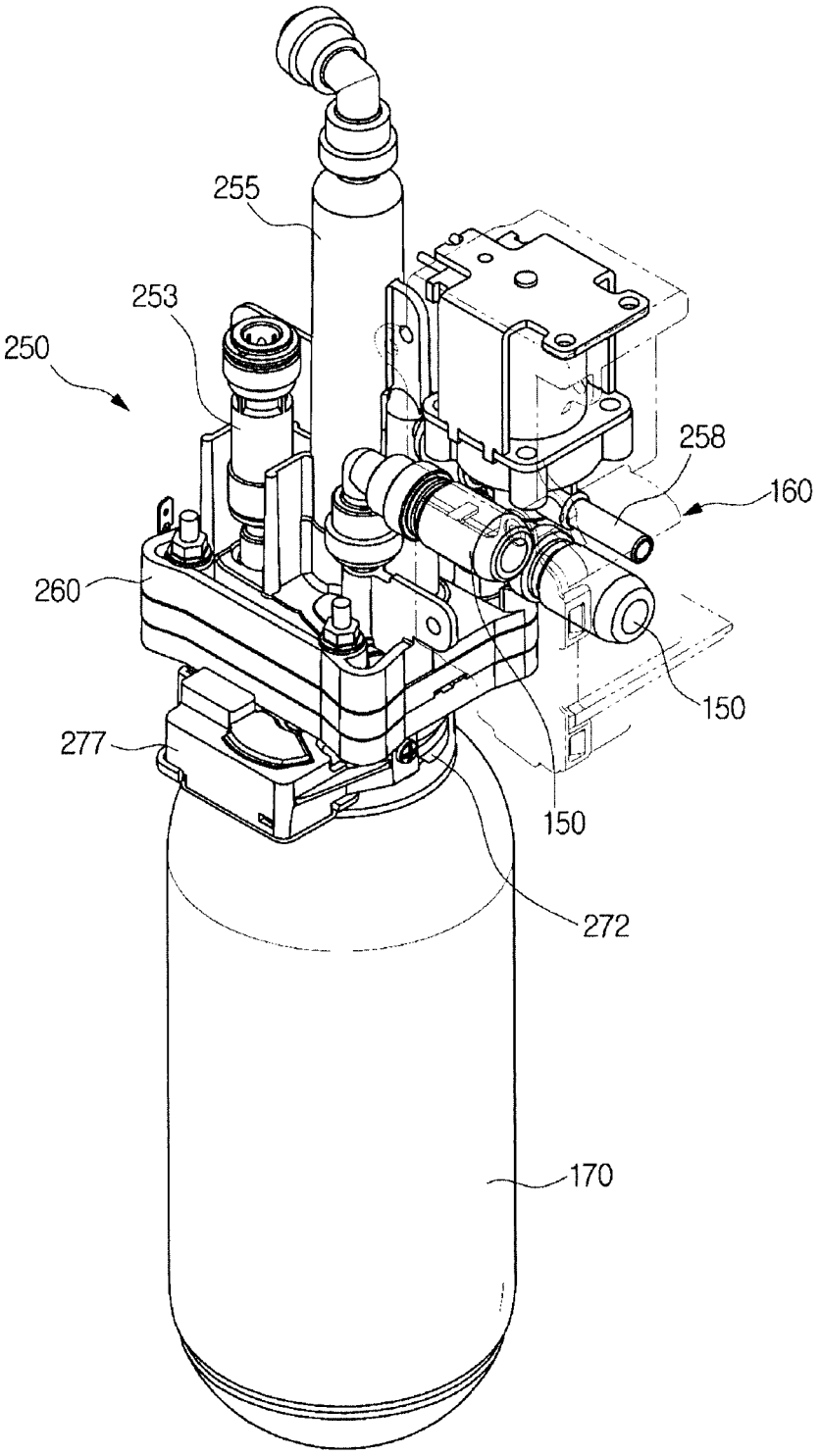
FIG. 7 shows a carbonated water maker module and a water intake container.
Figure 8:
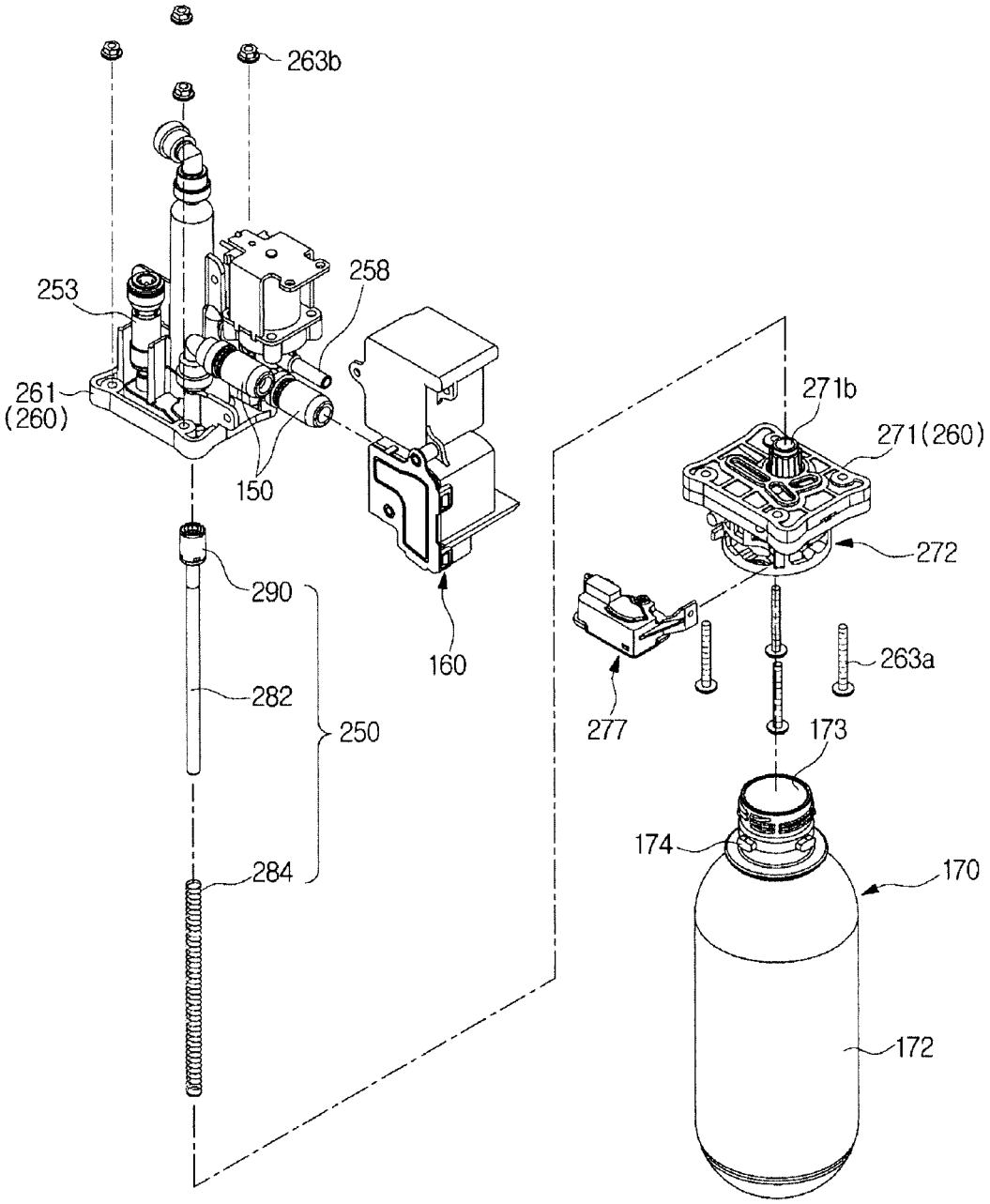
FIG. 8 is an exploded perspective view of a carbonated water maker module and a water intake container.
Figure 9:
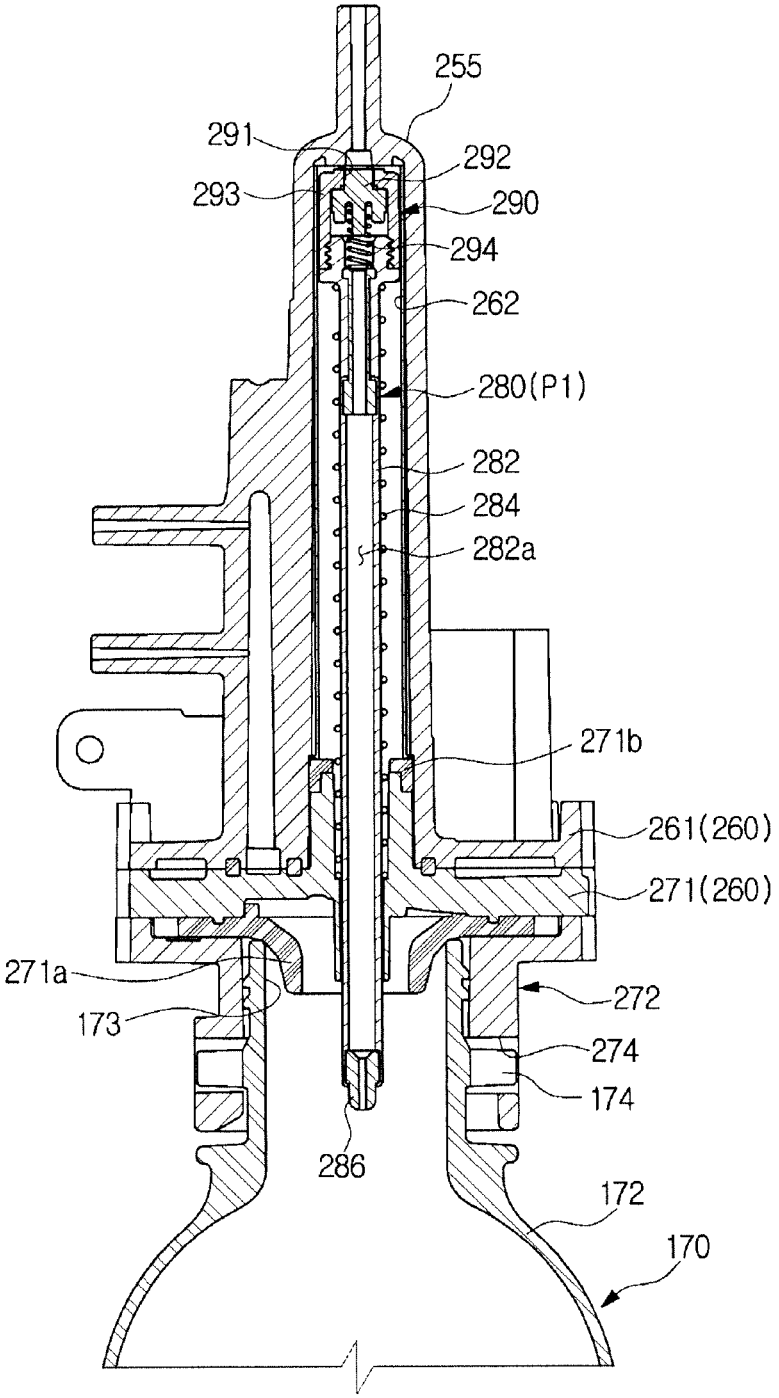
FIGS. 9 to 12 are diagrams for explaining a nozzle module.
Figure 10:
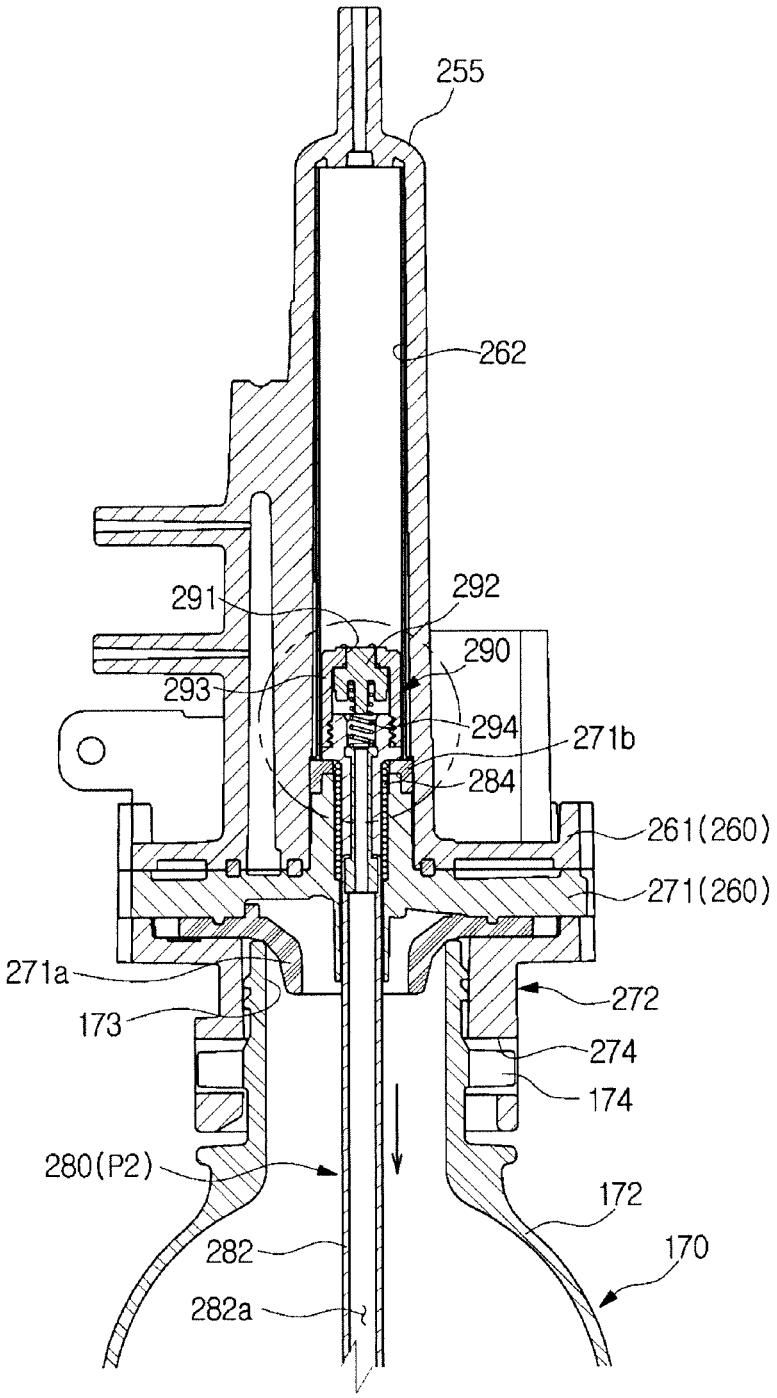
Figure 11:
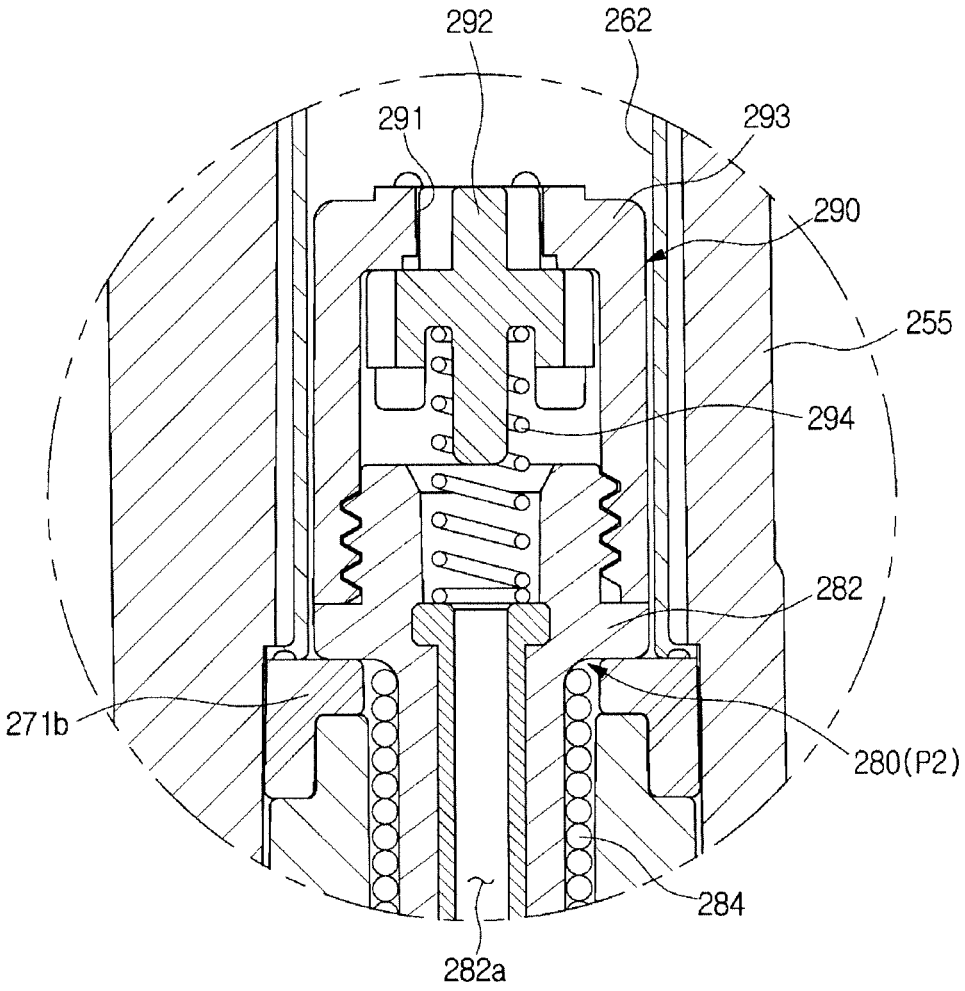
Figure 12:
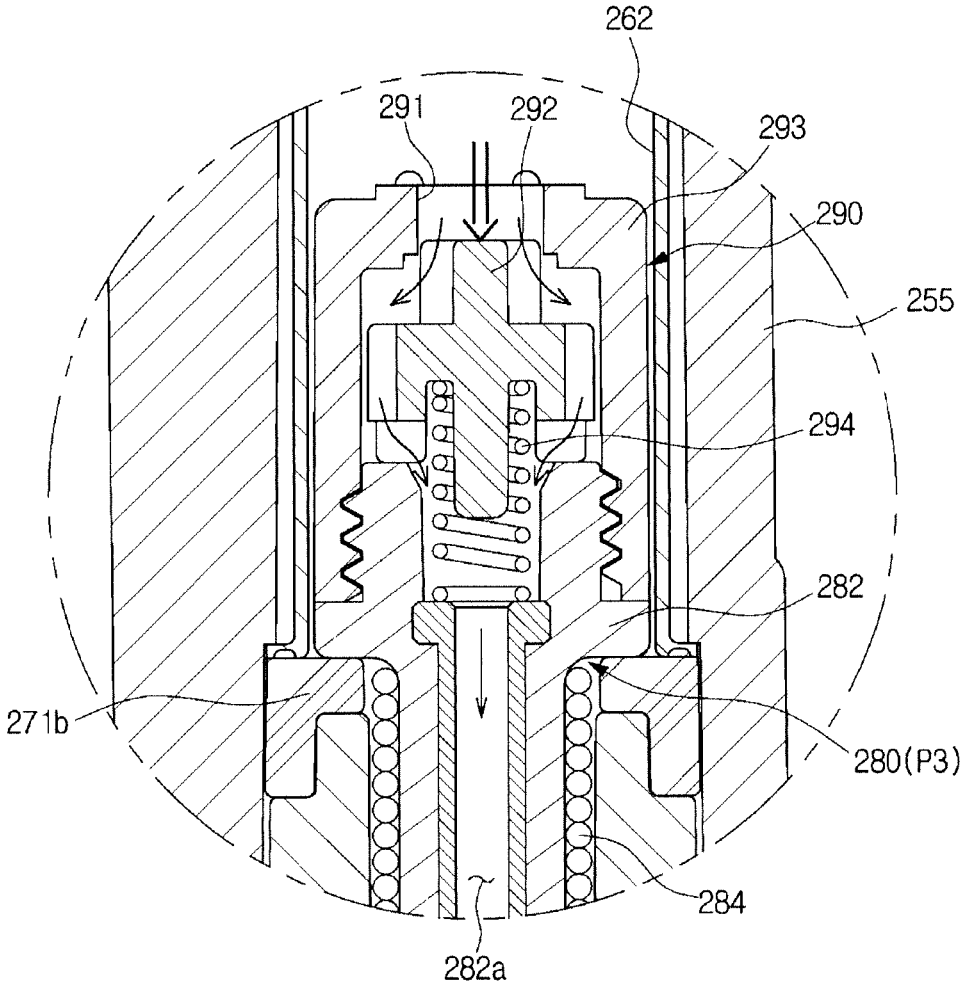

FIG. 5B shows a carbon dioxide supply module and a carbonated water maker module installed in a dispenser, and FIG. 6 shows a carbon dioxide supply module and a carbonated water maker module. FIG. 7 shows a carbonated water maker module and a water intake container, and FIG. 8 is an exploded perspective view of a carbonated water maker module and a water intake container.

Referring to FIG. 5B, the second dispenser assembly 200 may include a module cover 202 to wrap around the outside of the carbon dioxide supply module 220 or carbonated water maker module 250. The module cover 202 prevents exposure of the fluid paths, through which clean water and carbon dioxide flow, and connectors of the fluid paths, to prevent damages from external impact. The module cover 202 may also be formed to cover at least part of the carbon dioxide supply module 220 and carbonated water maker module 250, and accordingly, may cut off noise caused in the process of circulation of the clean water and carbon dioxide.

The carbonated water maker module 250 may be formed for the water intake container 170 to be attached thereto and detached therefrom, and may inject clean water and carbon dioxide into the attached water intake container 170.

The carbonated water maker module 250 may include a producing module body 260.

The producing module body 260 may include the attachment body 272, to which the water intake container 170 is attached. The attachment body 272 is formed to be exposes to the water intake space 132, allowing the water intake container 170 to be attached thereto. In other words, the water intake container 170 is formed to be attached to and detached from the attachment body 27. On one side of the attachment body 272, there is an attachment sensor 277 for detecting attachment of the water intake container 170. Details of the attachment body 272 and attachment sensor 277 will be described later.

The carbonated water maker module 250 may include a clean water inflow pipe 251 that forms the clean water inflow path 251, and a carbon dioxide inflow pipe 255 that forms the carbon dioxide inflow path. Clean water flowing through the clean water fluid path 215 may flow into the clean water inflow pipe 253, and carbon dioxide flowing through the carbon dioxide supply path may flow into the carbon dioxide inflow pipe 255. The clean water and the carbon dioxide flowing through the clean water inflow pipe 253 and the carbon dioxide inflow pipe 255, respectively, may be injected to the water intake container 170 for producing carbonated water.

The clean water inflow pipe 253 and the carbon dioxide inflow pipe 255 may be coupled to the producing module body 260. Specifically, the attachment body 272 may be formed on one side of the producing module body 260, and the clean water inflow pipe 253 and the carbon dioxide inflow pipe 255 may be coupled to the other side of the producing module body 260. More specifically, the attachment body 272 may be formed on a second module body 271, and the clean water inflow pipe 253 and the carbon dioxide inflow pipe 255 may be coupled to a first module body 261.

The second dispenser assembly 200 may include one, two or more relief valves 150 and a drainage module 160.

The relief valves 150 may enable overflowing clean water or carbonated water to be discharged if clean water that exceeds a certain level is supplied to the water intake container 170 or carbonated water that exceeds a certain level is produced in the water intake container 170, in the process of producing carbonated water.

The relief valve 150 may be formed to be coupled to the producing module body 260 of the carbonated maker module 250. More specifically, an end of the relief valve 150 is formed to be linked to the inside of the water intake container 170 when the water intake container 170 is attached to the carbonated water making module 250, and the other end of the relief valve 150 is formed to be linked to the drainage module 160. The carbonated water or high pressure carbon dioxide discharged through the relief valve 150 may flow into the drainage module 160.

The drainage module 160 may discharge the carbonated water overflowing from the water intake container 170 by turning the carbonated water from the water intake container 170. The drainage module 160 may be formed to wrap around an outlet of the relief valve 150.

The carbonated water maker module 250 may include the nozzle module 280. The nozzle module 280 may eject carbon dioxide to the water intake container 170. The nozzle module 280 may be activated by the carbon dioxide supplied from the carbon dioxide supply module 220 and flowing into the carbonated water maker module 250. Configuration and operation of the nozzle module 280 will be described later in detail.

As shown in FIG. 8, the producing module body 260 may include the first module body 261 and the second module body 271.

The first module body 261 may be combined with the clean water inflow pipe 253 and the carbon dioxide inflow pipe 255. On the first module body 261, a nozzle mover 262 is installed to enable the nozzle module 280 to be moved. The nozzle mover 262 is installed inside the carbon dioxide inflow pipe 255 for the nozzle module 280 to be moved by carbon dioxide flowing into the carbon dioxide inflow pipe 255.

The top of the second module body 271 is coupled to the bottom of the first module body 261, and there may be the attachment body 272 formed on the bottom of the second module body 271, to which the water intake container 170 may be attached. In other words, the water intake container 170 may be attached to or detached from the second module body 271.

In an embodiment, the second module body 271 may have a stopper 271*b* installed to limit the movement of the nozzle module 280. The stopper 271*b* is equipped on the top of the second module body 271 to limit the movement of the nozzle module 280 that moves in the nozzle mover 262. Specifically, it is formed to limit the movement of a nozzle pipe 282 to a suppliable position P2 when the carbon dioxide is supplied to the carbonated water maker module 250, The first and second module bodies 261 and 271 may be fastened to each other using various means. For example, the first and second module bodies 261 and 271 may be fastened together with coupling bolts 263*a* and coupling nuts 263*b*. How to fasten them together is not, however, limited thereto, and for example, they may be fastened together with an epoxy adhesive.

FIGS. 9 to 12 are diagrams for explaining a nozzle module.

The nozzle module 280 may be moved by carbon dioxide flowing into the carbonated water maker module 250 to eject the carbon dioxide directly from inside of the water intake container 170. In this case, the nozzle module 280 may directly eject carbon dioxide from under the surface of the clean water stored in the water intake container 170, and in some embodiments, may eject the carbon dioxide from right under the surface of the clean water. Accordingly, the ejected carbon dioxide may directly come into contact with the clean water, and may be more easily dissolved by the clean water.

In an embodiment, the nozzle module 280 may include the nozzle pipe 282 and a valve unit 290.

The nozzle pipe 282 is installed to be movable in the nozzle mover 262. There may be a carbon dioxide ejecting nozzle 286 formed on one end of the nozzle pipe 282, and the carbon dioxide flowing through the other end may be ejected through the carbon dioxide ejecting nozzle 286. The nozzle pipe 282 may include a nozzle pipe fluid path 282*a*, in which the carbon dioxide flows.

The valve unit 290 is formed on the other end of the nozzle pipe 282. The valve unit 290 may include an inflow hole 291 and a valve part 292. Through the inflow hole 291, carbon dioxide may flow into the nozzle pipe 282 from the inside of the carbonated water maker module 250. The valve part 292 may control the inflow of the carbon dioxide by opening and closing the inflow hole 291. The valve part 292 may open the inflow hole 291 to cause inflow of the carbon dioxide if the internal pressure of the carbon dioxide inflow pipe 255 exceeds a certain level. Since the valve unit 290 is placed on the other end of the nozzle pipe 282, if the carbon dioxide pressure applied is not more than a certain level, the other end of the nozzle pipe 282 is sealed by the valve unit 290.

The valve unit 290 may include a valve housing 293. In the valve housing 293, the inflow hole 291 is formed and the valve part 292 is located inside. The valve housing 293 is coupled to the nozzle pipe 282 to allow the valve part 292 to be moved in the valve housing 293 without falling out from inside.

The nozzle module 280 may pass a standby position P1, the suppliable position P2, and a supplying position P3.

The standby position P1 refers to a position of the nozzle module 280 in a case that no carbon dioxide is supplied from the carbon dioxide supply module 220 or the pressure of the inside of the carbon dioxide inflow pipe 255 is less than a first pressure even if the carbon dioxide is supplied. If the nozzle module 280 is at the standby position P1, the carbon dioxide ejecting nozzle 286 may be located on the surface of the clean water stored in the water intake container 170.

The suppliable position P2 refers to a position, to which the nozzle module 280 moves when carbon dioxide is supplied from the carbon dioxide supply module 220 to the carbon dioxide inflow pipe 255 of the carbonated water producing module 250 and thus, the pressure inside the carbon dioxide inflow pipe 255 reaches the first pressure. In this case, the carbon dioxide ejecting nozzle 286 may move to be located underneath the surface of the clean water stored in the water intake container 170.

The supplying position P3 refers to a position, to which the nozzle module 280 moves when carbon dioxide is supplied from the carbon dioxide supply module 220 to the carbon dioxide inflow pipe 255 of the carbonated water producing module 250 and thus, the pressure inside the carbon dioxide inflow pipe 255 increases to a second pressure greater than the first pressure. In this case, the carbon dioxide ejection nozzle 286 may eject carbon dioxide.

In an embodiment, the nozzle module 280 may include an elastic nozzle member 284. The elastic nozzle member 284 may elastically support the nozzle pipe 282 and may be formed to wrap around the nozzle pipe 282. In this case, the elastic nozzle member 284 may be arranged to be supported by the valve unit at one end and by the stopper 271*b* of the second module body 271 at the other end. The elastic nozzle member 284 may elastically support the nozzle pipe 282 such that the nozzle module 280 remains at the standby position P1 until the carbon dioxide pressure in the carbon dioxide inflow pipe 255 reaches the first pressure. If the carbon dioxide pressure in the carbon dioxide inflow pipe 255 reaches the first pressure, the elastic nozzle member 284 is pressurized to move the nozzle pipe 282 until the movement of the nozzle pipe 282 is restricted by the stopper 271*b*. Accordingly, the nozzle module 280 is moved to the suppliable position P2 from the standby position P1.

In an embodiment, the valve unit 290 may include an elastic valve member 294. The elastic valve member 294 elastically supports the valve part 292. In this case, the elastic valve member 294 may be configured to be supported by the valve part 292 at one end and by the nozzle pipe 282 at the other end. The elastic valve member 294 may elastically support the valve part 292 such that the nozzle module 280 may be able to move to the supplying position P3 from the suppliable position P2 when the carbon dioxide pressure in the carbon dioxide inflow pipe 255 is the second pressure. Accordingly, the elastic valve member 294 may elastically support the valve part 292 for the nozzle module 280 to remain at the suppliable position P2 when the carbon dioxide pressure in the carbon dioxide inflow pipe 255 is less than the second pressure. Since the second pressure is greater than the first pressure, the elastic power of the elastic valve member 294 may be set to be greater than the elastic power of the elastic nozzle member 284.

If the carbon dioxide pressure in the carbon dioxide inflow pipe 255 reaches the second pressure, the elastic valve member 294 is pressurized and accordingly, the valve part 292 opens the inflow hole 291. The carbon dioxide in the carbon dioxide inflow pipe 255 passes the open inflow hole 291, flowing along the nozzle pipe fluid path 282*a* and being released through the carbon dioxide ejection nozzle 286 located under the surface of the clean water stored in the water intake container 170.

As described above, as the ejection nozzle 286 may eject carbon dioxide directly from under the surface of the clean water stored in the water intake container 170, solubility of the carbon dioxide may be improved, leading to improvement of efficiency in producing carbonated water.

If the supply of carbon dioxide is stopped from the carbon dioxide supply module 220, the pressurized elastic valve member 294 and elastic nozzle member 284 are restored to their original states, and the nozzle module 280 is thus moved to the standby position P1 from the supplying position P3.

The first and second pressures may be arbitrarily set, but the second pressure may be set to be greater than the first pressure. For example, the first pressure may be set to 0.5 bar, and the second pressure may be set to 1.5 bar. The first and second pressures are not, however, limited thereto, and may be set to any values according to the environment of producing carbonated water or arbitrary selection from the designer.

Figure 13:
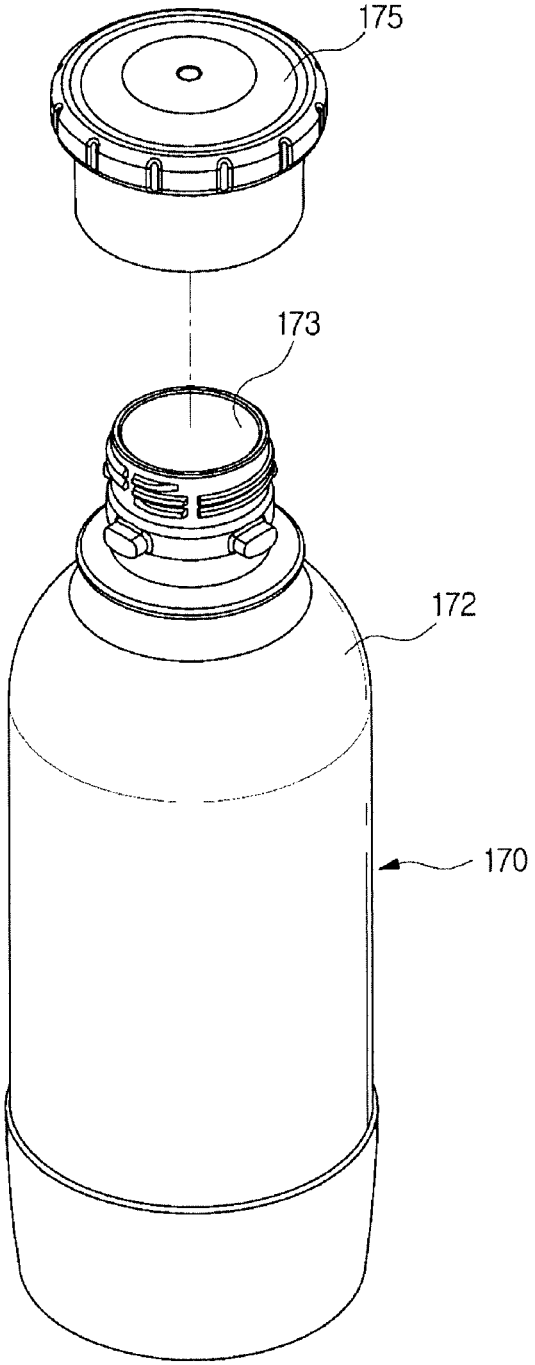
FIG. 13 shows a water intake container.

FIG. 13 shows a water intake container.

As shown in FIG. 13, the water intake container 170 may include a container body 172 for storing liquids inside, and an opening 173 through which the liquids flow in or out of the container body 172.

Figure 15:
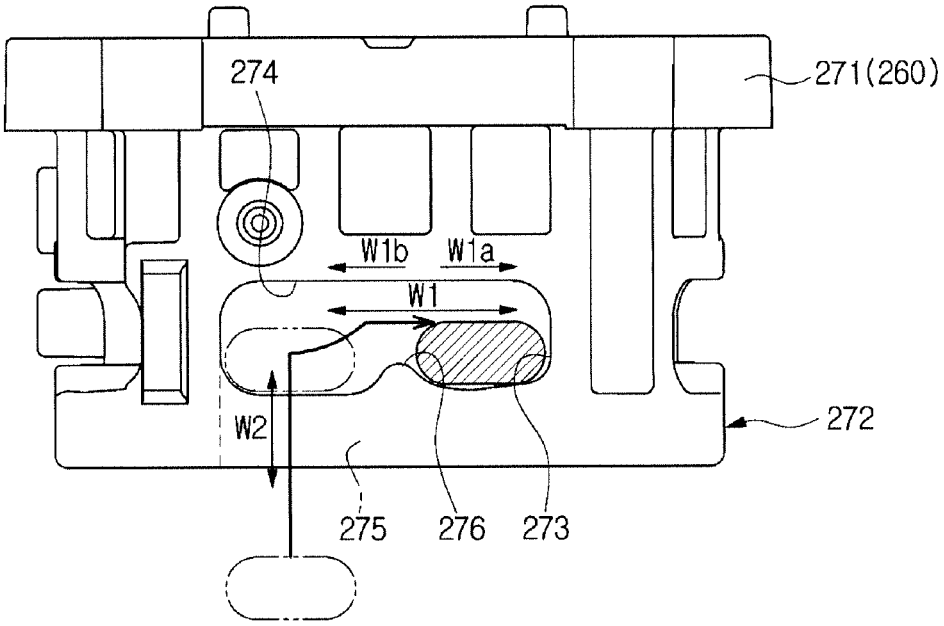

The container body 272 may have a cylindrical shape, as shown in FIG. 15. The shape of the container body 272 is not, however, limited thereto, and may be in the form of a polyhedron, e.g., a hexahedron, or in various forms to the user's liking.

The opening 173 may be formed on a side of the container body 172. In an embodiment, the container body 172 may have a protrusion 173*a* formed at one end, and the opening 173 may be formed at an end of the protrusion 173*a*.

The opening 173 of the water intake container 170 may have a substantially circular form. In some embodiments, the shape of the opening 173 may correspond to the shape of the container body 172.

The water intake container 170 may include one, two or more sitting protrusions 174 protruding from the container body 172. The sitting protrusions 174 are arranged to be adjacent to the opening 173, and in some embodiments, may be formed at the protrusion 173*a*. The sitting protrusions 174 may be formed to radially protrude around the opening 173, and in a case that a plurality of sitting protrusions 174 are formed, the sitting protrusions 174 may be formed on the container body 172 at regular intervals. If the water intake container 170 is attached to the attachment body 272, the opening 173 is inserted to the attachment body 272 and the sitting protrusions 174 may be seated in seats 273 of the attachment body 272.

The water intake container 170 may be formed to be easy to carry around after separated from the attachment body 272. For this, the water intake container 170 may further have a handle formed to be easily held by the user.

In some embodiments, a cover 175 may be attached to the water intake container 170 at one end to open or close the opening 173.

Figure 14:
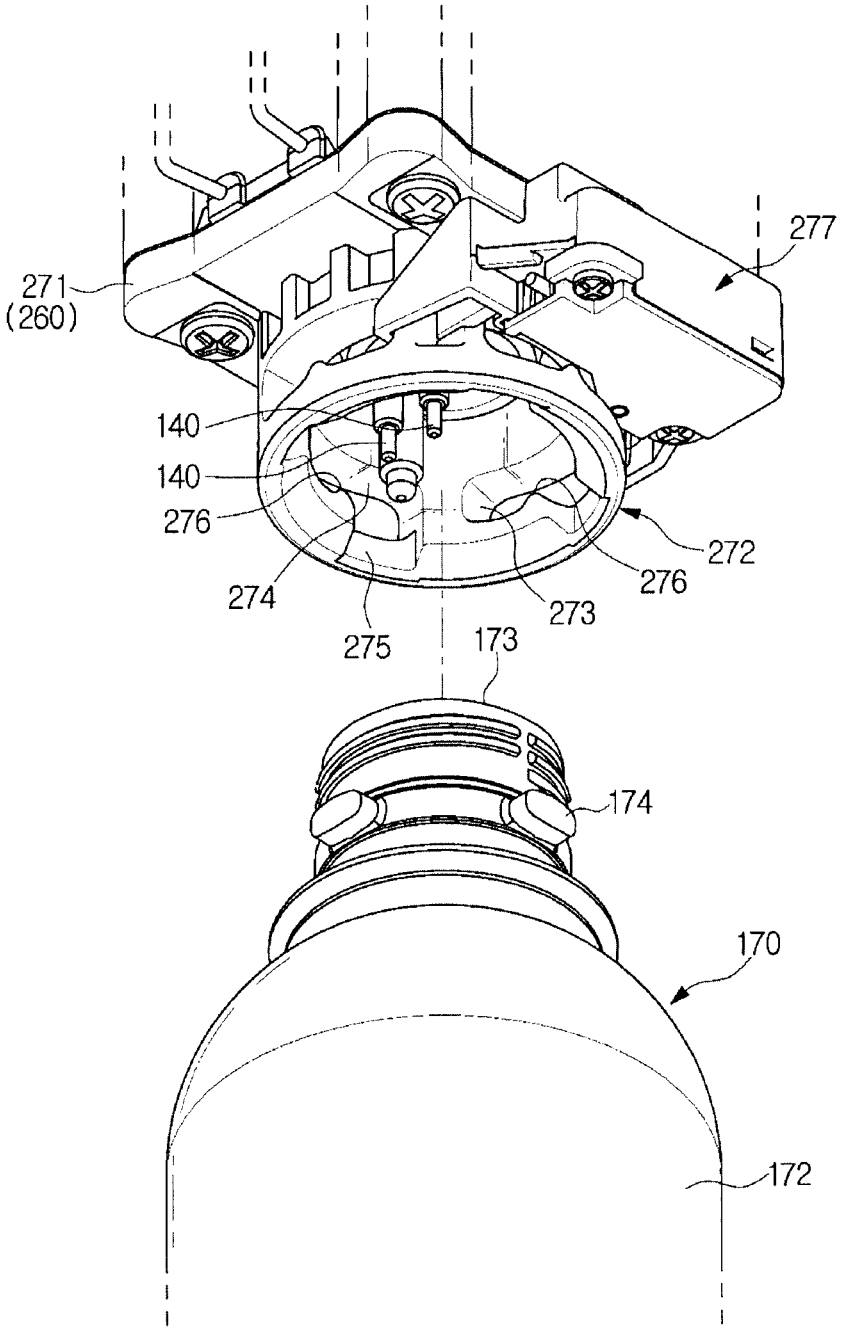
FIGS. 14 to 16 are diagrams for explaining an example of attaching a water intake container to a carbonated water maker module.
Figure 16:
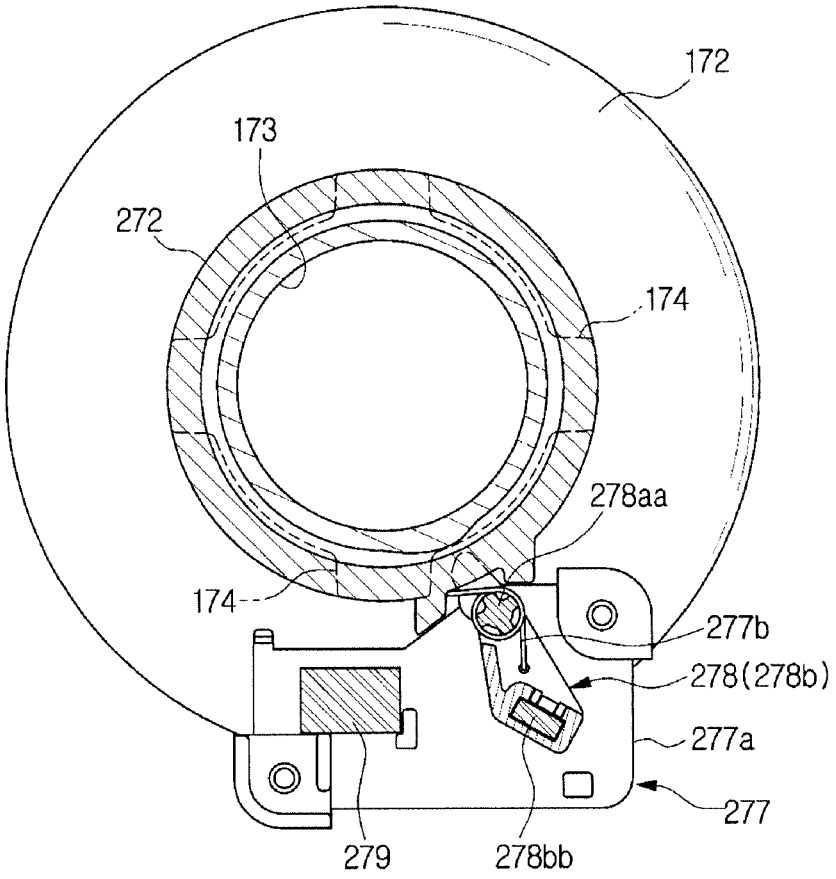

FIGS. 14 to 16 are diagrams for explaining an example of attaching a water intake container to a carbonated water maker module.

As shown in FIGS. 14 to 16, the producing module body 260 may further include the attachment body 272 to which the water intake container 170 is attached, and the attachment sensor 277 for detecting whether the water intake container 170 and the attachment body 272 are coupled together.

The attachment body 272 may include the seats 273 into which the sitting protrusions 174 of the water intake container 170 are seated, and a guide rail 274 for guiding the sitting protrusions 174 into the seats 273.

The seats 273 may have a shape corresponding to the shape of the sitting protrusions 174, and accordingly, the sitting protrusions 174 may be stably seated into the seats 273.

The guide rail 274 may be formed to extend from the seats 273, and may have a certain form for the sitting protrusions 174 to be smoothly moved to the seats 273. If the attachment body 272 has a cylindrical form, the guide rail 274 may be formed along the inner circumferential face of the attachment body 272 corresponding to the sitting protrusions 174

The sitting protrusions 174 may be moved along the guide rail 274 in a detachment direction or in an attachment direction. The attachment direction refers to a direction in which the sitting protrusions 174 move toward the seats 273 along the guide rail 274, and the detachment direction refers to a direction in which the sitting protrusions 174 move away from the seats 273 along the guide rail 274. The detachment direction or attachment direction may be arbitrarily determined by a selection from the designer.

As described above, if a plurality of sitting protrusions 174 are arranged on the water intake container 170 at certain intervals, the guide rail 274 may be formed on the attachment body 272 at corresponding intervals as well.

In an embodiment, the attachment body 272 may include an insertion groove 275. In a case of inserting the water intake container 170 to the attachment body 272, the insertion groove 275 allows the sitting protrusions 174 to be located in the guide rail 274. The insertion groove 275 may extend from the guide rail 274, and may be formed in the attachment body 272 along a direction in which the water intake container 170 is inserted to the attachment body 272.

In an embodiment, the attachment body 272 may include an anti-deviation protrusions 276. The anti-deviation protrusions 276 may be formed on the guide rail 274 near the seats 273 to prevent the sitting protrusions 174 positioned in the seats 174 from falling out of the seats 273.

The attachment sensor 277 may detect attachment of the water intake container 170 to the attachment body 272. In an embodiment, the attachment sensor 277 may detect the sitting protrusion 174 moving to the seat 273 along the guide rail 274 of the attachment body 272, the sitting protrusion 174 passing the anti-deviation protrusion 276, the sitting protrusion 174 seated in the seats 273, or the sitting protrusion 174 moving to the insertion groove 275. Of course, in some embodiments, the attachment sensor 277 may detect them all.

In an embodiment, the attachment sensor 277 may include a sensing lever 278 and a sensor part 279.

The sensing lever 278 may be pivoted. Specifically, the sensing lever 278 may pivot around a sensing lever center axis 278*aa*, and may be formed to pivot around by an applied pressure if a side of the sensing lever 278 is pressed by the sitting protrusion 174. The sensing lever 278 may be pivoted and moved between a non-attachment position 278*b* and an attachment position 278*a*. The non-attachment position 278*b* refers to a corresponding position when the sitting protrusion is positioned on the guide rail 274, and the attachment position 278*a* refers to a corresponding position when the sitting protrusion 174 moves along the guide rail 274 and arrives at the seat 273.

In an embodiment, the attachment sensor 277 may include an elastic restoration member 277*b*. The elastic restoration member 277*b* may restore the sensing lever 278 to the non-attachment position 278*b* from the attachment position 278*a* when the water intake container 170 is separated from the attachment body 272.

The sensor part 279 may detect pivoting of the sensing lever 278. The sensor part 279 is arranged to correspond to the other side of the sensing lever 278 to detect pivoting of the sensing lever 278.

In an embodiment, a magnet 278*bb* may be formed on the other side of the sensing lever 278, and the sensor part 279 may include a reed switch configured to detect the magnet of the sensing lever 278. In another embodiment, the sensor part 279 may include e.g., a micro switch pressed by the other side of the sensing lever 278 to be on/off.

In an embodiment, the attachment sensor 277 may include a sensor housing 277*a*. The sensor housing 277*a* may prevent the sensing lever 278 and the sensor part 279 from being exposed. Furthermore, the sensor housing 277*a* may also prevent malfunction of the sensing lever 278 and the sensor part 279 due to clean water.

In the case of attaching the water intake container 170 to the attachment body 272, the opening 173 of the water intake container 170 may be sealed by the carbonated water producing module 250. In this case, the opening 173 of the water intake container 170 may be sealed by the producing module body 260 or by an extra part.

For example, the carbonated water maker module 250 may include a packing part 271*a* for the opening 173 of the water intake container 170 to be sealed. The packing part 271*a* may be arranged within the attachment body 272 to correspond to the opening 173 of the water intake container 170. The packing part 271*a* may allow the opening 173 to be sealed and thus prevent the carbonated water from leaking through the opening 173 if the water intake container 170 is attached to the attachment body 272.

Figure 17:
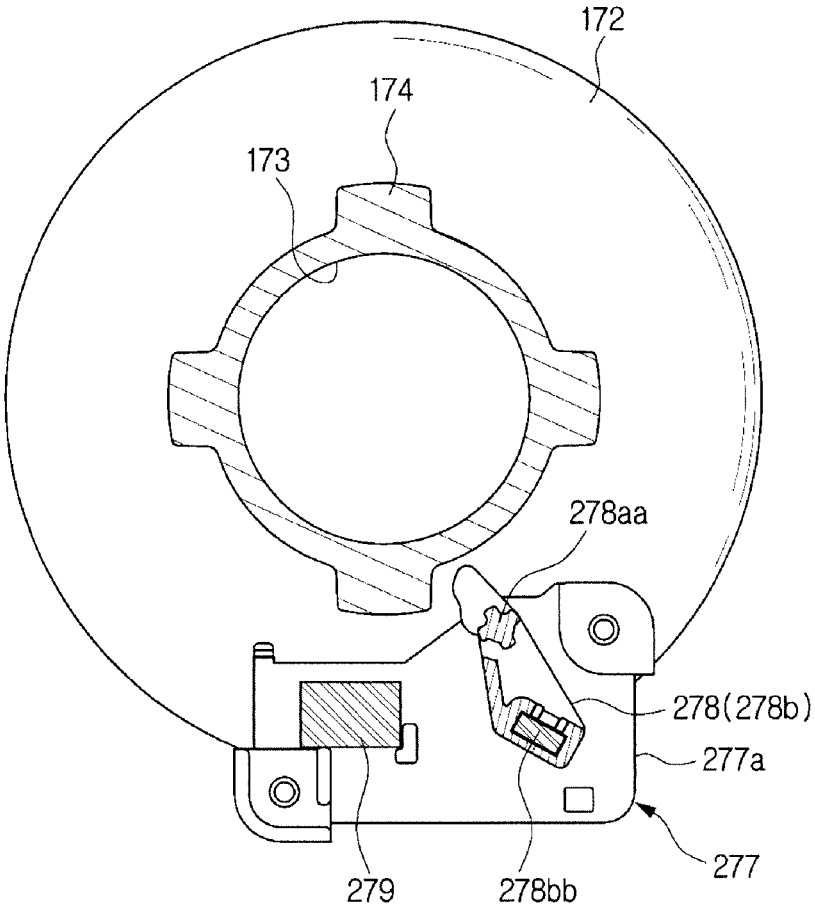
FIGS. 17 to 19 are diagrams for explaining a procedure of detecting attachment of a water intake container.
Figure 18:
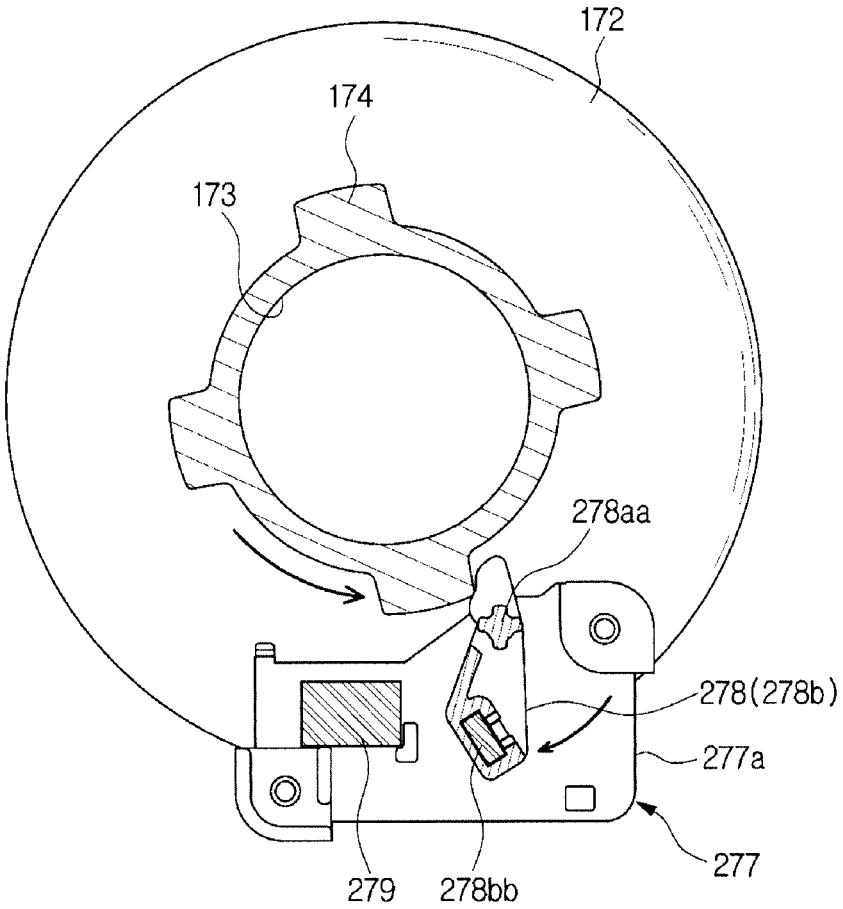
Figure 19:
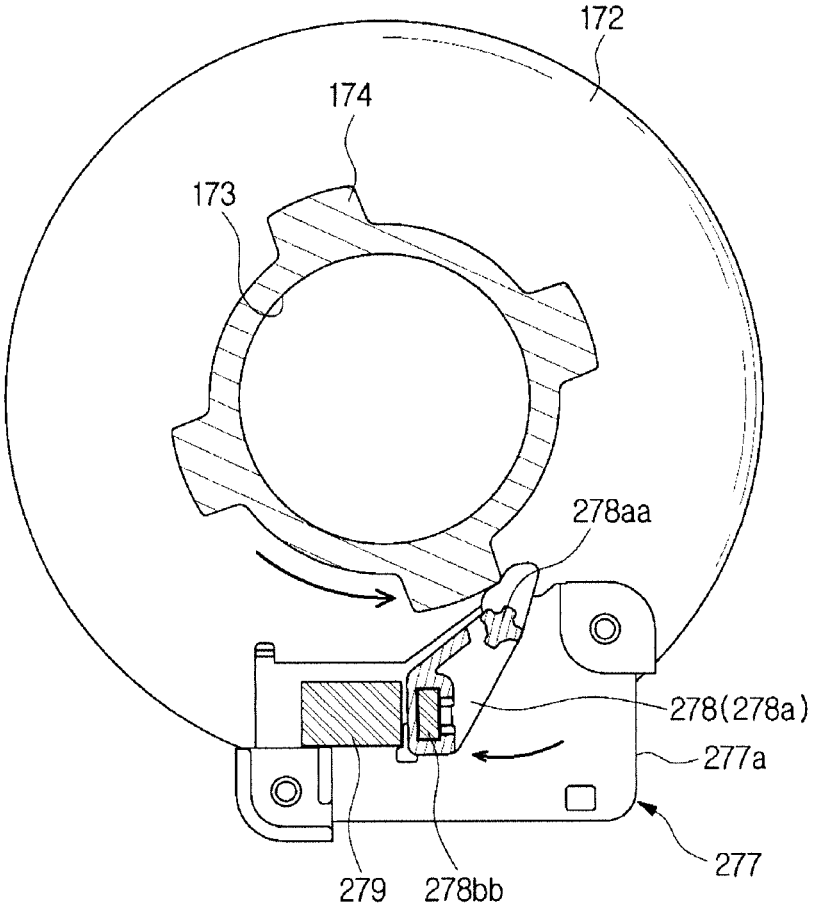

FIGS. 17 to 19 are diagrams for explaining a procedure of detecting attachment of a water intake container.

Referring to FIGS. 17 to 19, operation of the water intake container 170 being attached to the carbonated water maker module 250 will be described.

When the water intake container 170 is attached to the attachment body 272 exposed to the water intake space 132, the sitting protrusions 174 of the water intake container 170 may be inserted to the guide rail 274 along the insertion grooves 275.

Once the water intake container 170 is inserted to the attachment body 272, the water intake container 170 may be rotated in the attachment direction. In this case, the sitting protrusions 174 are moved along the guide rail 274 in the attachment direction, and finally, positioned in the seats 273, making the water intake container 170 attached to the attachment body 272

If the water intake container 170 is rotated in the attachment direction, the sensing lever 278 of the attachment sensor 277 is pressed by the sitting protrusions 174 at the non-attachment position 278*b* and moved to the attachment position 278*a*, and the sensor part 279 may detect whether the water intake container 170 is attached by detecting movement of the sensing lever 278. Accordingly, whether the water intake container 170 is attached to the carbonated water maker module 250 may be detected. Once the movement of the sensing lever 278 is detected, the sensor part 279 may output and send an electric signal to a processor.

A processor 300 equipped in the refrigerator 1 may determine based on the electric signal sent from the sensor part 279 that the water intake container 170 is attached to the attachment body 272, and control the respective parts to perform producing of carbonated water in the water intake container 170. Then, the clean water is supplied into the water intake container 170, and carbon dioxide may be ejected into the clean water to produce carbonated water.

If the water intake container 170 is wrongly attached to the attachment body 272, the sitting protrusions 174 are not inserted to the guide rail 274. If the sitting protrusions 174 are not seated in the seats 273, the attachment sensor 277 remains at the non-attachment position 278*b* and accordingly, the sensor part 279 may not detect attachment of the water intake container 170. In this case, the processor 300 may determine that the water intake container 170 is not attached to the attachment body 272 and control not to perform producing carbonated water in the water intake container 170. Consequently, by preventing production of carbonated water if the water intake container 170 is wrongly attached or not attached, stability of producing carbonated water may be improved and also, safety for the user may be enhanced.

In a case of detaching the water intake container 170 from the carbonated water maker module 250, the water intake container is first rotated in the detachment direction opposite to the attachment direction. The sitting protrusions 174 of the water intake container 170 are then moved along the guide rail 274 from the seats 174 and arrive at the insertion grooves 275. if the sitting protrusions 174 falls out from the attachment body 272 through the insertion grooves 275, the water intake container 170 may be separated from the carbonated water maker module 250.

In the meantime, if the water intake container is rotated in the detachment direction, the sensing lever 278 of the attachment sensor 277 is released from the pressure applied by the sitting protrusions 174 and moved from the attachment position 278*a* to the non-attachment position 278*b*.

The sensor part 279 may detect the movement of the sensing lever 278 to the non-attachment position 278*b* and output a corresponding electric signal. The processor may determine based on the electric signal sent from the sensor part 279 whether the water intake container 170 is unseated, and may send control signals based on the determination to the respective parts to stop producing carbonated water.

In some embodiments, the sensor part 279 may keep outputting an electric signal if the sensing lever 278*a* is located at the attachment position 278*a*, and may stop outputting the electric signal if the sensing lever 278 is moved to the non-attachment position 278*b*. In this case, as the electric signal sent from the sensor part 279 is stopped, the processor 300 may determine whether the water intake container 170 is unseated, and may send control signals based on the determination to the respective parts to stop producing carbonated water.

An embodiment of the refrigerator 1 will now be described, where manipulation of the dispenser lever 136 is disabled if the water intake container 170 is coupled to the carbonated water maker module 250, and the dispenser lever 136 may be manipulated to take clean water or ice only if the water intake container 170 is detached from the carbonated water maker module 250.

Figure 20:
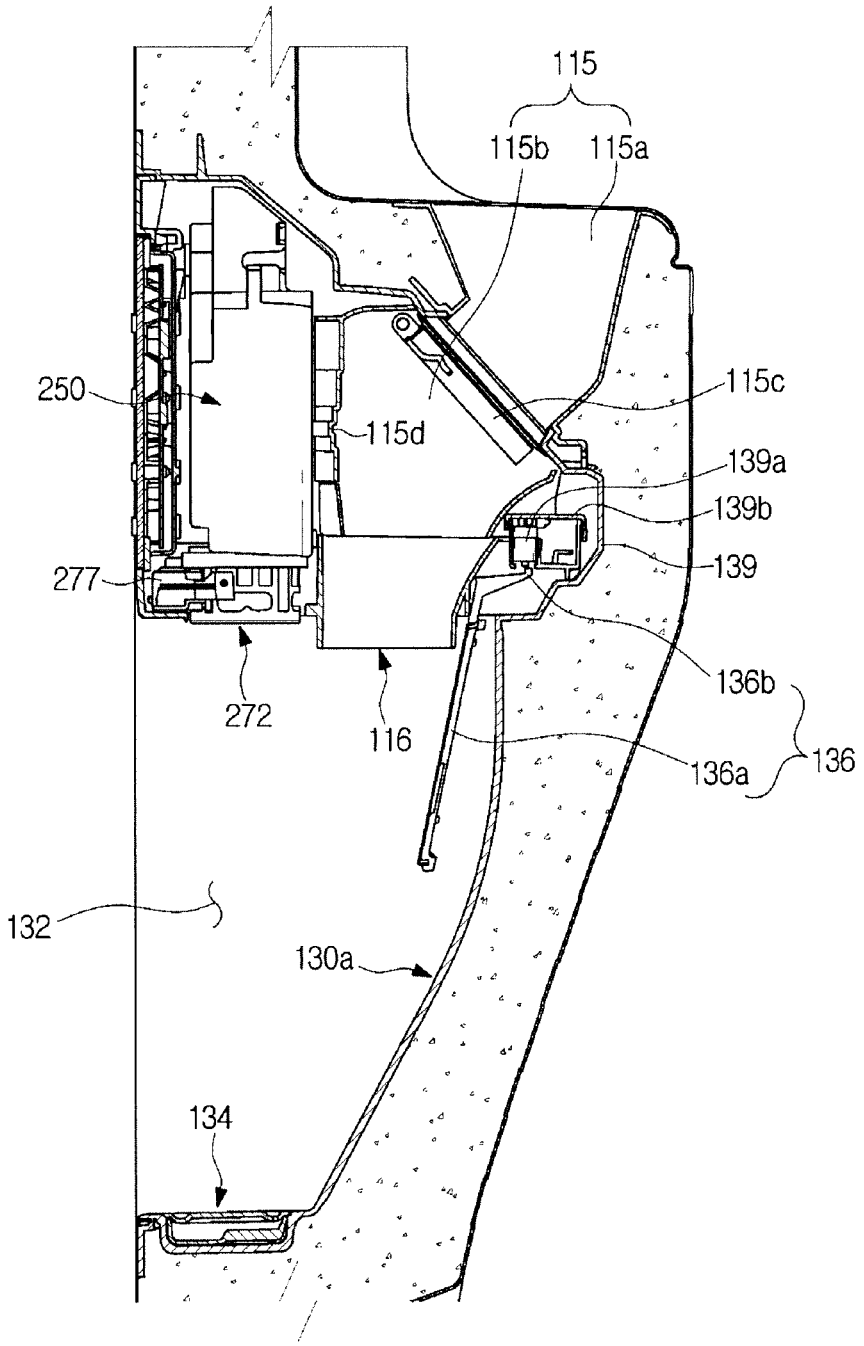
FIG. 20 is a side cross-sectional view of an embodiment of a dispenser assembly.
Figure 21:
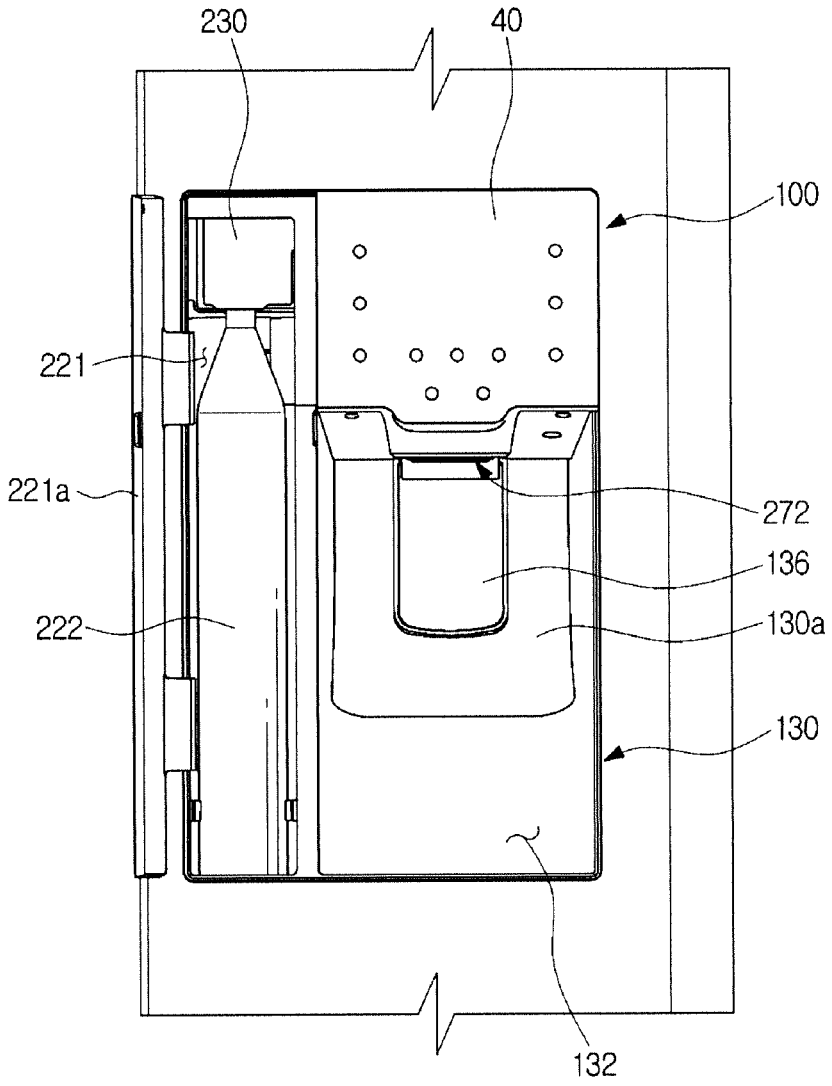
FIG. 21 is a front view of an embodiment of a dispenser assembly.

FIG. 20 is a side cross-sectional view of an embodiment of a dispenser assembly, and FIG. 21 is a front view of an embodiment of a dispenser assembly.

As shown in FIGS. 20 and 21, the dispenser assembly 100 may be installed to be exposed on the front of at least one of the doors 21, 22, 31 of the refrigerator 1, and may provide carbonated water, clean water, or ice to the user.

The dispenser assembly 100 may include the dispenser housing 130, which may be caved in from the front of the door toward the back to form the water intake space 132.

The water intake space 132 may be formed wide enough for the water intake container 170 to be smoothly inserted and attached to the attachment body 272. The back face 130*a* of the water intake space 132 may be formed to be slanted at a certain degree, and accordingly, the clean water or ice may be smoothly moved across the back face 130*a* of the water intake space 132. As described above, the water collector case 134 may be formed at the bottom of the water intake space 132.

The attachment body 272 to be coupled to the water intake container 170 and the outlet 116, through which the clean water or ice is discharged, may be formed inside the water intake space 132, and the attachment body 272 and the inlet 116 may be arranged on the top of the water intake space 132 for the clean water or ice to be naturally moved down by gravity.

The attachment body 272 and the outlet 116 may be installed to be close to each other. For example, as shown in FIG. 21, the attachment body 272 may be installed on the side of the opening of the water intake space 132, and the outlet 116 may be installed on the side of the back face 130*a* of the water intake space 132. The positions of the attachment body 272 and the outlet 116 are not limited thereto. For example, both the attachment body 272 and the outlet 116 may be installed side by side around the center of the water intake space 132.

The attachment body 272 may be formed in the second module body 271, which may be coupled to the first module body 261 to form a part of the carbonated water maker module 250.

The attachment sensor 277 may be installed on a side of the attachment body 272 to detect whether the water intake container 170 is coupled to the attachment body 272.

The outlet 116 may be formed at the end of a dispenser supply fluid path ending part 115 that extends from the dispenser supply fluid path 112, to discharge clean water flowing through the dispenser supply fluid path 112.

The dispenser supply fluid path ending part 115 may include a first ending part 115*a* and a second ending part 115*b*.

The first ending part 115*a* may be formed by extending from the dispenser supply fluid path 112.

The second ending part 115*b* may be formed by extending from the first ending part 115*a*. In some embodiments, the second ending part 115*b* may be manufactured separately from the first ending part 115*a*, and then connected to the first ending part 115*a* by being coupled to the first ending part 115*a*. The second ending part 115*b* may be separated by a partition wall 115*d* from the carbonated maker module 250, and the partition wall 115*d* may prevent the carbonated water maker module 250 from being damaged by the clean water or ice flowing in the second ending part 115*b*.

The first and second ending parts 115*a* and 115*b* may be divided by a cover 115*c* that may be opened or closed, and may be connected to each other or isolated from each other according to opening or closing of the cover 115*c*. The cover 115*c* may be opened or closed by a pressure applied by the clean water or ice moving from the dispenser supply fluid path 112 to the first ending part 115*a*, and opened or closed according to a control signal applied from outside.

The dispenser lever 136 may be formed near the back face 130*a* of the water intake space 132. The dispenser lever 136 may be installed near the attachment body 277, and may be pivoted to the opposite direction to where the attachment body 277 is arranged around a certain axis, i.e., to the back face 130*a* of the water intake space 132, according the applied pressure. Furthermore, the dispenser lever 136 may be pivoted around a certain axis to a direction where the attachment body 277 is arranged, i.e., to the forward direction, if the applied pressure is reduced or dissipated. Forward movement of the dispenser lever 136 may be implemented by an extra elastic substance.

The dispenser lever 136 may include a to-be-manipulated part 136*a* exposed to the inside of the water intake space 132, and a to-be-detected part 136*b* detected by a dispenser lever sensor part 139 while moving along the to-be-manipulated part 136*a* if the to-be-manipulated part 136*a* is manipulated.

The to-be-manipulated part 136*a* may have a form allowing the user to easily apply force, and in some embodiments, may have a form corresponding to the appearance of a container held by the user. The to-be-manipulated part 136*a* may be pivoted around a certain axis within a certain range. The user may apply a certain pressure onto the to-be-manipulated part 136*a* to pivot the to-be-manipulated part 136*a*. When the to-be-manipulated part 136*a* is pivoted, clean water or ice is discharged from the outlet 116.

The to-be-detected part 136*b* may not be exposed to the water intake space 132, and may be connected to the to-be-manipulated part 136*a* and pivoted around the certain axis within the certain range, like the pivoting of the to-be-manipulated part 136*a*.

Inside the dispenser assembly 100, the dispenser lever sensor part 139 may be formed to detect the to-be-detected part 136*b*. The dispenser lever sensor part 139 may include a sensor 139*a* for detecting the to-be-detected part 136*b*, and a housing 139*b* containing the sensor 139*a* and related parts.

The sensor 139*a* may be implemented with a pressure sensitive sensor or a contact sensor, in which case the sensor 139*a* detects contact of the to-be-detected part 136*b* and based on the detection result, outputs and sends an electric signal to the processor 300. Specifically, as the to-be-detected part 136*b* is pivoted by manipulation of the to-be-manipulated part 136*a*, an end of the to-be-detected part 136*b* is also moved and comes into contact with the sensor 139*a*, which in turn detects the contact and outputs and sends an electric signal to the processor 300.

In some embodiments, the sensor 139*a* may be implemented by not only the pressure sensitive sensor or contact sensor but also a reed switch that detects the magnet placed in the to-be-detected part 136*b* or a micro switch that becomes on/off by being pressurized by the to-be-detected part 136*b*.

Although an example where the dispenser lever sensor part 139 detects whether the dispenser lever 136 is manipulated using the to-be-detected part 136*b* was described above, how the dispenser lever sensor part 139 detects manipulation of the dispenser lever 136 is not limited thereto, but various methods that may be considered by the designer may be used.

A cylinder receiving space 211, to which the carbon dioxide cylinder 22 may be inserted, may be provided on a side of the water intake space 132 in the dispenser housing 130, and the carbon dioxide supply valve 230 is arranged at the top end of the cylinder receiving space 211. A cylinder door 221*a* is arranged on a side of the cylinder receiving space 211 to open or close the cylinder receiving space 211 by being pivoted on a hinge.

Furthermore, in the dispenser housing 130, the user interface 400 may further be installed.

An embodiment of the ice maker will now be described.

Figure 22:
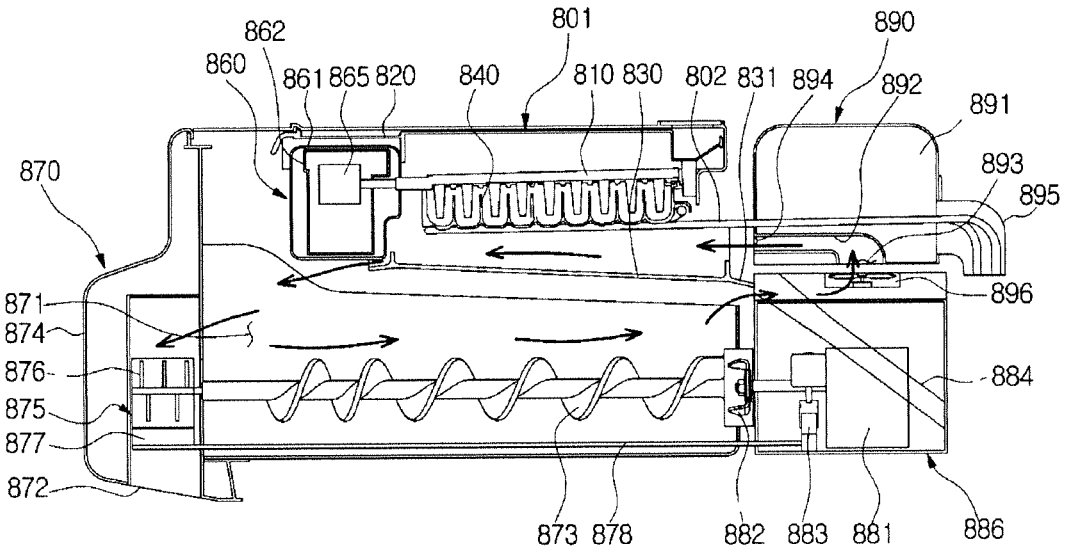
FIG. 22 is a cross-sectional view of an embodiment of an ice maker.
Figure 23:
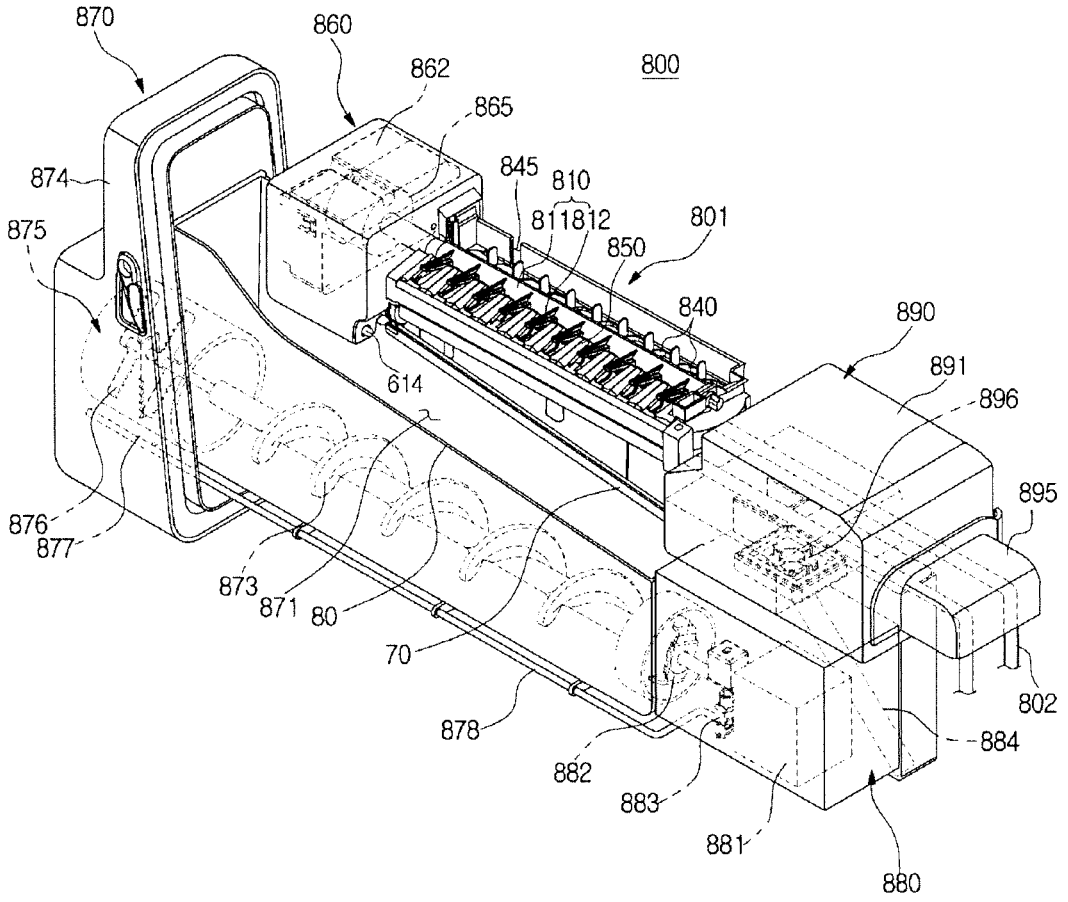
FIG. 23 is a perspective view of an embodiment of an ice maker.
Figure 24:
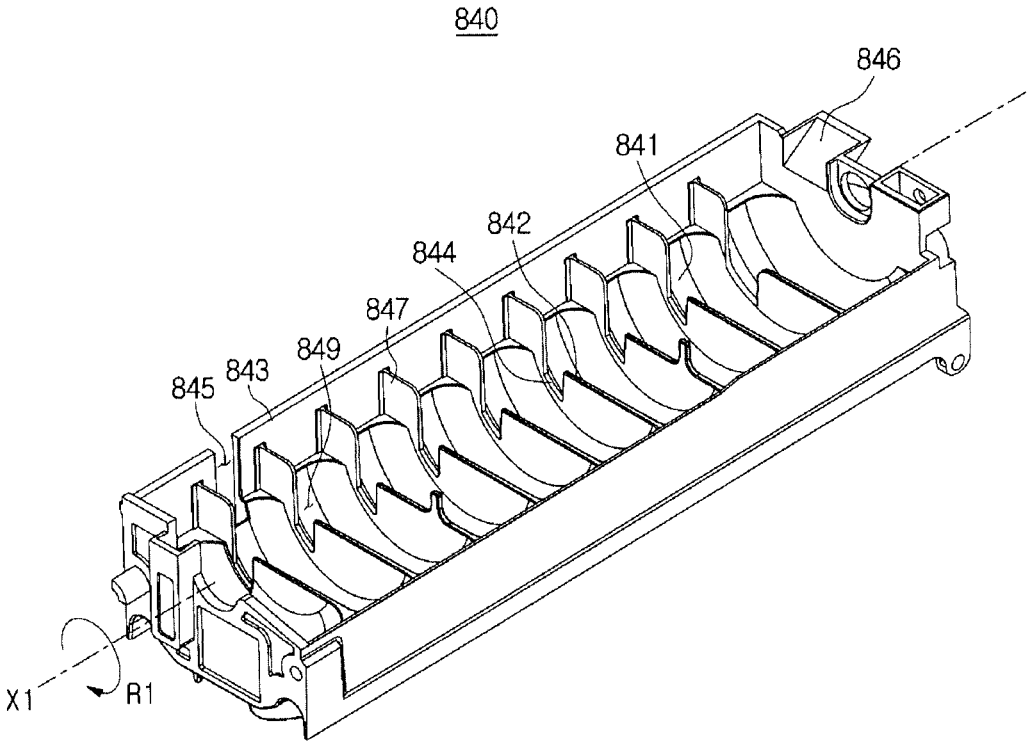
FIG. 24 is a diagram for explaining an example of a ice maker tray with clean water supplied thereto.
Figure 25:
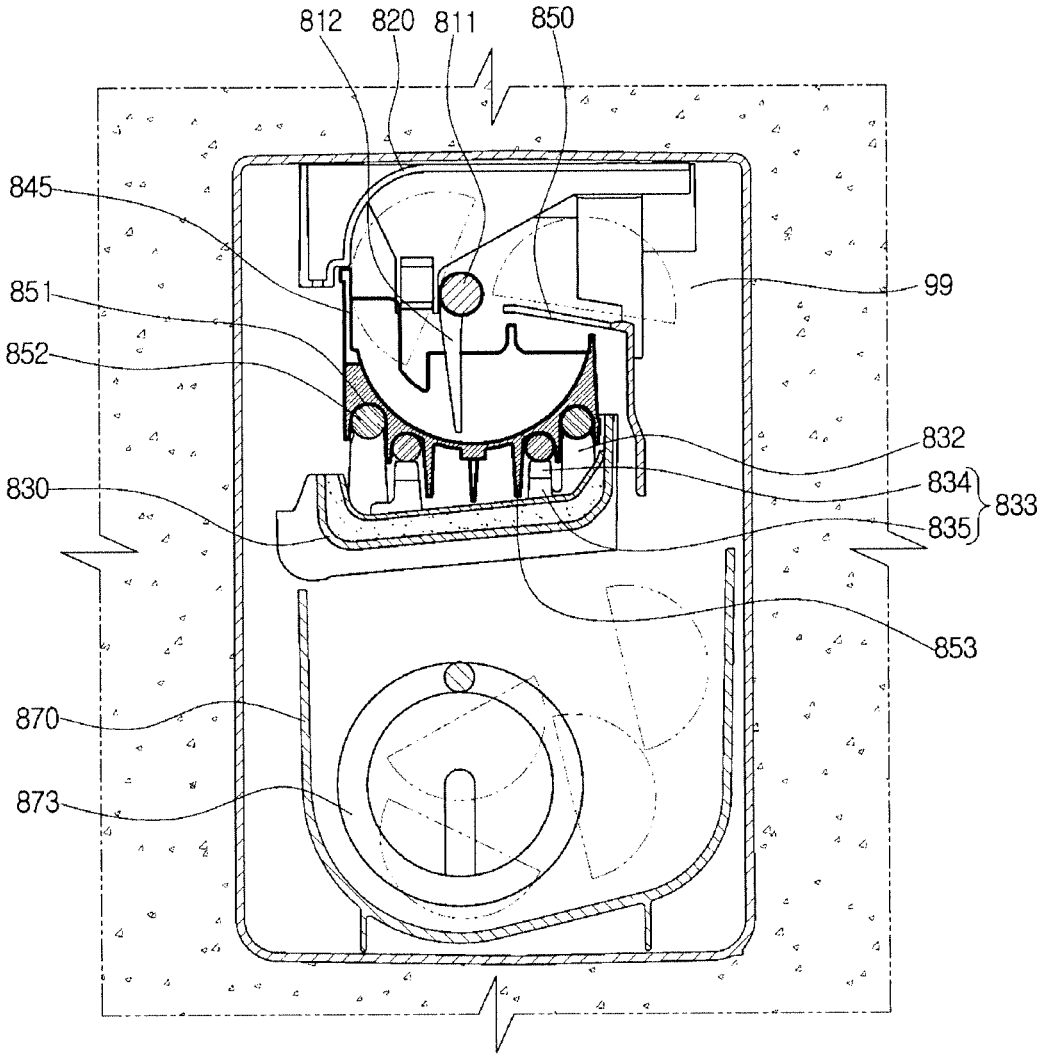
FIG. 25 shows an internal structure of an embodiment of an ice maker.

FIG. 22 is a cross-sectional view of an embodiment of an ice maker, and FIG. 23 is a perspective view of an embodiment of an ice maker. FIG. 24 is a diagram for explaining an example of a ice maker tray with clean water supplied thereto, and FIG. 25 shows an internal structure of an embodiment of an ice maker.

Referring to FIGS. 22 and 23, the ice maker 800 may include a ice maker tray 840 in which clean water is supplied and ice is formed, an ejector 810 for removing ice from the ice maker tray 840, a driving device 860 for driving the ejector 810, a drain duct 830 for guiding water overflowing from the ice maker tray 840 or defrosted water from the ice maker tray 840, an ice bucket 870 for storing ice formed in the ice maker tray 840, an auger motor assembly 880 for driving an auger 873 that transfers ice, and an air duct 890 for insulating a refrigerant pipe 802 arranged inside an ice maker room 60 and at the same time, forming part of a cold air fluid path inside the ice maker room 60.

A groove, in which an ice maker refrigerant pipe 802 may be installed, may be formed in the bottom of the ice making tray 840 in the lengthwise direction of the ice making tray 840, and may directly contact the ice maker refrigerant pipe 802. The ice maker tray 840 may serve as a self heat exchanger and obtain ice 99 by freezing the clean water contained in an ice maker space 849. Furthermore, there may be a plurality of heat exchange ribs (not shown) formed under the ice maker tray 840 to increase an air contact area to improve heat exchange performance. The ice maker tray 840 may be implemented using a highly conductive material, such as aluminum.

As shown in FIG. 24, the ice maker tray 840 may include the ice maker space 849 for receiving water supplied and forming ice 99.

The ice maker space 849 may have various forms, e.g., a substantially half-circular form with a bottom face 841 having the shape of an arc with certain radius. Furthermore, the ice maker space 849 may be divided by a plurality of partition walls 842 protruding upward from the bottom face 841 into a plurality of unit ice maker spaces 849.

Linking grooves 844 may be formed in the respective partition walls 842 to link the neighboring unit ice maker spaces 849, such that the water flowing in through at least one water supply port 846 formed in the ice maker tray 840 may be supplied to all the unit ice maker spaces 849. The ice maker tray 840 may be positioned at an angle in the lengthwise direction such that a part where the water supply port 846 is formed is somewhat higher than the other parts, and accordingly, the clean water supplied may be moved from one end to the other end inside the ice maker tray 840.

In the ice maker tray 840, an anti-fallout wall 843 may further be formed to prevent the ice formed in the ice maker tray 849 from falling and at the same time, guiding the ice maker tray 840 to a slider 850.

The ice maker tray 840 may further include a plurality of cutting ribs 847 to break the ice 99 formed into a plurality of unit ice cubes. The ice created 99 formed in the unit ice maker spaces 849 may be formed in one body because of the linking parts 844, and the cutting ribs 847 may break the ice 99 formed in one body. The cutting ribs 847 may be formed to protrude upward from the entire or part of the partition walls 842 and to contact the anti-fallout wall 843. The cutting ribs 847 may break the ice 99 into unit ice cubes when the ejector 810 pushes the ice 99 out of the ice maker space 849 while being rotated. The cutting rib 847 may be formed to have the height to the top edge of the cutting rib 847 higher than a half of the height to the top edge of the partition wall 842

In some embodiments, as shown in FIG. 25, an ice removal heater 852 may be installed in the ice maker tray 840 for heating the ice maker tray 840 to facilitate removal of the ice 99 from the ice maker tray 840. The ice removal heater 852 may be arranged to be received in an ice removal heater contact 851 shaped like a groove under the ice maker tray 840.

The ejector 810 is configured to separate the ice 99 from the ice maker tray 840. The ejector 810 may include a rotation shaft 811 to be rotated in a certain direction R1 around a certain axis x1, and a plurality of ejector fins 812 protruding from the rotation shaft 811. The ejector fins 812 may remove the ice 99 from the ice maker space 849 while being rotated around the rotation shaft 811. The ejector 810 may be connected to the driving device 860 that provides a turning force to the ejector 810 and rotated in the certain direction R1 according to an operation of the driving device 860.

As needed, the ice maker tray 840 may further include an opening part 845 to discharge overflowing clean water if the water supplied exceeds a certain amount. For example, the opening part 845 may be formed in the upper part of one of the plurality of unit ice maker spaces. Accordingly, if clean water supplied to the ice maker tray 840 exceeds more than a certain level, the oversupplied clean water may be discharged out of the ice maker tray 840 through the opening part 845 and thus the ice created in the ice maker tray 840 may not exceed a certain size. In some embodiments, the opening part 845 may be made at a position opposite where the water supply part 846 is arranged or around the opposite position.

The water discharged through the opening part 845 may fall down to the drain duct 830 arranged underneath the ice maker tray 840 and may then be moved.

The ice maker 800 may further include the drain duct 830 arranged underneath the ice maker tray 840 to form a part of the cold air fluid path in the ice maker room 60 between itself and the ice maker tray 840, and at the same time, to collect water discharged from the ice maker tray 840 due to oversupplying and defrosted water in the ice maker tray 840, and to guide them.

The drain duct 830 may be formed to be somewhat inclined for the water falling through the opening part 845 to flow to a guide part 831 formed at one end of the drain duct 830. The guide part 831 may guide the clean water discharged through the opening part 845 to a drain hose 884 of the auger motor assembly 880.

In the drain duct 830, an ice removal heater fixer 832 to support and put the ice removal heater 852 closely to the ice removal heater contact 851 of the ice maker tray 840, and a refrigerant pipe fixer 833 to support and put the ice maker room refrigerant pipe 802 closely to a refrigerant pipe contact 861 may be formed to protrude upward.

The ice removal heater fixer 832 may be formed of a highly conductive material, such as aluminum, guiding heat from the ice removal heater 832 to the drain duct 830 and preventing the drain duct 830 from being frosted.

The refrigerant pipe fixer 833 may include an elastic part 834 formed of a rubber material, and a pressurizer part 835 to pressurize the ice maker room refrigerant pipe 802. The elastic part 834 is formed to directly contact the ice maker room refrigerant pipe 802 to adhere the ice maker room refrigerant pipe 802 to the refrigerant pipe contact 861 of the ice maker tray 840, but prevent damages to the ice maker room refrigerant pipe 802 while contacting the ice maker room refrigerant pipe 802.

The driving device 860 may include a driving device housing 861 with an internal space, and a driving module 862 installed in the internal space of the driving device housing 861.

The driving module 862 may include an ice removal motor 865 to generate turning force to rotate the ejector 810, and further include an electromotive means to transfer the turning force of the ice removal motor 865 to the ejector 810.

The driving device housing 861 may further be equipped with semiconductor devices for controlling an ice making procedure and a circuit substrate with the semiconductor devices mounted thereon, as needed, and the semiconductor devices may be programmed to control overall operation about the ice making procedure, such as water supplying, ice making, ice removal, ice transferring, etc.

The ice maker 800 may further include an ice storage space 871 for storing ice formed in the ice maker tray 840, the ice bucket 870 having an auger 873 to transfer the stored ice to an outlet 872 on the front, and the auger motor assembly 880 to drive the auger 430 of the ice bucket 873.

The ice bucket 870 may also include an ice breaking device 875 to break ice transferred forward by the auger 873, and an ice maker room cover 874 to cover the open front of the ice maker room 60.

The ice breaking device 875 may include ice breaking blades 876 to break ice while being rotated along with the auger 873, and a supporting member 877 arranged under the ice breaking blades 876 to support ice to be broken apart. The supporting member 877 may be connected by a connecting member 878 to a solenoid valve 883 of the auger motor assembly 880. If the solenoid valve 883 is driven up and down, the connecting member 878 may be eccentrically rotated to move the supporting member 507 to support or not to support the ice.

The auger motor assembly 880 may include an auger motor 881 for generating turning force, a flange 882 combined with the auger 873 to deliver the turning force of the auger motor 881 to the auger 873, the solenoid valve 883 for selecting whether to grind ice with an ice grinding device 875, an ice maker room fan 896 for circulating the air inside the ice maker room 60, and a drain hose 884 for guiding the clean water directed through the guide unit 831 of the drain duct 830 out of the ice maker room 60.

As shown in FIG. 3, the auger motor assembly 880 may be installed by sliding into the ice maker room 60, and on the contrary, separated by sliding out from the ice maker room 60. Accordingly, parts constituting the aforementioned auger motor assembly 880 may be easily installed in the ice maker room 60, and for repair and exchange, the auger motor assembly 880 may be repaired and exchanged easily by being separated from the ice maker room 60.

An air duct 890 of the ice maker 800 may be configured with an insulation member 891 to wrap around the ice maker room refrigerant pipe 802 to insulate the ice maker room refrigerant pipe 802 from outside, a fixing member 895 for fixing the ice maker room refrigerant pipe 802 to the ice maker room 60, and an internal fluid path 892 that forms at least a part of the fluid path for cold air inside the ice maker room 60.

The insulation member 891 may be configured to wrap around the ice maker room refrigerant pipe 802 to insulate the ice maker room refrigerant pipe 802 and at the same time, to prevent deformation, e.g., bending of the ice maker room refrigerant pipe 802. The fixing member 895 may be coupled onto the inner wall of the main body of the refrigerant 1 to fix the ice maker room refrigerant pipe 802.

An inlet 893 of the internal fluid path 892 may be formed on the bottom of the air duct 890, and an outlet 894 of the internal fluid path 892 may be formed on the front of the air duct 890, so that air may be drawn in through the bottom of the air duct 890 and cold air may be discharged to the front of the air duct 890. In this case, the ice maker room fan 896 may be installed under the inlet 893 of the internal fluid path 892 to circulate air inside the ice maker room 60. The ice maker room fan 896 may be rotated to circulate the air inside the ice maker 800 by making the air in the lower part of the air duct 890 flow into the internal fluid path 892.

Accordingly, the cold air inside the ice maker room 60 may be circulated in the ice maker room 60 along the direction of an arrow shown in FIG. 22. In other words, the air discharged from the air duct 890 passes space between the ice maker tray 840 and the drain duct 830 to exchange heat with the ice maker room refrigerant pipe 802 or the ice maker tray 840, and the heat-exchanged cold air may flow back into the air duct 890 via the ice grinding device 875 and the ice storage space 871.

This circulation of the cold air in the ice maker room 60 may enable the cold air to be uniformly delivered even to the surroundings of the ice outlet 872 of the ice bucket 870 and the ice storage space 871.

An embodiment of operation of the refrigerator 1 will now be described with reference to FIGS. 26 to 30.

Figure 26:
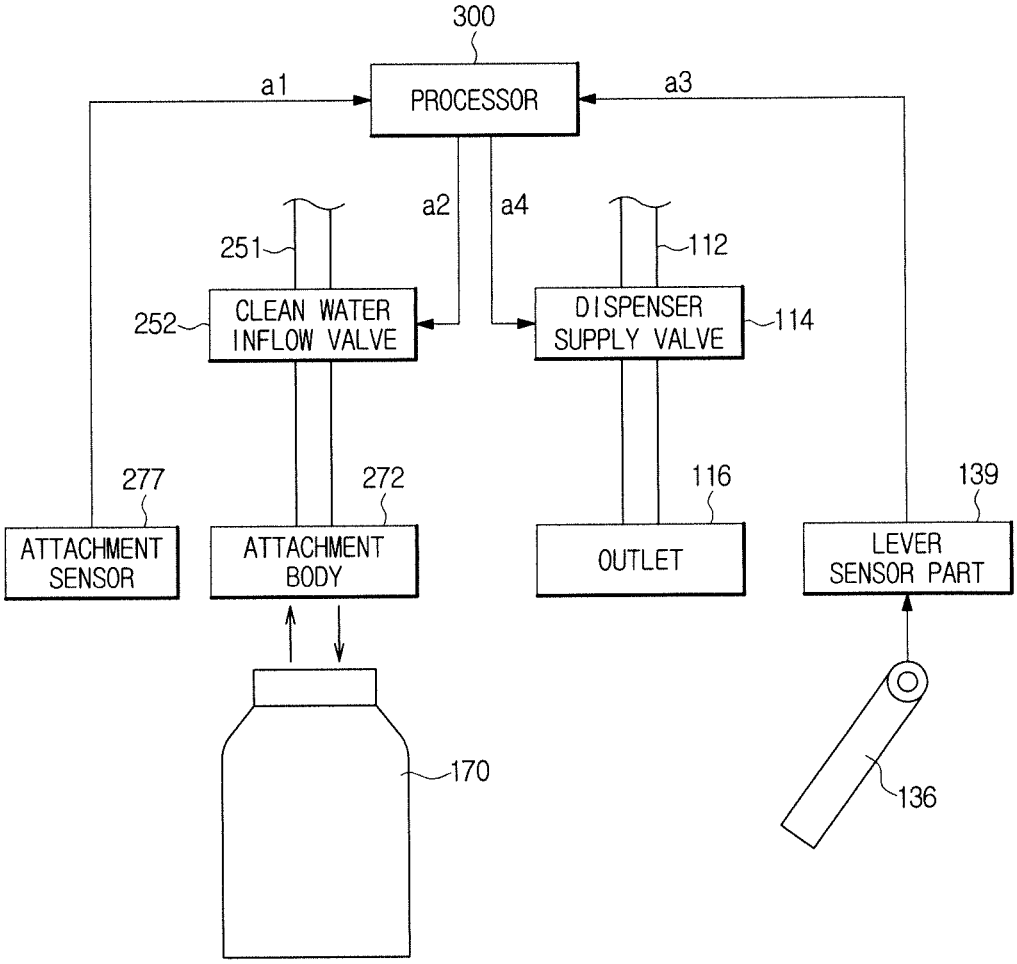
FIG. 26 is control block diagram of an embodiment of control flows of a refrigerator.

FIG. 26 is control block diagram of an embodiment of control flows of a refrigerator.

As shown in FIG. 26, in an embodiment, the refrigerator 1 may include the clean water inflow path 251, the clean water inflow valve 252, the attachment body 272, the attachment sensor 277, the dispenser supply fluid path 112, the dispenser supply valve 114, the outlet 116, the dispenser lever 136, the dispenser lever sensor part 139, and the processor 300.

The clean water inflow path 251, the clean water inflow valve 252, the attachment body 272, the attachment sensor 277, the dispenser supply fluid path 112, the dispenser supply valve 114, the outlet 116, the dispenser lever 136, and the dispenser lever sensor part 139 were described above, so the details of them will be omitted below.

The processor 300 may receive an electric signal output from the attachment sensor 277 or the dispenser lever sensor part 139 (a1, a3), generate a control signal based on the received electric signal, and send the control signal to the clean water inflow valve 252 or the dispenser supply valve 114 (a2, a4). In other words, the processor 300 may control the clean water inflow valve 252 or the dispenser supply valve 114 to be opened or closed according to whether the water intake container 170 is attached to the attachment body 272 or the dispenser lever 136 is manipulated.

The processor 300 may be implemented with one, tow or more semiconductor chips and related parts that may be mounted on a printed circuit board (not shown) arranged in the refrigerator 1, and may include, for example, a micro control unit (MCU) or a central processing unit (CPU). The printed circuit board may be installed at any position in the refrigerator 1 according to a selection from the designer, for example, inside the door 21, 22, 31 of the refrigerator. In this case, the printed circuit board may be installed in a part corresponding to where the user interface 400 is installed inside the door 21, 22, 31.

Figure 27:
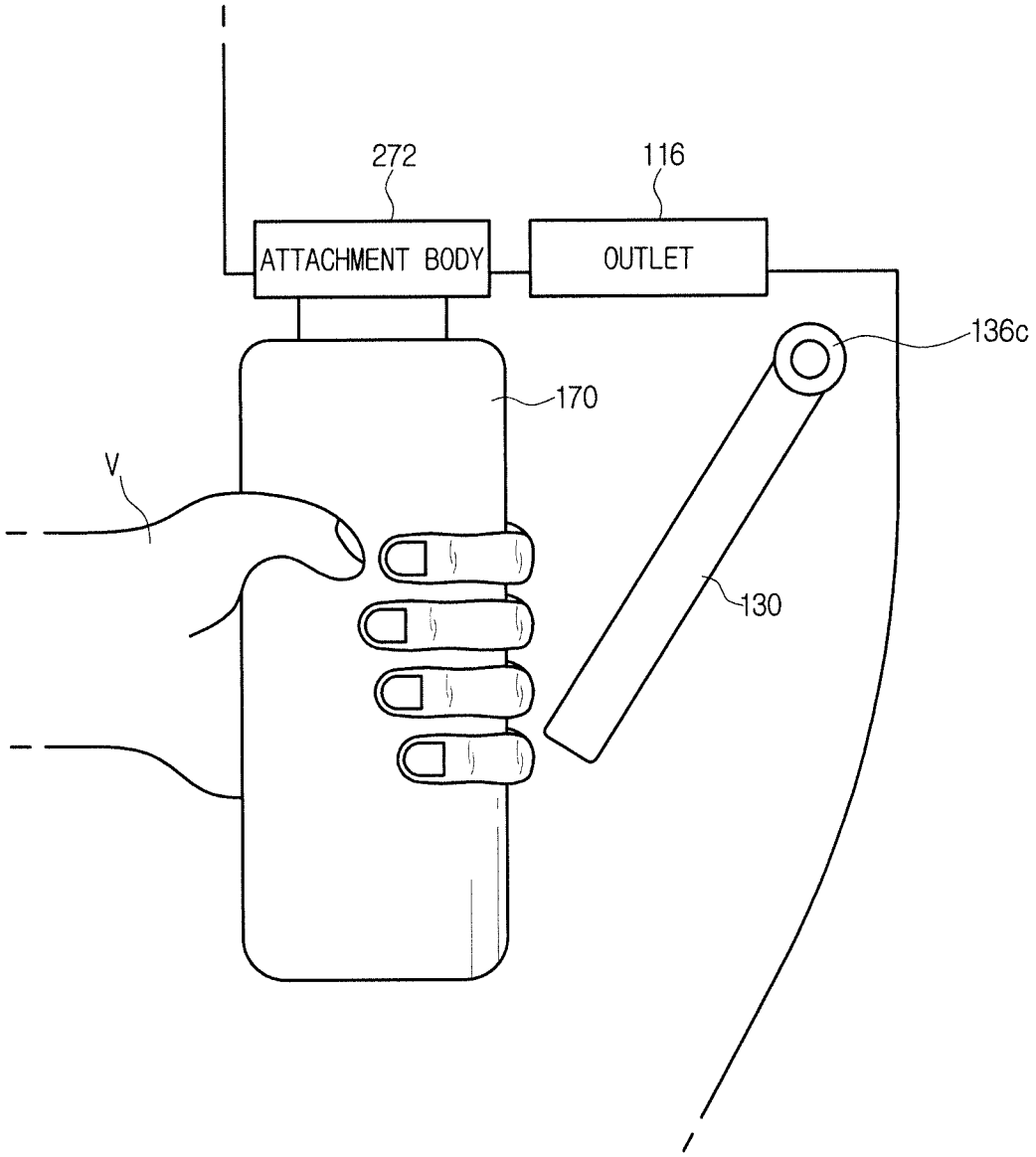
FIG. 27 briefly shows a procedure of combining a water intake container with a carbonated water maker module.

FIG. 27 briefly shows a procedure of combining a water intake container with a carbonated water maker module.

As shown in FIG. 27, if the user holds the water intake container 170 with his/her hand (v) and attach the water intake container 170 to the attachment body 272 by inserting the water intake container 170 to the water intake space 132, the attachment sensor 277 may output an electric signal corresponding to the attachment and send the electric signal to the processor 300 (a1).

The processor 300 determines based on the received electric signal that the water intake container 170 is or is being attached to the attachment body 272, and based on the determination, sends a control signal to the dispenser supply valve 114 (a4) to block the dispenser supply valve 114. If the dispenser supply valve 114 is blocked, the clean water or ice flowing to the dispenser supply fluid path 112 is blocked by the dispenser supply valve 114 and moved no longer, so no or almost no clean water or ice is discharged through the outlet 116.

In some embodiments, if determining based on the received electric signal that the water intake container 170 is or is being attached to the attachment body 272, the processor 300 may send a control signal for the clean water inflow valve 252 to be opened.

Figure 28:
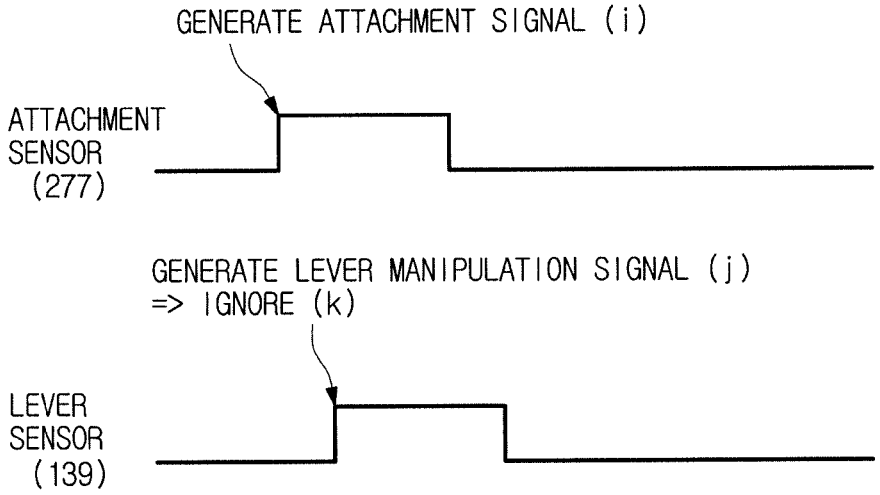
FIG. 28 shows time-varying changes in electric signals output from an attachment sensor and a lever sensor while an attachment signal is generated.

FIG. 28 shows time-varying changes in electric signals output from an attachment sensor and a lever sensor while an attachment signal is generated. In FIG. 28, the y-axis represents the magnitude of voltage and the x-axis represents time.

Once an attachment signal is generated (i) and sent to the processor 300 (a1) from the attachment sensor 277, the processor 300 ignores all the signals about manipulation of the dispenser lever (k), which are generated (j) and sent to the processor 300 from the dispenser lever sensor 139 after receiving the attachment signal, and may not generate any control signal related to manipulation of the dispenser lever.

Accordingly, opening of the dispenser supply valve 114 due to manipulation of the dispenser lever 136 may be prevented.

As shown in FIG. 27, if the user attaches the water intake container 170 to the attachment body 272, the user might mistakenly touch the dispenser lever arranged nearby with his/her hand (v) while turning the water intake container 170. Then, the dispenser lever 136 may be pivoted around a certain pivot axis 136*c* by a pressure applied by the user's hand (v), and accordingly, clean water or ice may be discharged through the outlet 116. This may cause inconvenience to the user because the clean water or ice is unintentionally discharged.

However, as described above, since the dispenser valve 114 is blocked to prevent the clean water or ice from being discharged through the outlet 116 if the water intake container 170 is attached to the attachment body 272, the possible inconvenience that might be caused to the user may be solved.

Figure 29:
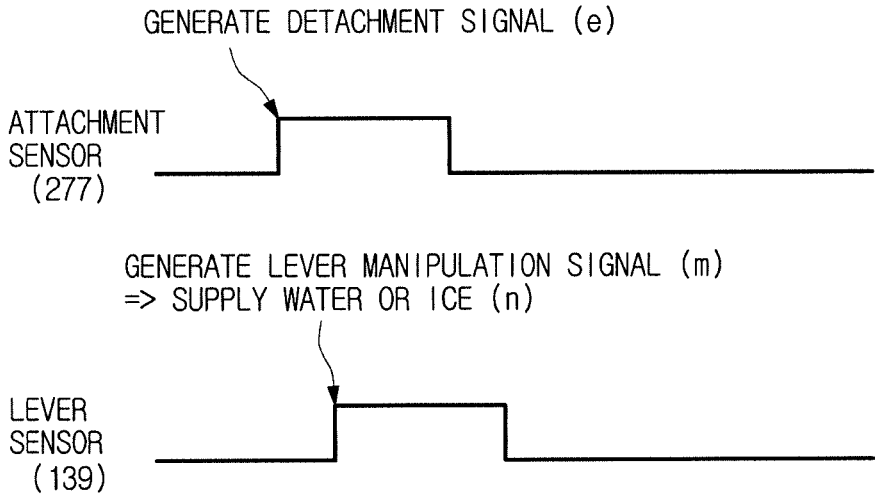
FIG. 29 shows time-varying changes in electric signals output from an attachment sensor and a lever sensor while a separation signal is generated.
Figure 30:
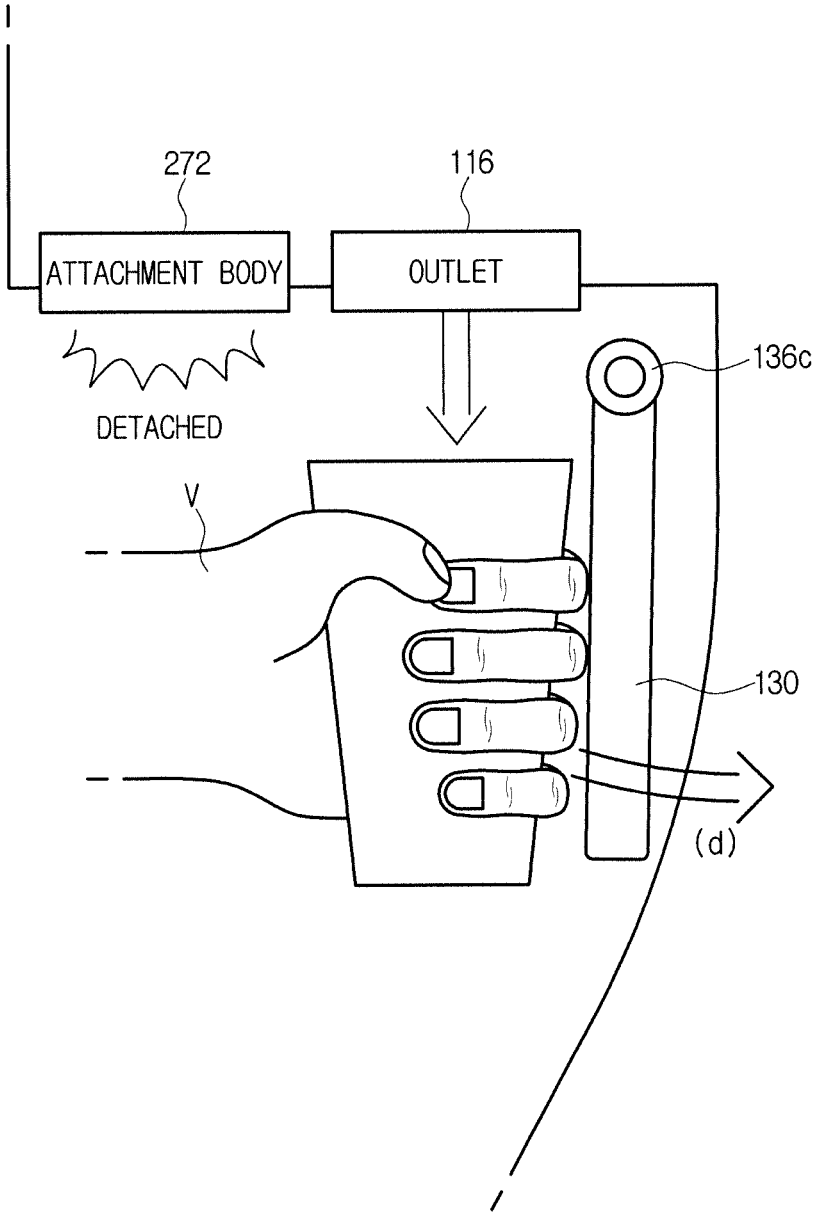
FIG. 30 is a diagram for explaining operation of a dispenser lever if a water intake container is not combined.

FIG. 29 shows time-varying changes in electric signals output from an attachment sensor and a lever sensor while a separation signal is generated, and FIG. 30 is a diagram for explaining operation of a dispenser lever if a water intake container is not combined. In FIG. 29, the y-axis represents the magnitude of voltage and the x-axis represents time.

As shown in FIG. 29, once the water intake container 170 is separated from the attachment body 272, the processor 300 receives an electric signal about the separation from the attachment sensor 277 (a1, e) or receive no electric signal from the attachment sensor 277.

After the separation signal is received (e) or after sending the electric signal from the attachment sensor 277 is stopped, as shown in FIG. 26, if the user presses and moves (d) the dispenser lever 136, the dispenser lever sensor part 139 generates and outputs an electric signal (m) and sends the electric signal to the processor 300 (a3). The processor 300 receives the electric signal sent in response to manipulation of the dispenser lever 136 (a3), outputs a control signal based on the received signal to open the dispenser supply valve 114 (a4), and opens the dispenser supply valve 114. As a result, clean water or ice is supplied through the outlet 116 (*n*). Accordingly, if the water intake container 170 is not attached to the attachment body 272, i.e., only if carbonated water is not produced, it is possible for the user to take clean water or ice from the refrigerator 1 by manipulating the dispenser lever 136.

Another embodiment of operation of the refrigerator 1 will now be described with reference to FIGS. 31 to 36.

Figure 31:
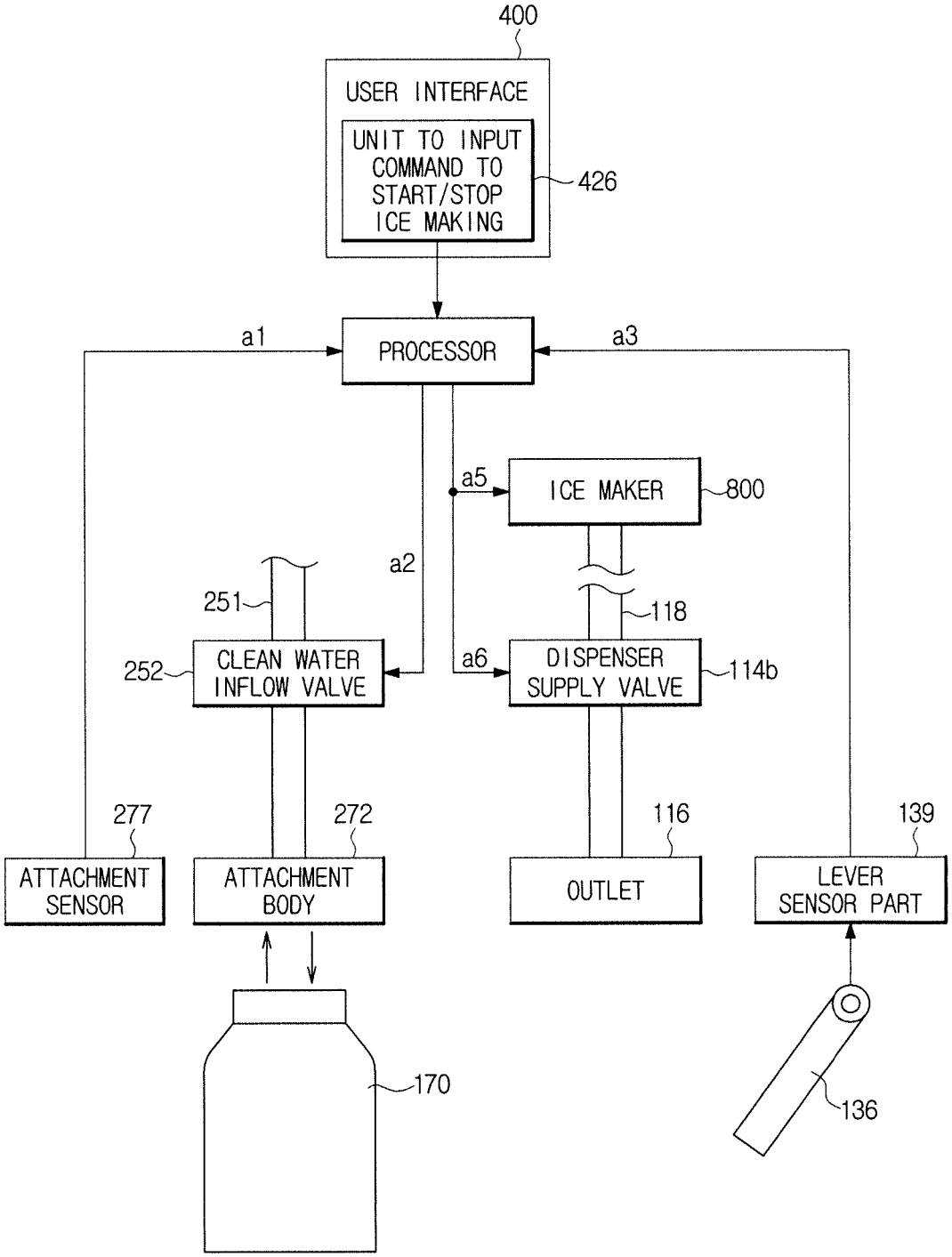
FIG. 31 is control block diagram of another embodiment of control flows of a refrigerator.
Figure 32:
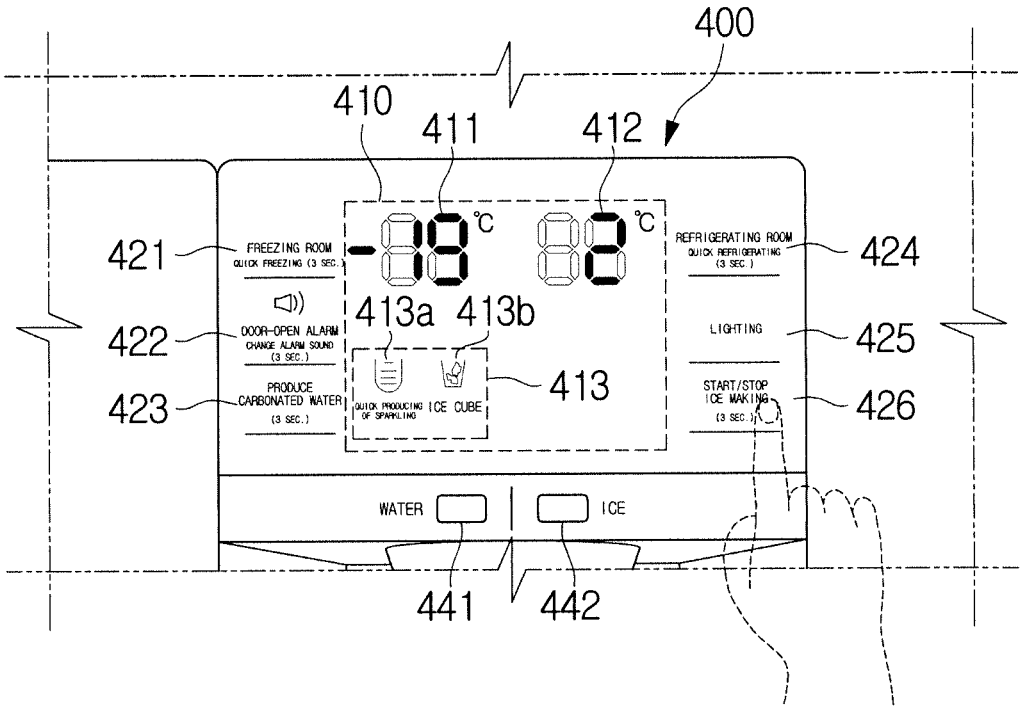
FIG. 32 shows an example of stopping ice making according to manipulation of an ice making operation button.

FIG. 31 is control block diagram of another embodiment of control flows of a refrigerator, and FIG. 32 shows an example of stopping ice making according to manipulation of a ice making operation button.

As shown in FIG. 31, the refrigerator 1 may include the clean water inflow path 251, the clean water inflow valve 252, the attachment body 272, the attachment sensor 277, the dispenser supply fluid path 118, a dispenser supply valve 114*b*, the outlet 116, the dispenser lever 136, the dispenser lever sensor part 139, the processor 300, the user interface 400, and the ice maker 800 in an embodiment.

The clean water inflow path 251, the clean water inflow valve 252, the attachment body 272, the attachment sensor 277, the dispenser supply fluid path 118, the dispenser supply valve 114*b*, the outlet 116, the dispenser lever 136, the dispenser lever sensor part 139, the user interface 400, and the ice maker 800 were described above, so the details of them will be omitted below.

The processor 300 may receive an electric signal output from the attachment sensor 277 (a1), generate a control signal based on the received electric signal, and send the control signal to the clean water inflow valve 252 (a2). In other words, the processor 300 may control the clean water inflow valve 252 to be opened or closed according to whether the water intake container 170 is attached to the attachment body 272.

Furthermore, the processor 300 may generate a control signal based on an electric signal (a3) from at least one of the user interface 400 and the lever sensor part 139 and send the control signal (a5, a6) to the ice maker 800 and the dispenser supply valve 114*b* connected to the ice maker 800 via the fluid path 118 to stop operation of the ice maker 800 or to offer ice formed by the ice maker 800 to the water intake space 132 through the outlet 116.

Specifically, the processor, as shown in FIG. 32, may receive an electric signal output from the unit 426 to input a command to start/stop ice making of the user interface 400 in response to the user's manipulation, generate a control signal corresponding to the received electric signal, and send the control signal (a5) to the ice maker 800 to control operation of the ice maker 800.

More specifically, if the user inputs a command to stop ice making by manipulating the unit 426 to input a command to start/stop ice making, the processor 300 may send the control signal (a5) corresponding to the command to stop ice making to the ice maker 800 to stop operation of the ice maker 800. In this case, the processor 300 may send the control signal for the display 410 to provide information 413*b* indicating that the ice maker 800 stops ice making to the user. For example, as shown in FIG. 32, the processor 300 may send a control signal to turn off a lighting device installed at a part to display the information 413*b* about whether ice making operation is performed, and in response to the control signal, the part to display the information 413*b* about whether ice making operation is performed becomes dark and displays no image. Accordingly, the refrigerator 1 may provide information indicating that the ice maker 800 stops its operation to the user.

On the contrary, if the user inputs a command to start ice making by manipulating the unit 426 to input a command to start/stop ice making, the processor 300 may send the control signal (a5) corresponding to the user command for the ice maker 800 to start ice making operation. Even in this case, the processor 300 may send the control signal for the display 410 to provide information 413*b* indicating that the ice maker 800 starts ice making to the user.

In the meantime, if the lever sensor part 139 detects operation of the dispenser lever 136 even while operation of the ice maker 800 is stopped, the processor 300 may send control signals (a5, a6) to the ice maker 800 and the dispenser lever supply valve 114*b* to resume operation of the ice maker 800 and to offer ice formed previously or according to the resumed operation of the ice maker 800 to the user.

Figure 33:
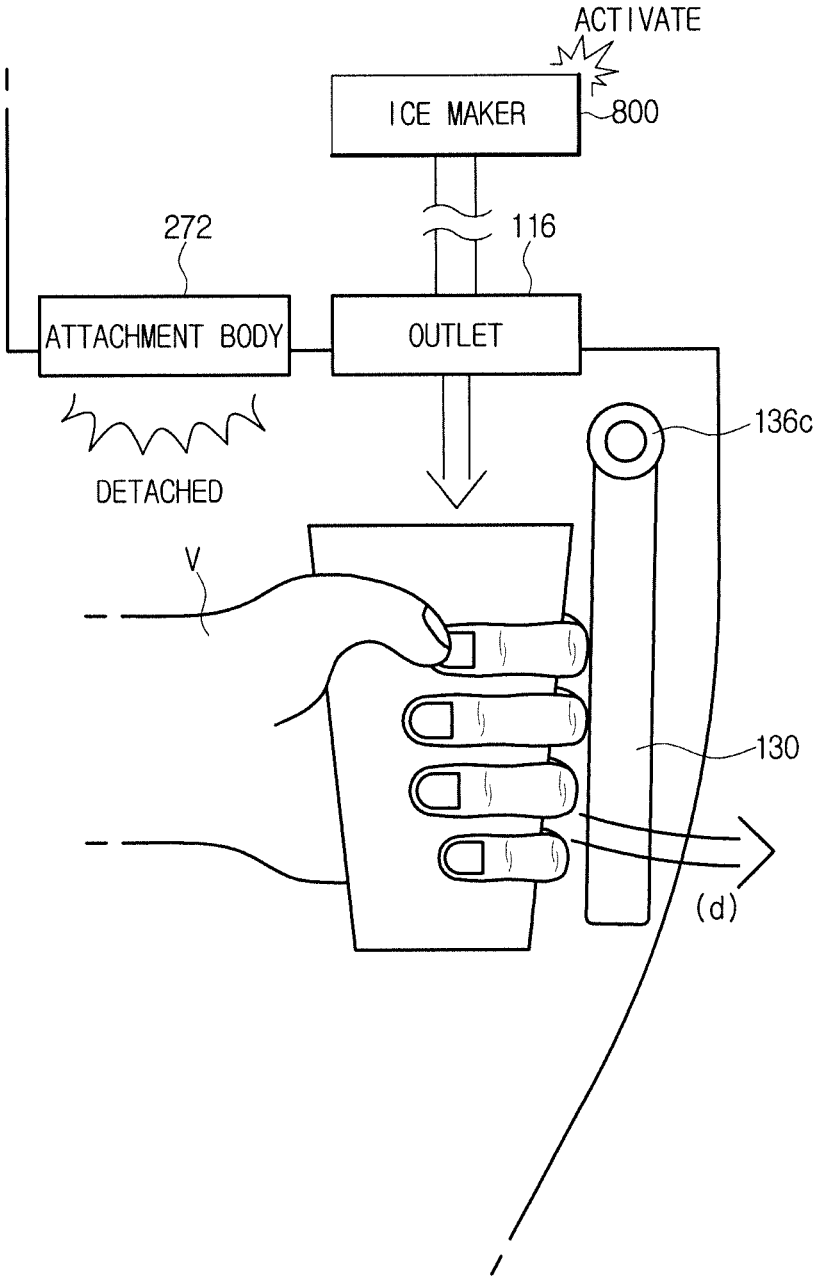
FIG. 33 shows an example of manipulating a dispenser lever.
Figure 34:
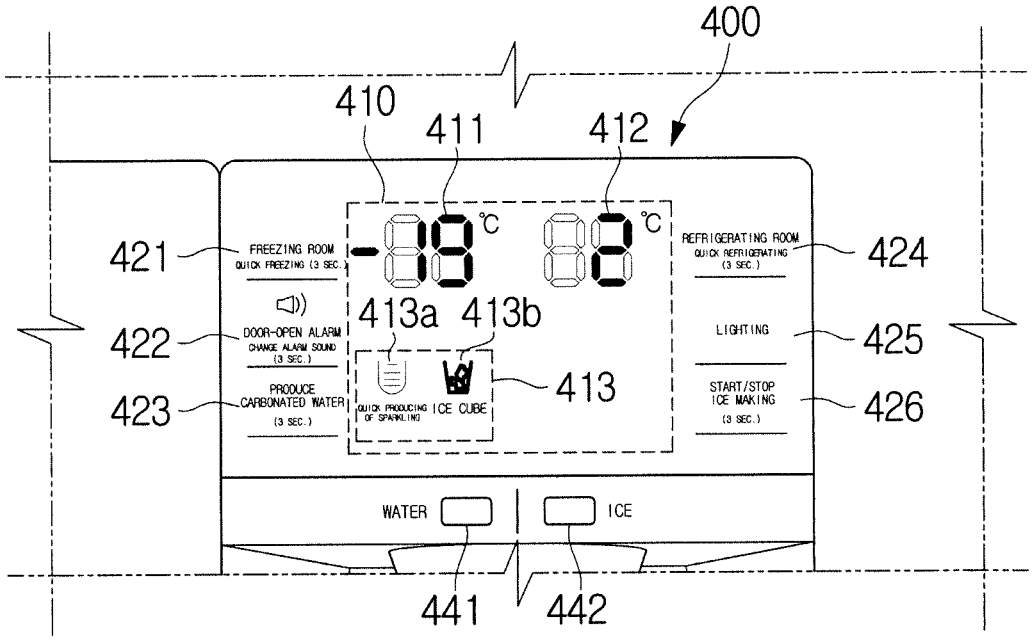
FIG. 34 shows an example of a user interface providing the user with information about the start of ice making operation when the ice making operation is started.

FIG. 33 shows an example of manipulating a dispenser lever, and FIG. 34 shows an example of a user interface providing the user with information about a start of ice making operation when the ice making operation is started.

As described above, the user may input a command to stop ice making operation by manipulating the unit 426 to input a command to start/stop ice making, in which case the processor 300 may send the control signal (a5) to the ice maker 800, which in turn stops ice making operation according to the control signal (a5).

The user may set the dispenser assembly 100 to offer ice by manipulating the unit 442 to input a command to discharge ice of the user interface 400, and as shown in FIG. 33, hold a container, such as a cup (c), and move the container (c) to the dispenser lever 136 to manipulate the dispenser lever 136. In this case, the dispenser lever 136 is pivoted around the pivot axis 136*c* in response to the movement of the container (c) along with the movement of the user's hand (v).

The lever sensor part 139 may detect pivoting of the dispenser lever 136, output an electric signal according to the detection and send the electric signal (a3) to the process 300 through a circuit or wire. In an embodiment, as described above, only if the water intake container 170 is not attached to the attachment body 272, the lever sensor part 139 may output an electric signal according to manipulation of the dispenser lever 136.

Receiving the electric signal (a3) from the lever sensor part 139, the processor 300 may generate the control signal (a5) for the command to start ice making operation in response to the received signal (a3) and forward the control signal (a5) to the ice maker 800. The ice maker 800 may resume the ice making operation if receiving the control signal (a5).

Furthermore, the processor 300 may forward the control signal (a6) even to the dispenser supply valve 114*b* connected to the ice maker 300 through the dispenser supply fluid path 118 in response to reception of the electric signal (a3) from the lever sensor part 139, enabling the ice formed previously or being formed by the ice maker 300 to be supplied to the water intake space 132 through the outlet 116.

Also, the processor 300 may send a control signal to the user interface 400 according to a feedback signal sent from the ice maker 800 in response to the electric signal (a3) sent from the lever sensor part 139 or the control signal (a5), so that the display 410 of the user interface 400 provides the user with information (413*b*) indicating that the ice maker 800 is performing ice making operation. For example, as shown in FIG. 34, under the control of the processor 300, the user interface 400 may provide the user with the information indicating that the ice maker 800 starts operation by turning on a lighting device installed in the part to display the information (413*b*) about whether the ice making operation is performed and illuminating the part.

Accordingly, even in a situation in which the ice maker 800 is set to not operate, the ice maker 800 may promptly resume operation just with the user's manipulation of the dispenser lever 136.

In an embodiment, the processor 300 may control the ice maker 800 to operate only if the dispenser lever 136 is manipulated for more than a certain period of time in a situation where the ice maker 800 is set to not operate. In other words, the processor 300 may resume the operation of the ice maker 800 only if receiving the electric signal (a3) from the lever sensor part 139 for more than a certain period of time.

Specifically, upon receiving the electric signal (a3) from the lever sensor part 139, the processor 300 may count time, and may generate the control signal (a5) for the command to start ice making operation in response to the signal (a3) received from the lever sensor part 139, the control signal (a6) for the dispenser supply valve 114*b*, and a control signal for the user interface 400, only if the count value exceeds a predetermined first time. The first time may be arbitrarily defined by a selection from at least one of the designer and the user, and, for example, may be defined to be 2 or 3 seconds.

More specifically, the processor 300 may increment the count value whenever receiving the electric signal (a3) from the lever sensor part 139, compare the count value with the first time, and control the respective parts to perform ice making operation and supply ice if the comparison reveals that the count value is greater than the first time. If delivering the electric signal (a3) from the lever sensor part 139 is stopped, the processor 300 may reset the count value, and may not generate the control signal (a5) for the command to start ice making operation, the control signal (a6) for the dispenser supply valve 114*b*, and a control signal for the user interface 400, only if the count value exceeds a predetermined first time. Accordingly, the processor 300 may prevent resumption of operation of the ice maker 800 from the user's wrong manipulation of the dispenser lever 136 only if the dispenser lever 136 is manipulated by the user for more than a certain period of time.

Figure 35:
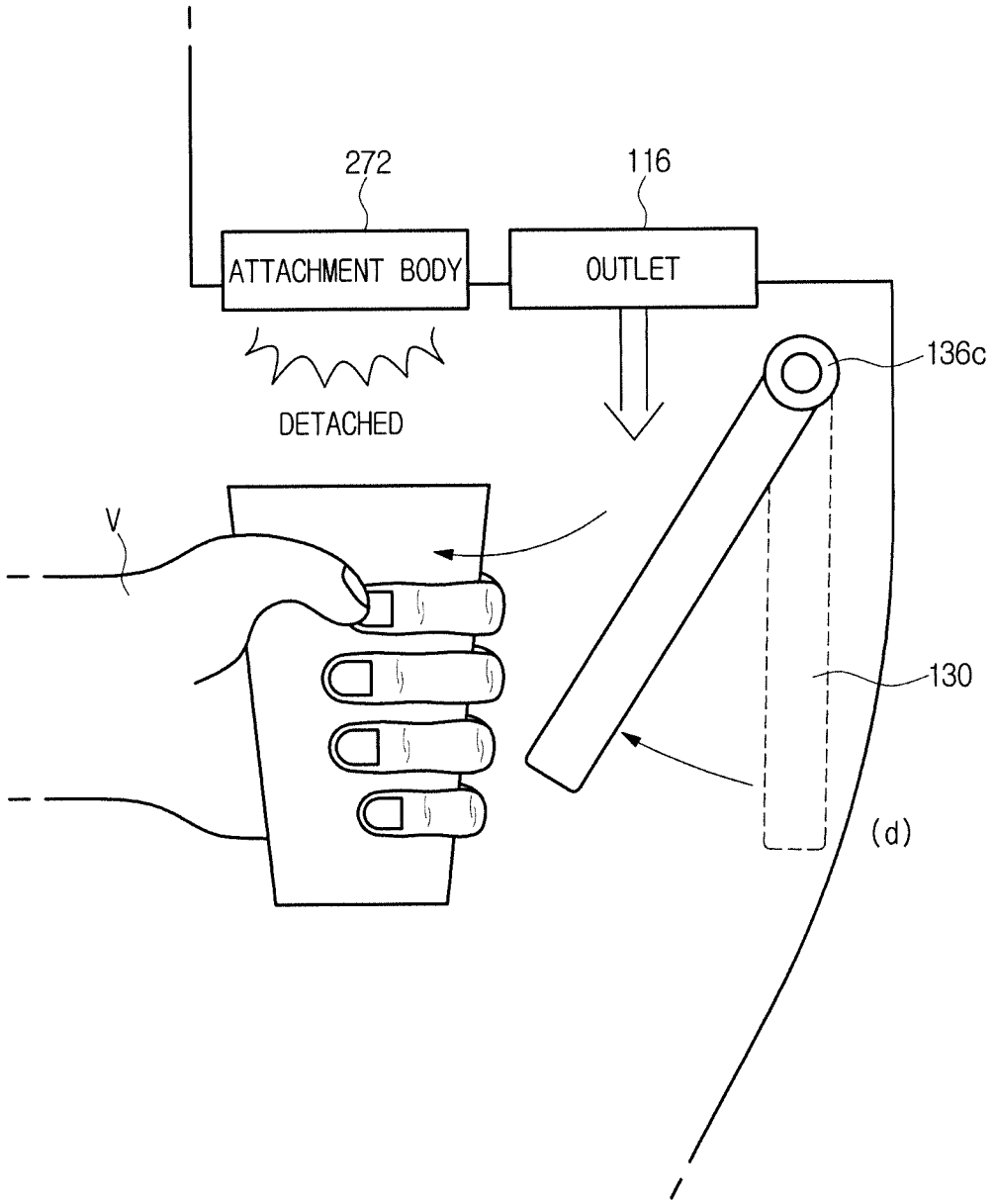
FIG. 35 shows an example of restoration of a dispenser lever.
Figure 36:
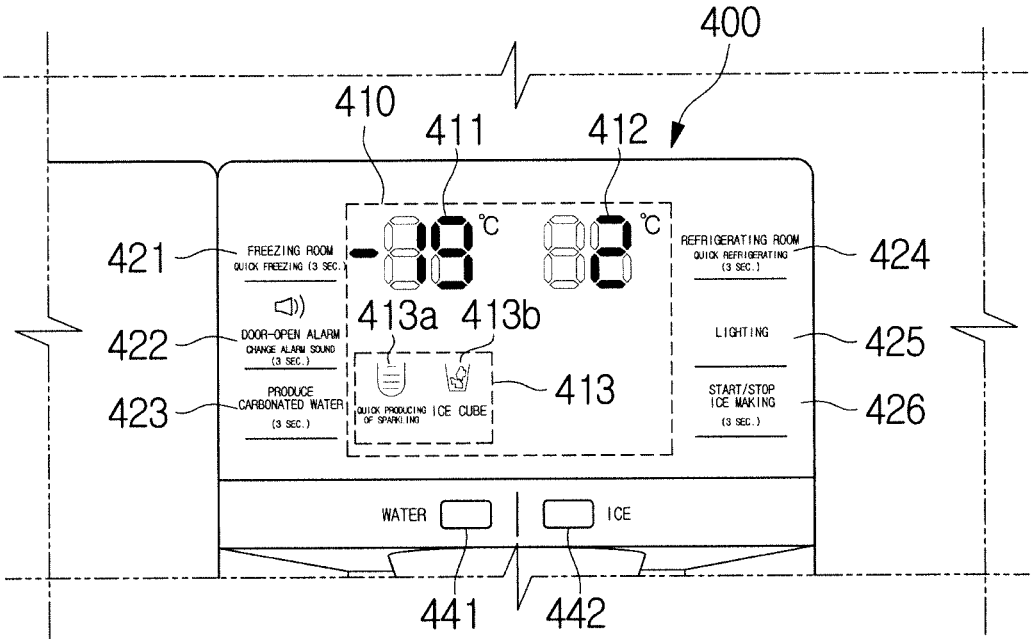
FIG. 36 shows an example of a user interface providing the user with information about the stop of ice making operation when the ice making operation is stopped.

FIG. 35 shows an example of restoration of a dispenser lever, and FIG. 36 shows an example of a user interface providing the user with information about a stop of ice making operation when the ice making operation is stopped.

As shown in FIG. 35, if the user places the container (c) away from the dispenser lever 136, the dispenser lever 136 is pivoted around the pivot axis 136*c* in the opposite direction and restored to its original state.

In this case, the lever sensor part 139 may stop sending the control signal (a3) to the processor 300, or send an electric signal related to the release from manipulation of the dispenser lever 136 to the processor 300.

In response to at least one of the stopping of sending the electric signal (a3) from the lever sensor part 139 and the delivery of the electric signal related to the release from manipulation of the dispenser lever 136, the processor 300 generates a control signal related to the stopping of operation of the ice maker 800 and sends the control signal to the ice maker 800. The ice maker 800 stops ice making operation in response to the received control signal.

Furthermore, in response to at least one of the stopping of sending the electric signal (a3) from the lever sensor part 139 and the delivery of the electric signal related to the release from manipulation of the dispenser lever 136, the processor 300 may forward the electric signal to the dispenser supply valve 114*b* to close the dispenser supply valve 114*b*.

Also, the processor 300 may send a control signal to the user interface 400 according to the stopping of sending the electric signal (a3) from the lever sensor part 139, the delivery of the electric signal related to the release from manipulation of the dispenser lever 136, and a feedback signal sent from the ice maker 800, so that the display 410 of the user interface 400 may provide the user with information (413*b*) indicating that the ice maker 800 is not performing ice making operation. For example, as shown in FIG. 36, the processor 300 may control a part of the user interface 400 to display the information (413*b*) about whether ice making operation is performed not to be illuminated by turning off a lighting device installed at the part, and accordingly, the refrigerator 1 provides the user with the information indicating that the ice maker 800 stops operation.

In some embodiments, the processor 300 may stop operation of the ice maker 800 and close the dispenser supply valve 114*b* only if sending of the electric signal (a3) from the lever sensor part 139 is stopped for more than a certain period of time.

Specifically, if the sending of the electric signal (a3) from the lever sensor part 139 is stopped, the processor 300 may count time, and may generate the control signal (a5) for the command to stop ice making operation, the control signal (a6) for the dispenser supply valve 114*b*, and the control signal for the user interface 400, only if the count value exceeds a predetermined second time. The second time may be arbitrarily defined by a selection from at least one of the designer and the user, and, for example, may be defined to be 10 or 20 seconds.

More specifically, the processor 300 may count time with an internal clock if sending of the electric signal (a3) from the lever sensor part 139 is stopped, compare the count value with the second time, and control the ice maker 800 to stop its operation if the comparison reveals that the count value is greater than the second time. Upon receiving the electric signal (a3) from the lever sensor part 139 in a situation that the count value is less than the second time, the processor may reset the count value, and may generate the control signal (a5) for the command to start ice making operation in response to the signal (a3) received from the lever sensor part 139, the control signal (a6) for the dispenser supply valve 114*b*, and a control signal for the user interface 400. According to this method, since the ice maker 800 continues to operate for more than a certain period of time even if the user's manipulation of the dispenser lever 136 is stopped for a little while, the user may obtain ice more quickly than in a case where the user manipulates the dispenser lever 136 again within a short time.

A first embodiment of a method for controlling a refrigerator will now be described in connection with FIG. 37.

Figure 37:
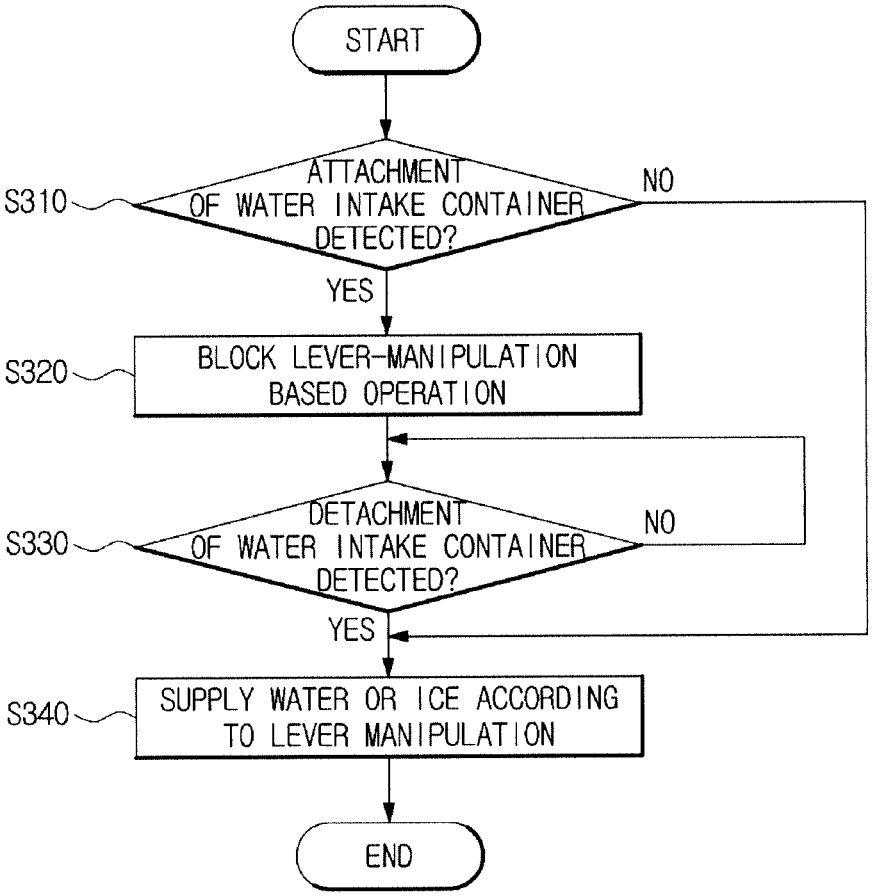
FIG. 37 is a flowchart showing a first embodiment of a method for controlling a refrigerator.

FIG. 37 is a flowchart showing the first embodiment of a method for controlling a refrigerator.

Referring to FIG. 37, first, it is detected whether the water intake container 170 is attached to the attachment body 272 of the refrigerator 1, in s310. Such detection may be performed by the aforementioned attachment sensor 272. The attachment sensor 272 may output an attachment-related electric signal only at a moment at which the water intake container 170 is attached in an embodiment, or may periodically output an electric signal while the water intake container 170 is attached in another embodiment.

If attachment of the water intake container 170 is detected (yes in s310), operation of supplying clean water or ice based on manipulation of the dispenser lever 136 is blocked, in s320. Accordingly, the user may attach the water intake container 170 to the attachment body 272 without concerns for mal-operation of the dispenser lever 136.

If attachment of the water intake container 170 is not detected (no in s310), i.e., if the water intake container 170 is not attached to the attachment body 272, the refrigerator 1 may discharge clean water or ice through the outlet 116 according to manipulation of the dispenser lever 136.

After the water intake container 170 is attached, it may be detected and determined whether the water intake container 170 is separated. Such detection and determination of separation of the water intake container 170 may be made by the attachment sensor 272 outputting an electric signal related to separation of the water intake container, or by the attachment sensor 272 stopping outputting the attachment-related electric signal.

If the water intake container is separated (yes in s330), then the clean water or ice is discharged through the outlet 116 according to manipulation of the dispenser lever 136. If the water intake container is not separated (no in s330), the clean water or ice may not be supplied through the outlet 116 even if the dispenser lever 136 is manipulated, in s320.

A second embodiment of a method for controlling a refrigerator will now be described in connection with FIG. 38.

Figure 38:
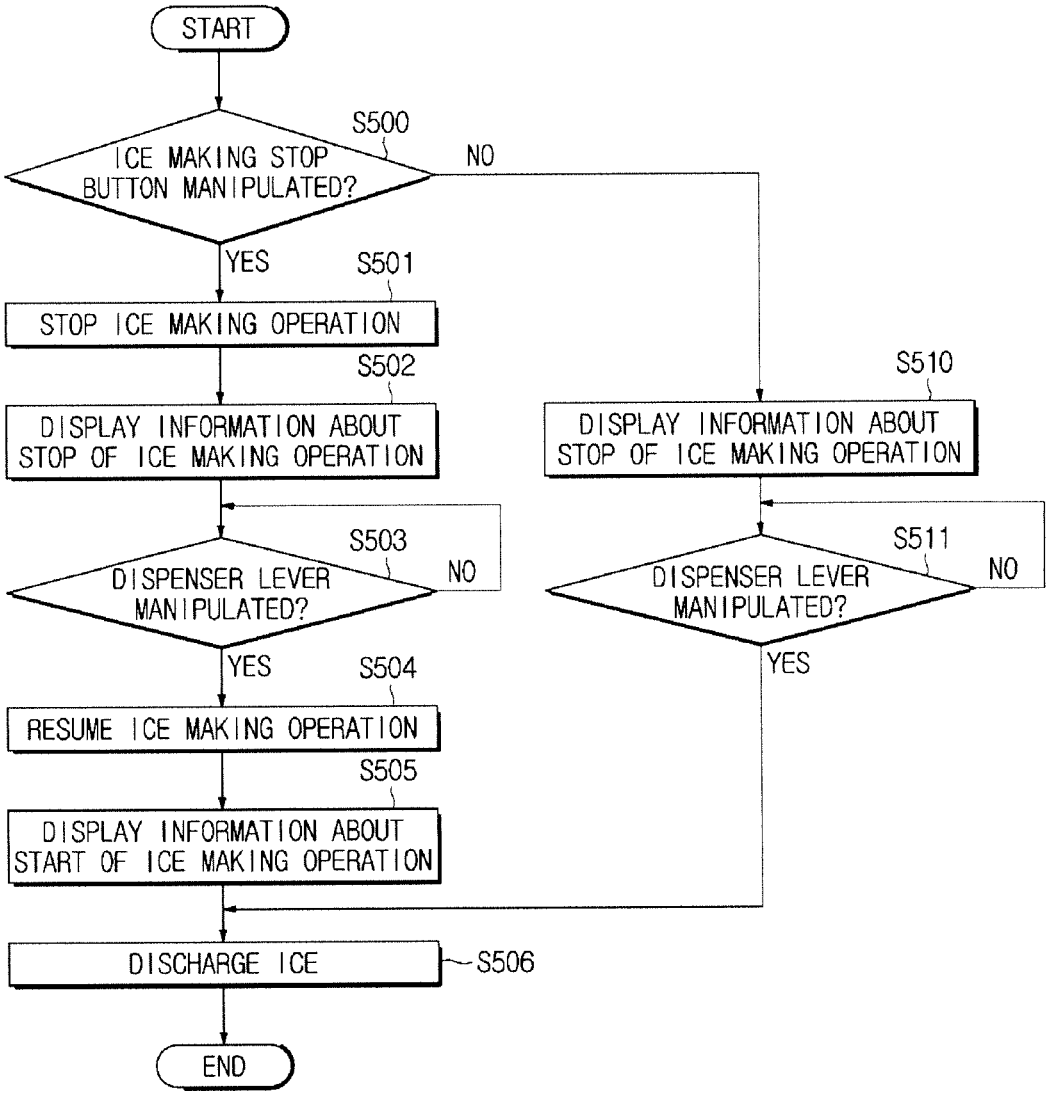
FIG. 38 is a flowchart showing a second embodiment of a method for controlling a refrigerator.

FIG. 38 is a flowchart showing a second embodiment of a method for controlling a refrigerator;

Referring to FIG. 38, the user may first input a user command to stop ice making to the refrigerator 1 by manipulating the unit 426 to input a command to start/stop the ice maker, such as a ice making stop button (yes in s500).

Once the unit 426 to input a command to start/stop the ice maker is manipulated by the user, the ice maker 800 of the refrigerator 1 stops ice making operation, in s501. At the same time as the moment of stopping the ice making operation or subsequently, the user interface 400 of the refrigerator 1 may provide the user with information indicating that the ice making operation of the ice maker 800 is stopped, in s502.

If the user manipulates the unit 441 to input a command to discharge clean water and manipulates the dispenser lever 136 (yes in s503) while the ice maker 800 of the refrigerator 1 stops ice making operation, the ice maker 800 resumes ice making operation in response to the user's manipulation of the dispenser lever 136, in s504. At the same time as the moment of starting the ice making operation of the ice maker 800 or subsequently, the user interface 400 may display and provide information indicating that the ice making operation of the ice maker 800 has begun to the user, in s505.

Once the ice making operation of the ice maker 800 is resumed, ice may be discharged through the outlet 116, in s506.

If the user does not manipulate the unit 426 to input a command to start/stop ice maker, such as the ice making stop button while the ice maker 800 is performing ice making operation, or if the user inputs a user command to start ice making operation of the ice maker 800 by manipulating the unit 426 to input a command to start/stop the ice maker (no in s500), the ice maker 800 of the refrigerator 1 performs ice making operation, and at the same time or at a different time, the user interface 400 may display information indicating that the ice making operation is being performed, in s510. In this case, if the user interface 400 has displayed the information indicating that ice making operation is being performed, the user interface 400 may maintain the display status, and if the user interface 400 has provided the user with the information indicating that the ice making operation is stopped, the user interface 400 starts displaying and providing information indicating that the ice making operation is being performed to the user.

In this case, if the user manipulates the dispenser lever 136 (yes in s511), the refrigerator 1 may provide the user with ice formed by the ice maker 800 through the outlet 116, in s506. If the user does not manipulate the dispenser lever 136 (no in s511), the refrigerator 1 may wait until a new user command is entered.

A third embodiment of a method for controlling a refrigerator will now be described in connection with FIG. 39.

Figure 39:
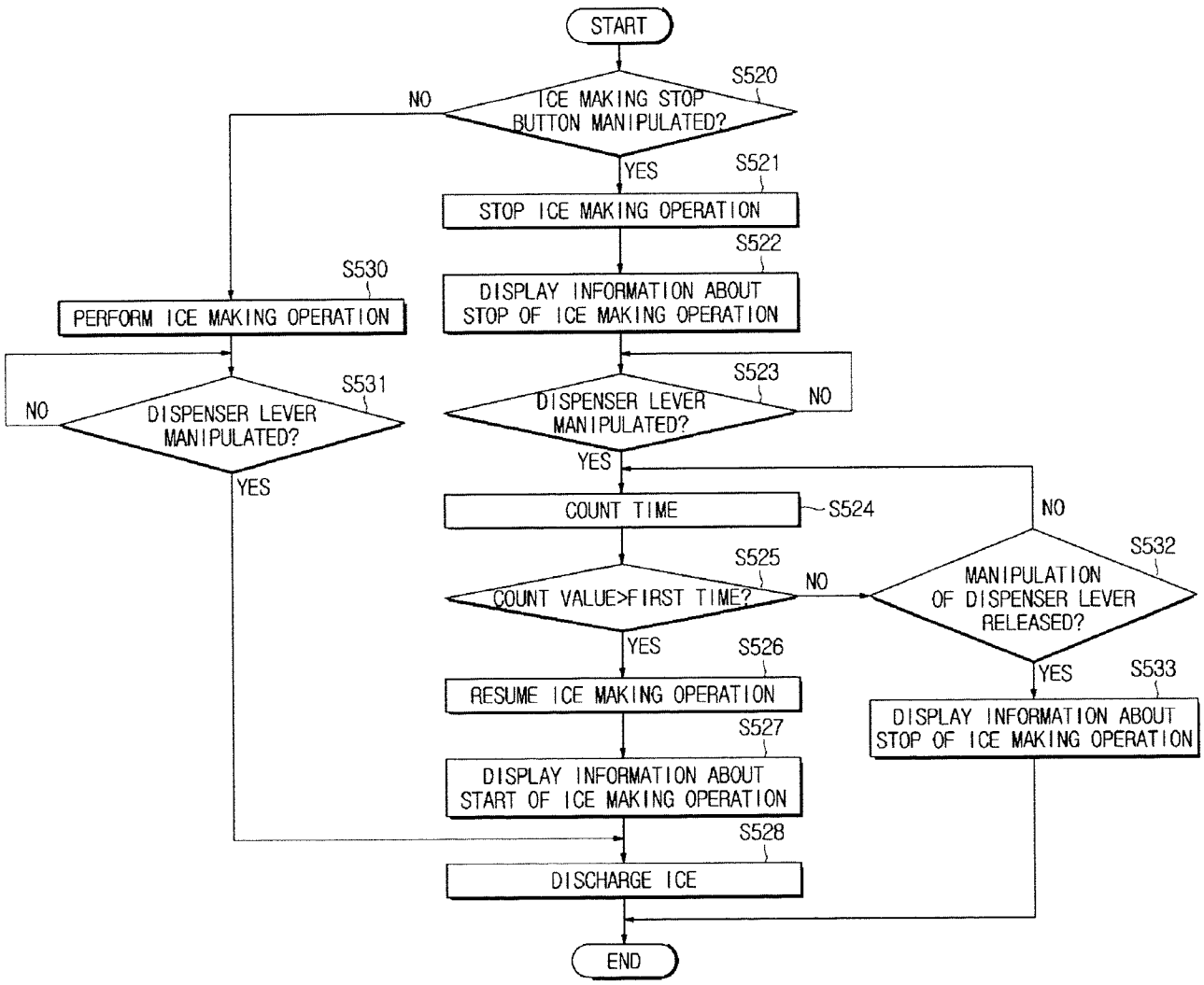
FIG. 39 is a flowchart showing a third embodiment of a method for controlling a refrigerator.

FIG. 39 is a flowchart showing a third embodiment of a method for controlling a refrigerator.

Referring to FIG. 39, at first, if the ice maker 800 is performing ice making operation, the user may manipulate the unit 426 to input a command to start/stop the ice maker, such as the ice making stop button to input a user command to stop ice making of the ice maker 800 (yes in s520).

Once the unit 426 to input a command to start/stop the ice maker is manipulated, the ice maker 800 may stop ice making operation, in s521, and simultaneously or subsequently, the user interface 400 may provide the user with information indicating that ice making operation of the ice maker 800 is stopped, in s522.

If the user manipulates the unit 442 to input a command to discharge ice and manipulates the dispenser lever 136 (yes in s523) while the ice maker 800 of the refrigerator 1 stops ice making operation, the processor 300 of the refrigerator 1 starts counting time with an extra embedded clock, in s524.

The processor 300 of the refrigerator 1 may compare the count value of the time with a predetermined first time in s525, and if the count value of the time exceeds the predetermined first time (yes in s525), the processor 300 controls the ice maker 800 to resume ice making operation according to the user's manipulation of the dispenser lever 136, in s526. In some embodiments, at the same time as the moment of starting the ice making operation of the ice maker 800 or subsequently, the user interface 400 may display and provide information indicating that the ice making operation of the ice maker 800 has begun to the user, in s528.

If the count value of the time does not exceed the predetermined first time (no in s525), the refrigerator 1 may determine whether manipulation of the dispenser lever 136 is stopped, in s532. In other words, the refrigerator 1 may determine whether the dispenser lever 136 has been released.

If manipulation of the dispenser lever 136 is stopped (yes in s532), the refrigerator 1 resets the count value of the time to an initial value, e.g., 0, and the user interface 400 keeps displaying information indicating that ice making operation is stopped, in s533.

If manipulation of the dispenser lever 136 is not stopped, the processor 300 of the refrigerator 1 may repeat counting time in s524 and comparing the count value with the first time in s525, and based on the comparison, perform aforementioned operations s526 to s58, s532, s533.

If the user does not manipulate the unit 426 to input a command to start/stop the ice maker, such as the ice making stop button while the ice maker 800 is performing ice making operation, or if the user inputs a user command to start ice making operation of the ice maker 800 by manipulating the unit 426 to input a command to start/stop the ice maker (no in s520), the ice maker 800 performs ice making operation and the user interface 400 may display information indicating that the ice making operation is being performed, in s530.

If the user manipulates the dispenser lever 136 (yes in s531), the refrigerator 1 may provide the user with ice formed by the ice maker 800 through the outlet 116. If the user does not manipulate the dispenser lever 136 (no in s531), the refrigerator 1 may wait until a new user command is entered.

A fourth embodiment of a method for controlling a refrigerator will now be described in connection with FIG. 40.

Figure 40:
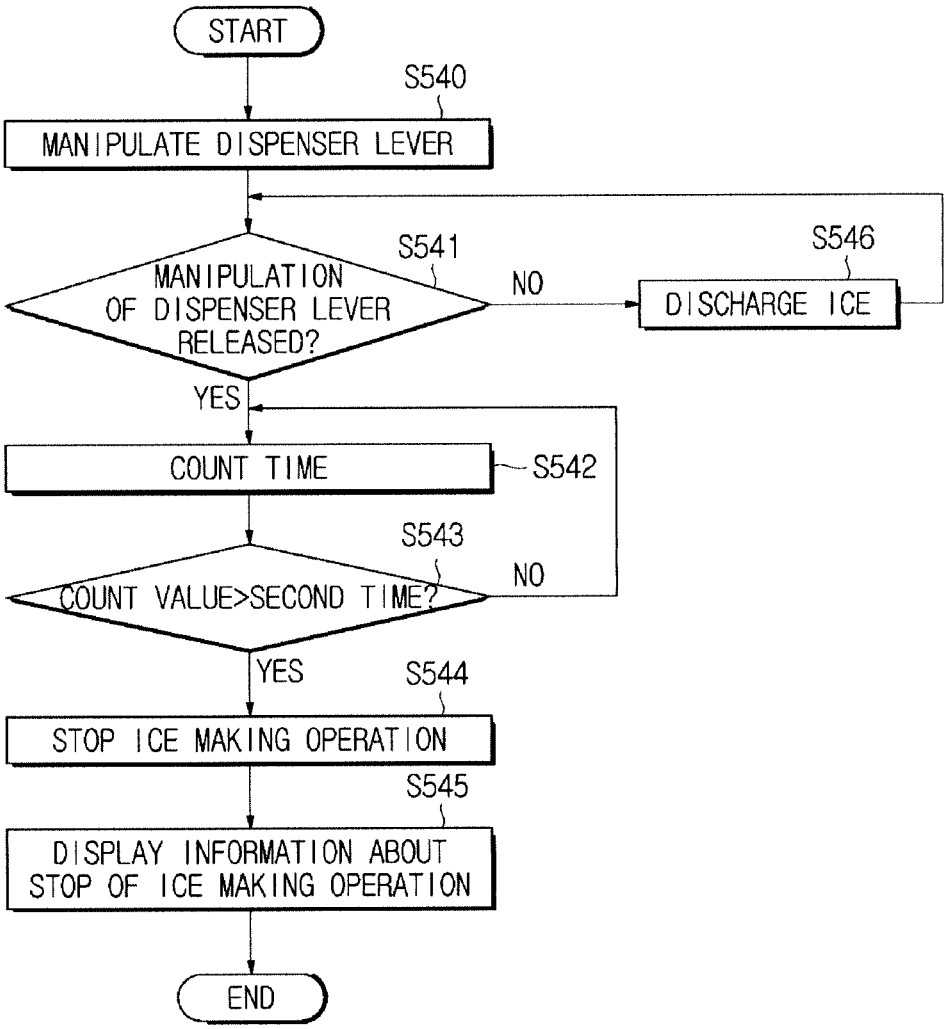
FIG. 40 is a flowchart showing a fourth embodiment of a method for controlling a refrigerator.

FIG. 40 is a flowchart showing the fourth embodiment of a method for controlling a refrigerator.

Referring to FIG. 40, if the ice maker 800 of the refrigerator 1 is or is not performing ice making operation, the dispenser lever 136 may be manipulated by the user, in s540. If the ice maker 800 is not performing ice making operation, as shown in FIGS. 38 and 39, the ice maker 800 may resume ice making operation to offer ice to the user.

If the user stops manipulation of the dispenser lever 136 in s541, the ice making operation may be stopped.

In this case, in an embodiment, if the user places the container away from the dispenser lever 136 to release the dispenser lever 136, the processor 300 of the refrigerator 1 may start counting time with an extra embedded clock, in s542.

The processor 300 of the refrigerator 1 may compare the count value of the time with a predetermined second time in s543, and if the count value of the time exceeds the predetermined second time (yes in s543), the processor 300 controls the ice maker 800 to stop ice making operation, in s544. In this case, in some embodiments, at the same time as the moment of starting the ice making operation of the ice maker 800 or subsequently, the user interface 400 may provide information indicating that the ice making operation of the ice maker 800 has stopped to the user in various methods, in s545.

If the count value of the time does not exceed the predetermined second time (no in s543), the processor 300 may keep counting time. The processor 300 may keep counting time until the result of counting exceeds the second time or the dispenser lever 541 is manipulated again. In some embodiments, if the dispenser lever 541 is manipulated again, the processor 300 may reset the count value of time to an initial value.

In the meantime, if the user keeps manipulating the dispenser lever 136 in s541 by keeping on applying force to the dispenser lever 136, the refrigerator 1 keeps discharging ice through the outlet 116 to offer it to the user, in s546.

A fifth embodiment of a method for controlling a refrigerator will now be described in connection with FIG. 41.

Figure 41:
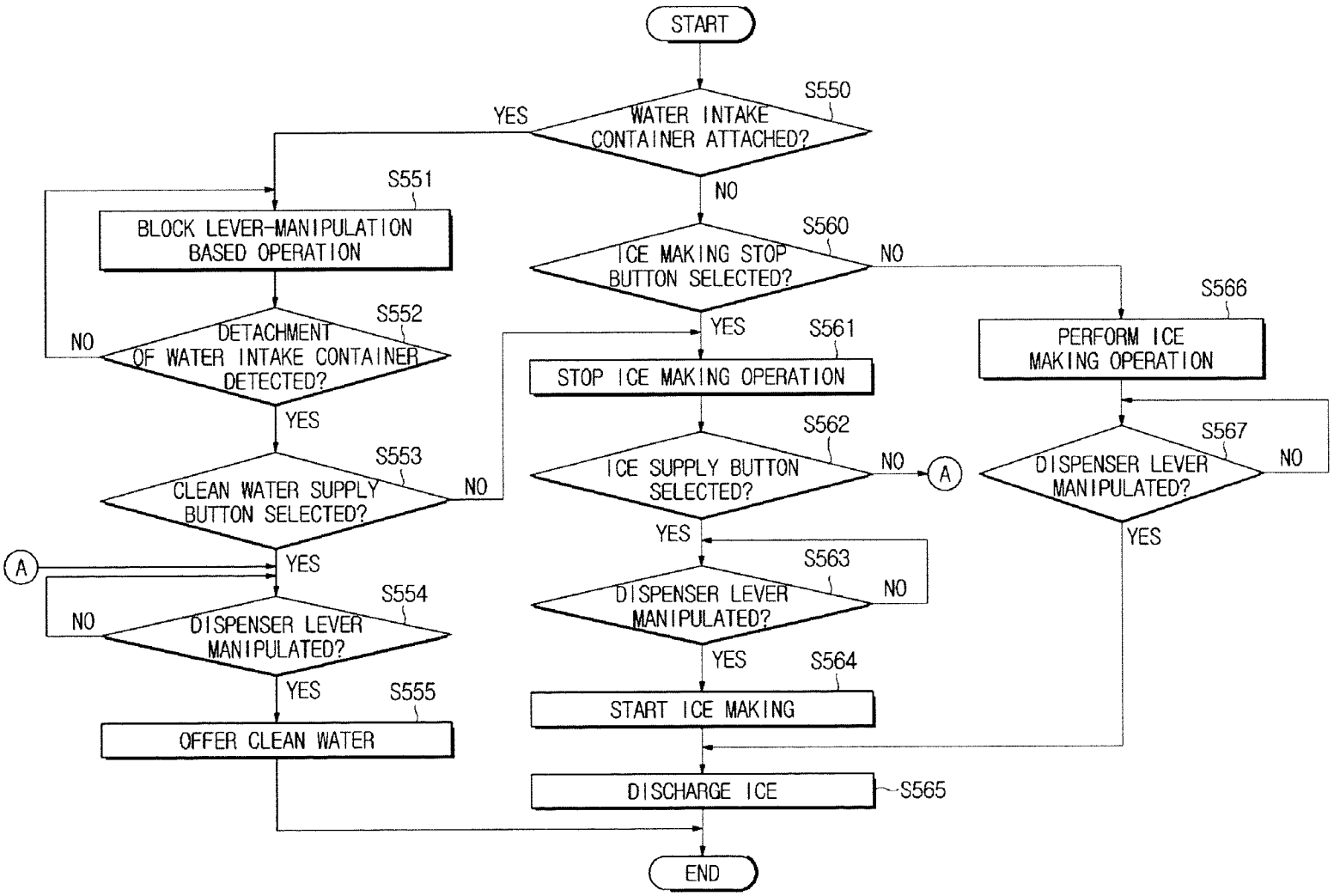
FIG. 41 is a flowchart showing a fifth embodiment of a method for controlling a refrigerator.

FIG. 41 is a flowchart showing the fifth embodiment of a method for controlling a refrigerator.

Referring to FIG. 41, the water intake container 170 may be attached to the attachment body 272, in s550. If the user attaches the water intake container 170 to the attachment body 272, operation from manipulation of the dispenser lever 136 is blocked, in s551, as described above.

After that, if detachment of the water intake container is detected (yes in s552) when the user detaches the water intake container 170 from the attachment body 272, and the user manipulates the unit 441 to input a command to discharge clean water, such as a clean water supply button, the refrigerator 1 is set to offer clean water to the user.

Subsequently, if the user manipulates the dispenser lever 136 (yes in s554), the refrigerator 1 may offer clean water to the user by discharging the clean water through the outlet 116, in s555. If the user does not manipulate the dispenser lever 136 (no in s554), the refrigerator 1 may wait until another command is entered from the user.

If the user does not select the unit 441 to input a command to discharge clean water in s533, the user may select and manipulate the unit 442 to input a command to discharge ice, such as an ice supply button, and in this case, the refrigerator 1 may perform various operations in s560 to s567 according to whether the ice making operation of the ice maker 800 is stopped.

In the meantime, in an embodiment, if the ice maker 800 is performing operation while the water intake container is not attached (no in s550), the user may manipulate the unit 426 to input a command to start/stop the ice maker, such as the ice making stop button to stop operation of the ice maker 800, in s560.

In response to the user's manipulation of the unit 426 to input a command to start/stop the ice maker, the ice maker 800 of the refrigerator 1 may stop ice making operation, in s561.

If the user does not select the unit 442 to input a command to discharge ice, such as the ice supply button (no in s562), the user may select and manipulate the unit 441 to input a command to discharge clean water (yes in s553). In this case, clean water is offered according to manipulation of the dispenser lever 136, in s554, s555.

If the user selects the unit 442 to input a command to discharge ice, such as the ice supply button (yes in s562), and manipulates the dispenser lever 136 (yes in s563), as described above, the ice maker 800 whose operation has been stopped resumes operation to produce ice, in s564. The ice produced by the ice maker 800 is discharged through the outlet 116, in s565. If the dispenser lever is not manipulated (no in s563), the refrigerator 1 may wait until a command is entered from the user.

If the user does not manipulate the unit 426 to input a command to start/stop the ice maker, the ice maker 800 may keep performing ice making operation, in s566.

If the unit 442 to input a command to discharge ice is manipulated and the dispenser lever 136 is also manipulated (yes in s567), the ice produced by the ice maker 800 is discharged through the outlet 116, in s565. If the dispenser lever is not manipulated (no in s567), the refrigerator 1 may wait until a command is entered from the user.

A method for controlling the refrigerator in accordance with the aforementioned embodiments may be implemented in the form of a program that may be performed by various computer means. The program herein may include program instructions, data files, data structures, etc., alone or in combination. The program may be designed and produced using not only machine language codes which may be made by a compiler but also high-level language codes which are executable by a computer using an interpreter. Furthermore, the program may be specially designed to implement the method for controlling the refrigerator, and may be implemented using various usable functions or definitions known to ordinary skilled people in computer software applications.

The program to implement the method for controlling the refrigerator may be recorded on a computer-readable recording medium. The computer-readable recording medium may include various types of hardware devices that may store particular programs that are executed by calls from computers, magnetic disk storage media like hard disks or floppy disks, magnetic tapes, optical media like compact discs (CDs) or digital versatile disks (DVDs), magneto-optical media like floptical disks, or semiconductor storage devices like read only memories (ROMs), random access memories (RAMs), or flash memories.

Although various embodiments of a refrigerator and method for controlling the same are described above, the refrigerator and method for controlling the same is not exclusively limited to the embodiments. Various other embodiments that may be implemented by ordinary skilled people in the art modifying and changing the aforementioned embodiments may also fall within the scope of the present disclosure. For example, the aforementioned method may be performed in different order, and/or the aforementioned systems, structures, devices, circuits, etc., may be combined in different combinations from what is described above, and/or replaced or substituted by other components or equivalents thereof, to obtain appropriate results.

INDUSTRIAL APPLICABILITY

The aforementioned refrigerator and method for controlling the same is applicable in various fields, such as homes and/or industrial area.

The invention claimed is:

1. A refrigerator comprising:

an attachment body to which a water intake container is attachable to and detachable from;

a dispenser lever; and a plurality of paths and valves configured to discharge water or ice according to the manipulation of the dispenser lever, and, with the water intake container being attached to the attachment body, supply carbon dioxide and the water to the water intake container;

an attachment sensor to detect whether the water intake container is attached to the attachment body; and a processor configured to determine whether the water intake container is attached to the attachment body based on an electric signal output from the attachment sensor, and when the water intake container is determined to be attached to the attachment body, control to prevent the discharge of the water or ice according to the manipulation of the dispenser lever.

2. The refrigerator of claim 1, wherein the plurality of paths and valves are configured so that the discharge of the water or ice according to the manipulation of the dispenser lever is allowed when the water intake container is detached from the attachment body.

3. The refrigerator of claim 1, wherein the refrigerator has a water intake space in which the attachment body and the dispenser lever are located, with the dispenser lever being further back in the water intake space than the detachment body, and the dispenser lever is manipulated by being moved in a back-and-forth direction in the water intake space, according to an applied pressure.

4. The refrigerator of claim 1, wherein the plurality of paths and valves comprises:

a clean water inflow valve configured to regulate the water supplied to the water intake container, and a dispenser supply valve configured to regulate the discharge of the water or ice, and the refrigerator further comprises a processor configured to control the clean water inflow valve to be opened and the dispenser supply valve to be closed when the water intake container is attached to the attachment body, and control the clean water inflow valve to be closed and the dispenser supply valve to be opened when the water intake container is detached from the attachment body.

5. The refrigerator of claim 1, further comprising:

an ice maker configured to perform an ice making operation; and a user interface configured to receive a command for at least one of start and stop of the ice making operation of the ice maker.

6. The refrigerator of claim 5, wherein the ice maker is configured to stop the ice making operation when receiving a command to stop the ice making operation through the user interface, to start the ice making operation when the dispenser lever is manipulated while the ice making operation of the ice maker is stopped, or to stop the ice making operation when manipulation of the dispenser lever is completed.

7. The refrigerator of claim 6, wherein the user interface is configured to output information about the start of the ice making operation of the ice maker when the ice maker starts the ice making operation or to output information about the stop of the ice making operation of the ice maker when the ice maker stops the ice making operation.

8. The refrigerator of claim 6, further comprising:

a processor configured to measure a period for which the dispenser lever is manipulated when the dispenser lever is manipulated while the ice maker stops the ice making operation, and control the ice maker to start the ice making operation when the measurement result exceeds a predetermined value.

9. The refrigerator of claim 1, wherein the processor controls the plurality of paths and valves to, when the water intake container is determined to be attached to the attachment body, supply the carbon dioxide and water to the water intake container through the attachment body.

10. The refrigerator of claim 1, wherein the processor controls the plurality of paths and valves to, when the water intake container is determined to be detached to the attachment body, discharge the water or ice according to the manipulation of the discharge lever through an outlet that is spaced apart from the attachment body.

* * * * *